US007457569B2

(12) United States Patent
Kawai

(10) Patent No.: US 7,457,569 B2
(45) Date of Patent: Nov. 25, 2008

(54) PROCESS CARTRIDGE, DEVELOPER SUPPLY CARTRIDGE AND ELECTROPHOTOGRAPHIC IMAGE FORMING APPARATUS

(75) Inventor: Tachio Kawai, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/613,508

(22) Filed: Dec. 20, 2006

(65) Prior Publication Data

US 2007/0223970 A1 Sep. 27, 2007

Related U.S. Application Data

(62) Division of application No. 11/556,539, filed on Nov. 3, 2006.

(30) Foreign Application Priority Data

Mar. 10, 2006 (JP) ..... 2006/066011
Oct. 31, 2006 (JP) ..... 2006/295074

(51) Int. Cl.
*G03G 15/08* (2006.01)

(52) U.S. Cl. ..... 399/258; 399/260

(58) Field of Classification Search ..... 399/258, 399/260, 262

See application file for complete search history.

(56) References Cited

U.S. PATENT DOCUMENTS 5,266,998 A 11/1993 Lee ..... 399/119 X
5,294,963 A 3/1994 Nakano et al. ..... 399/106
5,402,216 A 3/1995 Komaki et al.
5,450,178 A 9/1995 Kawashima et al. ..... 399/262
5,671,461 A 9/1997 Ishii ..... 399/27
5,734,953 A 3/1998 Tatsumi ..... 399/262
5,826,150 A 10/1998 Folkins ..... 399/260

(Continued)

FOREIGN PATENT DOCUMENTS

CN 1090659 A 8/1994

(Continued)

OTHER PUBLICATIONS

Patent Abstracts of Japan, vol. 18, No. 600 (P-1826) Nov. 15, 1994 (JP 06-222664).

(Continued)

*Primary Examiner*—Susan S Lee
(74) *Attorney, Agent, or Firm*—Fitzpatrick, Cella, Harper & Scinto

(57) ABSTRACT

A developer supply cartridge supplies a developer into a process cartridge, and is detachably mountable to a main assembly of an electrophotographic image forming apparatus. The process cartridge includes a drum, a developing roller, a receiving-side shutter portion opening and closing a developer receiving opening, a receiving-side movable portion to move the receiving-side shutter portion, and a regulating member for regulating movement of the receiving-side movable portion. The developer supply cartridge includes a supplying-side developer accommodating portion, a developer supply opening supplying the developer from the supplying-side developer accommodating portion into the process cartridge through the developer receiving opening, a supplying-side shutter portion opening and closing the developer supply opening, and a supplying-side movable portion to open the supplying-side shutter portion when the developer supply cartridge enters the main assembly and the process cartridge is set in the main assembly, by engagement with the receiving-side movable portion.

12 Claims, 29 Drawing Sheets

U.S. PATENT DOCUMENTS

| | | | | |
|---|---|---|---|---|
| 5,848,516 | A | 12/1998 | Ban | 53/453 |
| 5,933,691 | A | 8/1999 | Johroku | 399/262 |
| 6,023,594 | A | 2/2000 | Okiyama et al. | 399/12 |
| 7,010,250 | B1 | 3/2006 | Yahagi | 399/258 |
| 7,283,769 | B2 * | 10/2007 | Noh | 399/262 |
| 2002/0085857 | A1 | 7/2002 | Kim et al. | 399/119 |

FOREIGN PATENT DOCUMENTS

| | | |
|---|---|---|
| EP | 0 604 991 | 7/1994 |
| EP | 0 616 268 | 9/1994 |
| JP | 59-5254 | 12/1984 |
| JP | 4-12378 | 1/1992 |
| JP | 5-216344 | 8/1993 |
| JP | 6-222664 | 8/1994 |
| JP | 8-286490 | 11/1996 |
| JP | 9-269639 | 10/1997 |

OTHER PUBLICATIONS

Patent Abstracts of Japan, vol. 17, No. 658 (P-1654) Dec. 6, 1993 (JP 05-216344).

Patent Abstracts of Japan, vol. 161, No. 63 (P-1341), Apr. 21, 1992 (JP 4-012378).

Patent Abstracts of Japan, vol. 1998, No. 2, Jan. 30, 1998 (JP 9-269639).

Apr. 26, 2007 Notification of Transmittal, International Search Report, and Written Opinion of International Search Authority for PCT Application No. PCT/JP2007/050541.

Jul. 7, 2006 Notification of First Office Action in Chinese Application No. 2004100015323.

* cited by examiner (a)

(b)

(a)

(b)

PROCESS CARTRIDGE, DEVELOPER SUPPLY CARTRIDGE AND ELECTROPHOTOGRAPHIC IMAGE FORMING APPARATUS

CROSS REFERENCE TO RELATED APPLICATION

This is a divisional application of application Ser. No. 11/556,539 filed Nov. 3, 2006, pending.

FIELD OF THE INVENTION

The present invention relates to a process cartridge, a developer supply cartridge and an electrophotographic image forming apparatus usable with the same.

Here, the electrophotographic image forming apparatus (hereinafter called "image forming apparatus") is an apparatus forming an image on a recording material through an electrophotographic image forming process. Examples of such an apparatus include an electrophotographic copying machine, an electrophotographic printer (LED printer, laser beam printer or the like), an electrophotographic printer type facsimile machine, an electrophotographic printer type word processor and the like.

Here, the recording material is a material on which an image can be formed, and includes a recording sheet, an OHP sheet or the like.

Related Art

In the field of the image forming apparatus, a process cartridge type is known in which an electrophotographic photosensitive member and process means actable on the electrophotographic photosensitive member are unified into a cartridge which is detachably mountable to the main assembly of the image forming apparatus. With such a process cartridge type, the maintenance of the apparatus can be carried out by the user without relying on a service person. For this reason, the operationality is improved.

A process cartridge which can be supplied with a developer from a developer supply cartridge is also known. Such a supply type process cartridge is advantageous in that process cartridge can be downsized. This is because the developer accommodating portion thereof can be downsized.

In such a developer supply type, the developer supply cartridge is provided with a developer supply opening. Correspondingly, the process cartridge is provided with a developer receiving opening. The developer is supplied from the developer supply cartridge to the process cartridge with the developer supply opening and the developer receiving opening being aligned with each other.

It is necessary to prevention the developer from leaking, when the user mounts the process cartridge into the main assembly of the apparatus or when the user dismounts the process cartridge from the main assembly of the apparatus.

In addition, the developer leakage has also to be prevented, when the user mounts the developer supply cartridge to the main assembly of the apparatus or when the user dismounts the developer supply cartridge from the main assembly of the apparatus.

From the foregoing, the developer supply opening and the developer receiving opening are provided with opening and closing shutters, respectively.

As for the structure for opening and closing the developer supply opening, the following is known. A force reception engaging portion for engagement with the process cartridge is provided so that discharge opening shutter moves from a close position to an open position when the developer supply cartridge is mounted to the main assembly of the apparatus. In addition, a force is received from the process cartridge to move the discharge opening shutter from the open position to the close position when the developer supply cartridge is removed from the main assembly of the apparatus. By doing so, the developer supply opening is opened and closed (U.S. Pat. No. 7,010,250).

On the other hand, as for the system for opening and closing a developer receiving opening of the process cartridge, the following is known. The main assembly of the apparatus is provided with an engaging portion which applies a force to the receiving port shutter to move it in interrelation with process cartridge mounting and demounting operation relative to the main assembly of the apparatus. In this manner, the developer receiving opening is opened and closed (U.S. Pat. No. 7,010,250).

With such a structure, the developer supply opening can be opened and closed in either of the cases of mounting and demounting the developer supply cartridge relative to the main assembly of the image forming apparatus and mounting and demounting the process cartridge relative to the main assembly of the image forming apparatus.

Therefore, the developer supply opening can be opened and closed even when the developer supply cartridge or the process cartridge is mounted or demounted relative to the image forming apparatus, independently from each other.

It is realized in the developer supply type process cartridge that developer supply cartridge and the process cartridge can be mounted and mounted relative to the main assembly of the image forming apparatus independent from each other, without leakage of the developer.

For this reason, this technique is advantageous.

The present invention provides further development.

SUMMARY OF THE INVENTION

Accordingly, it is a principal object of the present invention to provide a developer supply cartridge, a process cartridge and an electrophotographic image forming apparatus wherein when the developer supply cartridge is removed from the main assembly of the apparatus in a state that both of the process cartridge and the developer supply cartridge are set in the main assembly of the electrophotographic image forming apparatus, the leakage of the developer through a developer supply opening or through the developer receiving opening can be prevented.

It is another object of the present invention to provide a developer supply cartridge, a process cartridge and an electrophotographic image forming apparatus wherein when the process cartridge is removed from the main assembly of the apparatus in a state that both of the process cartridge and the developer supply cartridge are set in the main assembly of the electrophotographic image forming apparatus, the leakage of the developer through a developer supply opening or through the developer receiving opening can be prevented.

It is a further object of the present invention to provide a developer supply cartridge, a process cartridge and an electrophotographic image forming apparatus wherein when the developer supply cartridge enters the main assembly of the apparatus in a state that process cartridge is set in the main assembly of the apparatus, the developer can be supplied through the developer supply opening under the condition that developer receiving opening is capable of receiving the developer.

It is a further object of the present invention to provide a developer supply cartridge, a process cartridge and an electrophotographic image forming apparatus wherein when the process cartridge enters the main assembly of the apparatus in a state that developer supply cartridge is set in the main assembly of the apparatus, the developer can be supplied through the developer supply opening under the condition that developer receiving opening is capable of receiving the developer.

It is a further object of the present invention to provide a developer supply cartridge, a process cartridge and an electrophotographic image forming apparatus wherein when the developer supply cartridge is removed from the main assembly of the apparatus in a state that both of the process cartridge and the developer supply cartridge are set in the main assembly of the apparatus, a supplying-side shutter can be moved from a developer-supply-permitting position to a developer-supply-preventing position under the condition that receiving-side shutter is placed at a developer-reception-permitting position.

It is a further object of the present invention to provide a process cartridge, a developer supply cartridge and an electrophotographic image forming apparatus wherein when the process cartridge is removed from the main assembly of the apparatus in a state that both of the process cartridge and the developer supply cartridge are set in the main assembly of the apparatus, a supplying-side shutter can be moved from a developer-supply-permitting position to a developer-supply-preventing position under the condition that receiving-side shutter is placed at a developer-reception-permitting position.

It is a further object of the present invention to provide a developer supply cartridge, a process cartridge and an electrophotographic image forming apparatus wherein when the developer supply cartridge enters the main assembly of the apparatus in a state that process cartridge is set in the main assembly of the apparatus, a supplying-side shutter can be moved from a developer-supply-preventing position to a developer-supply-permitting position under the condition that receiving-side shutter is placed at a developer-reception-permitting position.

It is a further object of the present invention to provide a process cartridge, a developer supply cartridge and an electrophotographic image forming apparatus wherein when the process cartridge enters the main assembly of the apparatus in a state that developer supply cartridge is set in the main assembly of the apparatus, a supplying-side shutter can be moved from a developer-supply-preventing position to a developer-supply-permitting position under the condition that receiving-side shutter is placed at a developer-reception-permitting position.

It is a further object of the present invention to provide a process cartridge, a developer supply cartridge and an electrophotographic image forming apparatus wherein a receiving-side movable member for interrelatedly moving a receiving-side shutter can be used for moving a supplying-side movable member.

It is a further object of the present invention to provide a process cartridge, a developer supply cartridge and an electrophotographic image forming apparatus wherein when the process cartridge enters the main assembly of the apparatus, a supplying-side shutter can be moved from a developer-supply-preventing position to a developer-supply-permitting position after a receiving-side shutter placed at a developer-reception-preventing position is moved a developer-reception-permitting position.

It is a further object of the present invention to provide a process cartridge, a developer supply cartridge and an electrophotographic image forming apparatus wherein a developer supply opening can be opened and closed by relative movement between the developer supply cartridge and the process cartridge.

It is a further object of the present invention to provide a process cartridge and an electrophotographic image forming apparatus wherein even if the process cartridge is entered into the main assembly of the apparatus in the state that developer supply cartridge is not set in the main assembly of the image forming apparatus, a developer receiving opening is not opened.

It is a further object of the present invention to provide a developer supply cartridge and an electrophotographic image forming apparatus wherein even if a developer supply cartridge is entered into the main assembly of the apparatus in the state that process cartridge is not set in the main assembly of the image forming apparatus, a developer supply opening is not opened.

According to an aspect of the present invention, there is provided a process cartridge detachably mountable to a main assembly of an electrophotographic image forming apparatus, wherein said process cartridge is capable of receiving a supply of a developer from a developer supply cartridge, wherein the developer supply cartridge includes a supplying-side developer accommodating portion for accommodating the developer, a supplying-side shutter portion movable between a developer-supply-permitting position for opening a developer supply opening for supplying the developer from the supplying-side developer accommodating portion into the process cartridge and a developer-supply-preventing position for closing the developer supply opening, a supplying-side movable portion movable to interrelatedly move the supplying-side shutter portion between the developer-supply-permitting position and the developer-supply-preventing position, and an engageable member, said process cartridge comprising an electrophotographic photosensitive drum; a developing roller for developing an electrostatic latent image formed on said electrophotographic photosensitive drum with the developer; a receiving-side developer accommodating portion for accommodating the developer; a developer receiving opening for receiving the developer into said receiving-side developer accommodating portion; a receiving-side shutter portion movable between a developer-reception-permitting position for opening said developer receiving opening and a developer-reception-preventing position for closing said developer receiving opening; a regulating member; and a receiving-side movable portion movable to interrelatedly move said receiving-side shutter portion between the developer-reception-permitting position and the developer-reception-preventing position, said receiving-side movable portion including a first receiving-side operating portion which takes an operating position when said receiving-side shutter portion is at the developer-reception-preventing position and a second receiving-side operating portion which takes the operating position when said receiving-side shutter portion is at the developer-reception-permitting position, wherein when said process cartridge enters the main assembly of the apparatus with said regulating member regulating movement to place said first receiving-side operating portion at the operating position in a state that said developer supply cartridge is set in the main assembly of the apparatus, said regulating member contacts the engageable member to release said receiving-side movable portion, thus permitting movement of said receiving-side movable portion, then receiving-side movable portion moves said receiving-side shutter portion to the developer-reception-permitting position in interrelation with said first receiving-side operating portion moved by contacting the engageable member, and then said receiving-side movable portion moves the supplying-side shutter portion to the developer-supply-permitting position in interrelation with the supplying-side movable portion moved by engagement of said second receiving-side operating portion with the supplying-side movable portion while being regulated by said regulating member in a state that second receiving-side operating portion is placed at the operating position.

According to another aspect of the present invention, there is provided a developer supply cartridge for supplying a developer into a process cartridge, said developer supply cartridge being detachably mountable to a main assembly of an electrophotographic image forming apparatus, wherein said process cartridge includes an electrophotographic photosensitive drum; a developing roller for developing an electrostatic latent image formed on said electrophotographic photosensitive drum; a receiving-side shutter portion movable between a developer-reception-permitting position for opening a developer receiving opening for receiving the developer to be used by said developing roller for developing operation and a developer-reception-preventing position for closing said developer receiving opening; a receiving-side movable portion movable to interrelatedly move said receiving-side shutter portion between the developer-reception-permitting position and the developer-reception-preventing position, said receiving-side movable portion including a receiving-side operating portion which takes an operating position when said receiving-side shutter portion is at said developer-reception-permitting position; a regulating member for regulating movement of said receiving-side movable portion when said receiving-side operating portion is at the operating position, said developer supply cartridge comprising a supplying-side developer accommodating portion for accommodating the developer; a developer supply opening for supplying the developer from said supplying-side developer accommodating portion into said process cartridge through said developer receiving opening; a supplying-side shutter portion movable between a developer-supply-permitting position for opening said developer supply opening and a developer-supply-preventing position for closing said developer supply opening; and a supplying-side movable portion movable, when said developer supply cartridge enters said main assembly of the apparatus in a state that process cartridge is set in said main assembly of the apparatus, to interrelatedly move said supplying-side shutter portion from said developer-supply-preventing position to the developer-supply-permitting position by engagement with said receiving-side operating portion of said receiving-side movable portion, a movement of which is regulated by said regulating member in a state that receiving-side operating portion is positioned at the operating position.

According to a further aspect of the present invention, there is provided an electrophotographic image forming apparatus comprising the process cartridge and the developer supply cartridge detachably mountable to the main assembly of the apparatus independently from each other.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the preferred embodiments of the present invention will be described.

First Embodiment

[General Arrangement of Image Forming Apparatus]

Figure 1:
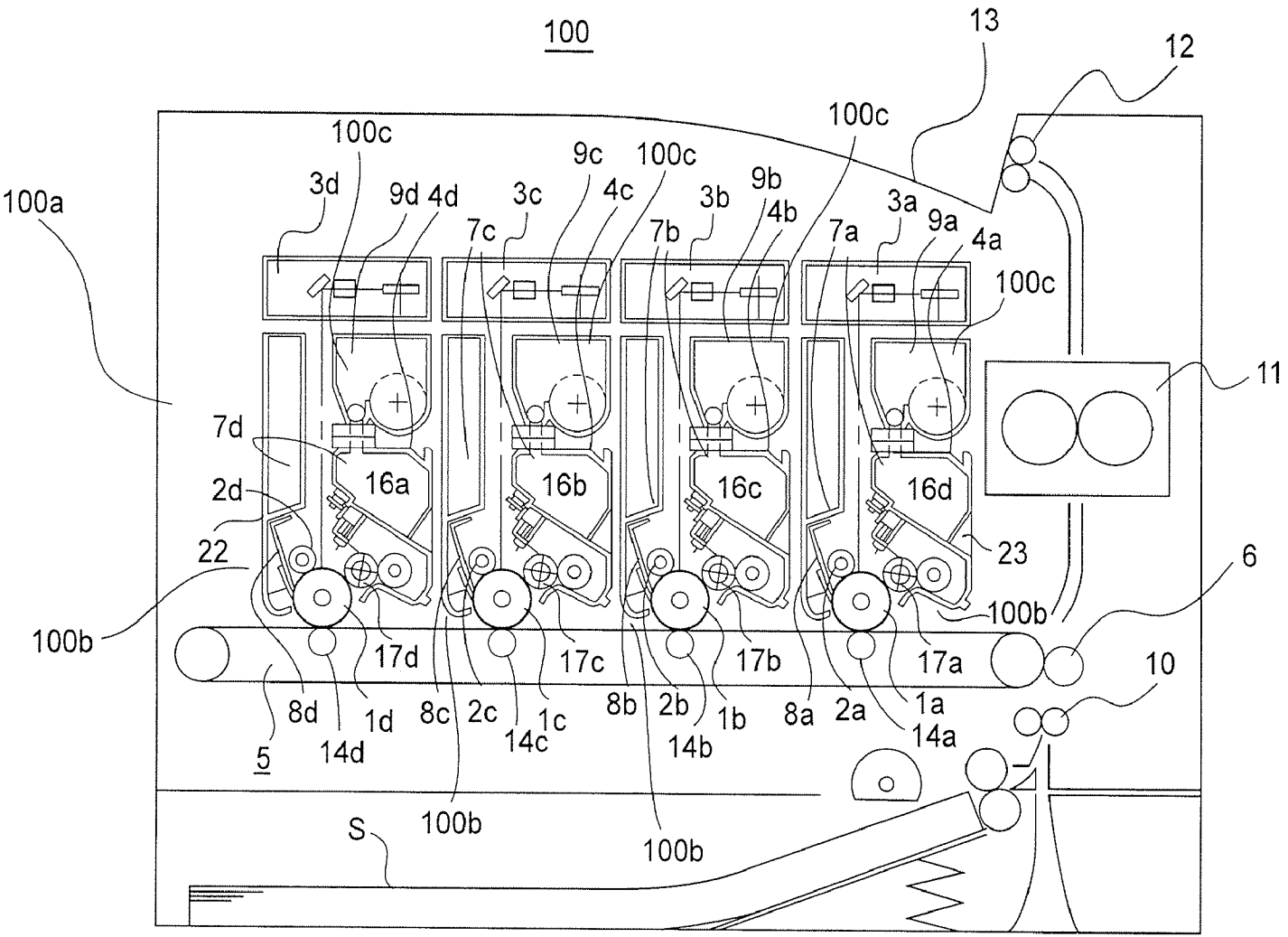
FIG. 1 is a sectional view of a main assembly of an electrophotographic type color image forming apparatus according to first embodiment of the present invention.

Referring to FIG. 1, the general arrangement of the image forming apparatus will be described. FIG. 1 is a longitudinal sectional view illustrating the general arrangement of a full-color laser beam printer 100 which is an exemplary image forming apparatus.

The image forming apparatus 100 comprises four process cartridges 7 (7*a*, 7*b*, 7*c*, 7*d*) arranged in a horizontal direction and four developer supply cartridges 9 (9*a*, 9*b*, 9*c*, 9*d*) provided correspondingly thereto. The process cartridges 7 and the developer supply cartridges 9 are detachably mountable to the main assembly 100*a* of the apparatus of the image forming apparatus 100 independently from each other. Here, the main assembly 100*a* of the apparatus means the entirety of the image forming apparatus 100 without the process cartridges 7 and the developer supply cartridges 9. The process cartridge 7 contains an electrophotographic photosensitive drum 1 (1*a*, 1*b*, 1*c*, 1*d*). The electrophotographic photosensitive drum (photosensitive drum) 1 is rotated by driving means (unshown) provided in the main assembly 100*a* of the apparatus.

The process cartridge 7 includes a charging roller (charging means) 2 (2*a*, 2*b*, 2*c*, 2*d*), developing means 4 (4*a*, 4*b*, 4*c*, 4*d*) and cleaning means 8 (8*a*, 8*b*, 8*c*, 8*d*) which are process means provided around the photosensitive drum 1. The main assembly 100*a* of the apparatus comprises scanner units 3 (3*a*, 3*b*, 3*c*, 3*d*) and intermediary transfer members 5, respectively such that they are around the photosensitive drum 1 when the process cartridges are mounted to the main assembly. The developed image formed on the photosensitive drum 1 is transferred onto an intermediary transfer member 5 by primary transferring means 14 (14*a*, 14*b*, 14*c*, 14*d*). The primary transferring means 14 is provided in the main assembly 100*a* of the apparatus.

The charging roller 2 is urged to the photosensitive drum 1 and functions to uniformly charge the surface of the photosensitive drum 1. The scanner unit 3 projects a laser beam onto the photosensitive drum 1 to form the electrostatic latent image on the photosensitive drum 1. The developing means 4 (4*a*-4*d* (4*a*-4*d*) functions to develop the electrostatic latent image with a developer into a developed image. The developing means 4 develops the electrostatic latent image. The cleaning means 8 functions to remove the residual developer remaining on the surface of the photosensitive drum 1 after the toner image is transferred.

The photosensitive drum 1, and the process means including the charging roller 2, the developing means 4 and the cleaning means 8 constitute a unit, that is, a process cartridge 7.

The operation of image formation will be described. First, the photosensitive drum 1 is rotated in timed relation with image formation. The scanner units 3 are operated sequentially for the respective process cartridges 7. The voltage is applied to the charging roller 2 rotated by the photosensitive drum 1 while being in contact thereto by which the peripheral surface of the photosensitive drum 1 is charged electrically to a uniform potential. The scanner unit 3 produces a light beam modulated in accordance with the image signal, and the peripheral surface of the photosensitive drum 1 is exposed to the image light. By doing so, an electrostatic latent image is formed on the peripheral surface of the photosensitive drum 1. The electrostatic latent image is developed with a developer by the developing roller 17 (17*a*-17*d*) of the developing means 4. By this, a developed image is formed on the peripheral surface of the photosensitive drum 1 by the developing roller 17. Thus, the developing roller 17 develops the electrostatic latent image using the developer.

Thereafter, the primary transferring means 14 is supplied with a bias voltage of a polarity opposite to that of the developed image. By doing so, the developed image formed on the photosensitive drum 1 is transferred onto the intermediary transfer member 5 (primary transfer).

The developed images (four color developed images) formed on the photosensitive drum 1 are overlaid on the intermediary transfer member 5. Thereafter, secondary transferring means 6 is press-contacted to the intermediary transfer member 5. The recording material S having been stopped at a predetermined position by the registration roller 10 is delivered to a nip formed between the intermediary transfer member 5 and the secondary transferring means 6.

The process cartridge 7*a* accommodates a yellow color developer. The process cartridge 7*b* accommodates a magenta color developer. The process cartridge 7*c* accommodates a cyan color developer. The process cartridge 7*d* accommodates a black color developer. Therefore, a yellow color developed image is formed on the photosensitive drum 1*a*. Similarly, a magenta color developed image is formed on the photosensitive drum 1*b*, a cyan color developed image is formed on the photosensitive drum 1*c*, and a black color developed image is formed the photosensitive drum 1*d*.

The process cartridges 7*a*, 7*b*, 7*c* and 7*d* have the same structures although the colors of the contained developers are different.

The secondary transferring means 6 is supplied with a bias voltage of the polarity opposite from that of the developer. Therefore, the developed images on the intermediary transfer member 5 are transferred all together onto the surface of the fed recording material S.

Thereafter, the recording material S is fed to the fixing device 11 and is fixed by heat and pressure. The recording material S is discharged onto the discharging tray 13 by discharging rollers 12. In this manner, the image forming operation is completed.

The developer is consumed by the developing operation. With the consumption of the developer, the developer is supplied sequentially from the developer supply cartridge 9 (9*a*, 9*b*, 9*c*, the) which will be described hereinafter.

The structures of the developer supply cartridges 9*a*, 9*b* the 9*c* and 9*d* are the same although the colors of the contained developer are different from each other.

Designated by reference characters 100*b* is a process cartridge mounting portion having a space into which the process cartridge 7 is mounted dismountably.

Designated by 100*c* is a supply cartridge mounting portion having a space into which the supply cartridge 9 is mounted dismountably.

The mounting portion 100*b* and 100*c* are provided in the main assembly 100*a* of the apparatus.

[Entering Fashions of Process Cartridge 7 and Developer Supply Cartridge 9]

Referring to FIG. 2 to FIG. 5, the description will be made as to fashions of insertion of the process cartridge 7 and the developer supply cartridge 9 into the main assembly 100*a* of the apparatus.

Figure 5:
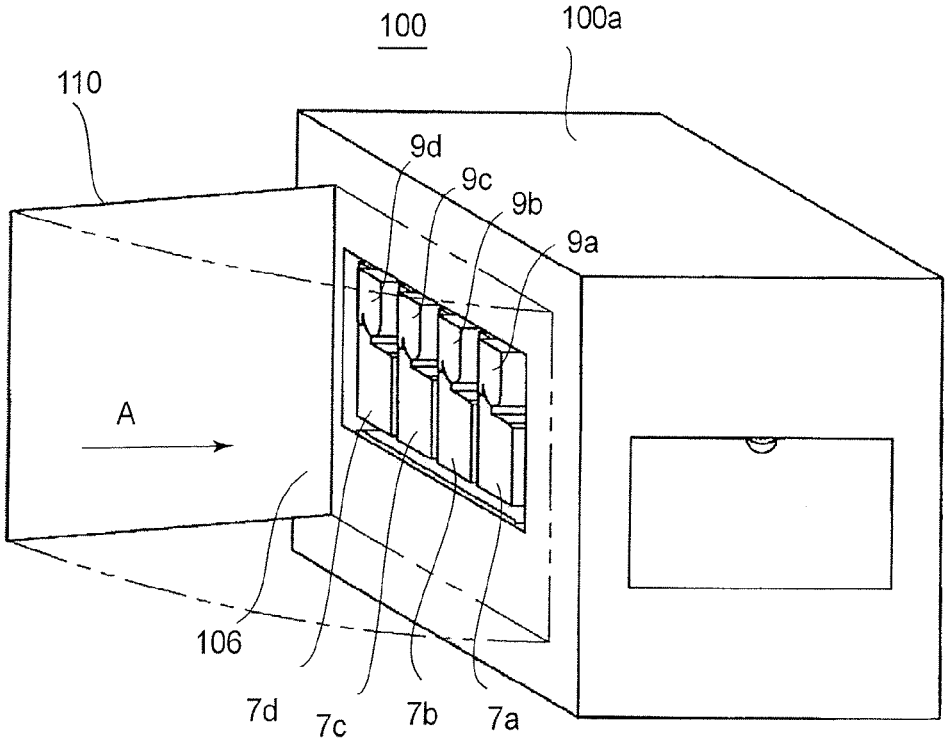
FIG. 5 is a perspective view of the process cartridge and the toner developer supply cartridge, illustrating a mounting style thereof into the color image forming apparatus, according to the first embodiment of the present invention.

First, the operator opens a cartridge cover 110 provided in the main assembly 100*a* of the apparatus (FIG. 5). Then, the operator advances the process cartridge 7 into the main assembly 100*a* of the apparatus along the longitudinal direction of the photosensitive drum 1 (direction of arrow A in the Figure). In addition, the operator advances the developer supply cartridge 9 into the main assembly 100*a* of the apparatus along the longitudinal direction of the supplying-side developer accommodating portion 33 (direction of arrow A in the Figure). Thus, the cartridges 7 and 9 are inserted in the longitudinal direction. The process cartridge 7 and the developer supply cartridge 9 receive driving forces from the main assembly 100*a* of the apparatus at a rear side of the main assembly 100*a* of the apparatus (leading side with respect to the entering direction.

The developer supply cartridge 9 is carried on main assembly rails 101*a*, 101*b* provided in the main assembly 100*a* of the apparatus at portions-to-be-guided 42*a*, 42*b* of the developer supply cartridge 9 (FIG. 2) when the developer supply cartridge 9 is inserted.

The process cartridge 7 is carried on main assembly rails 102*a*, 102*b* provided in the main assembly 100*a* of the apparatus at portions-to-be-guided 43*a*, 43*b* (FIG. 2) of the process cartridge 7.

[Structure of Process Cartridge]

Figure 2:
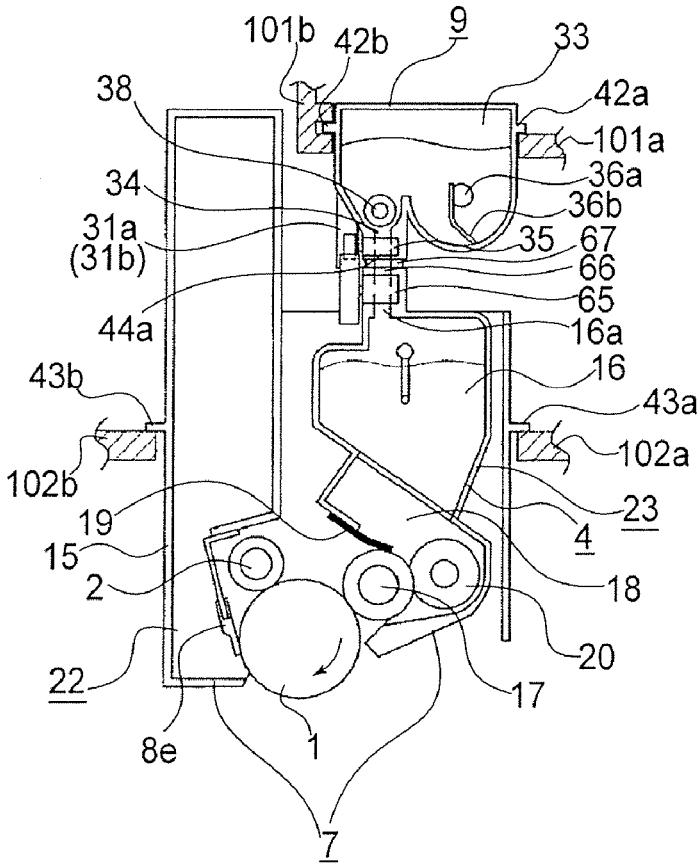
FIGS. 2(*a*) and 2(*b*) are sectional views of a process cartridge and a developer supply cartridge mountable to a color image forming apparatus according to the first embodiment of the present invention, where FIG. 2(*b*) is an enlarged sectional view of a guide portion of the main assembly of the apparatus.
Figure 2:
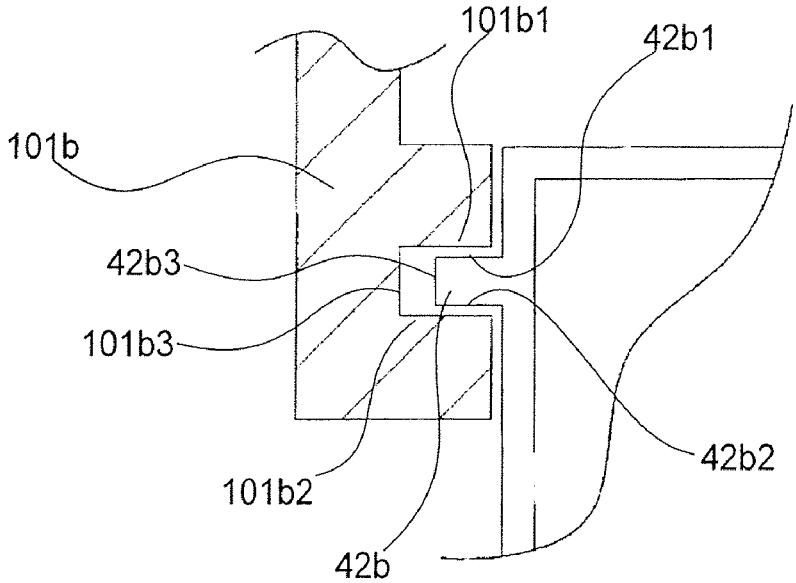
Figure 3:
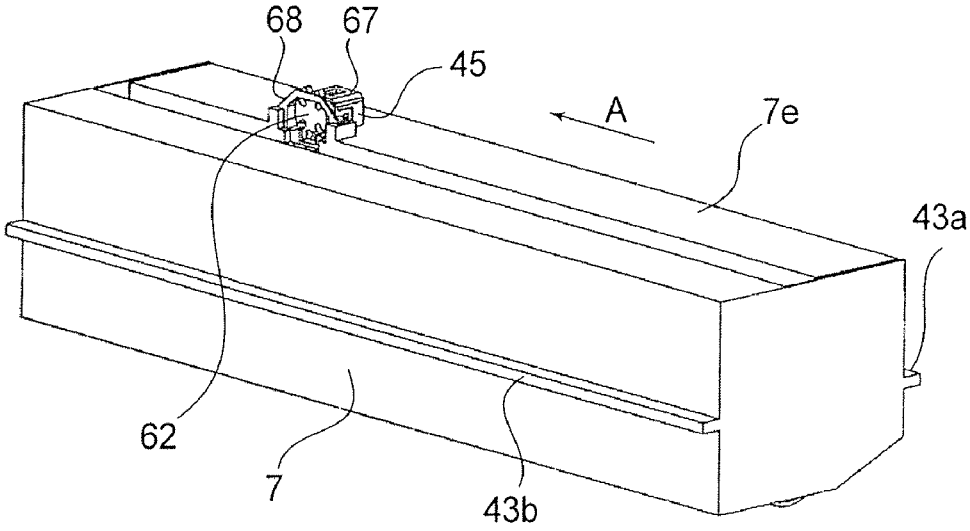
FIG. 3 is a perspective view of a process cartridge according to the first embodiment of the present invention.
Figure 4:
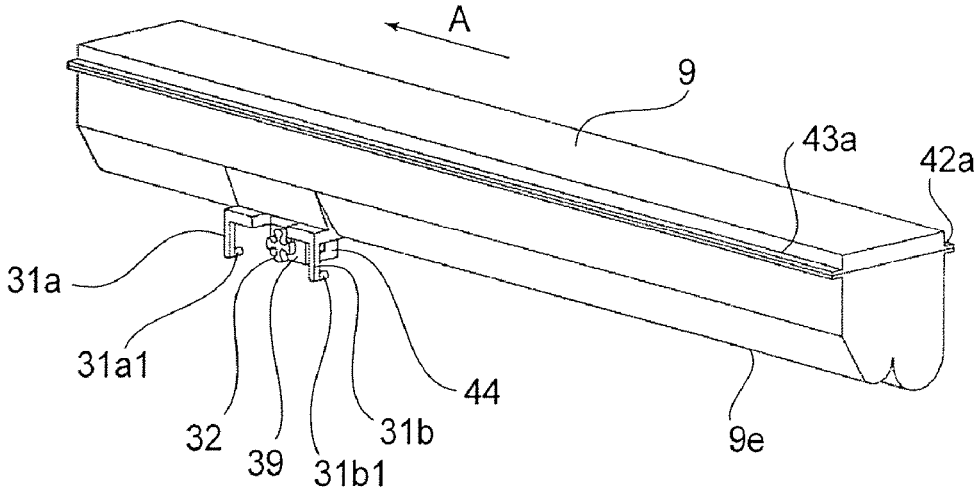
FIG. 4 is a perspective view of a developer supply cartridge according to the first embodiment of the present invention.

Referring to FIGS. 2 and 3, the structure of the process cartridge 7 will be described.

As shown in FIG. 2, the process cartridge 7 comprises a cleaning unit 22 and a developing unit 23 which are rotatably connected with each other.

The cleaning unit 22 comprises the cleaner container 15 which is a frame rotatably supporting the photosensitive drum 1 and comprises a charging roller 2. The cleaning unit 22 further comprises cleaning means 8 in the form of cleaning blade 8*e* and so on. The cleaning blade 8*e* functions to remove the developer remaining on the photosensitive drum 1.

On the other hand, in a frame including the developing means 4, a receiving-side developer accommodating portion 16 (developer accommodating portion) for accommodating the developer and a developing container 18 are connected with each other by ultrasonic welding or the like. The developing unit 23 includes the developer accommodating portion 16 and the developer container 18. The developing container 18 rotatably supports the developing roller 17. A fresh (unused) process cartridge 7 contains a predetermined amount of the developer in the developer accommodating portion 16. The developer is consumed for image formation, and the developer is supplied from the developer supply cartridge 9.

The developing container 18 includes the developing roller 17, a developing blade 19 for regulating a layer thickness of the developer deposited on the peripheral surface of the developing roller 17, and a developer supplying roller 20 in the form of a sponge roller for supplying the developer onto the developing roller 17.

The developing unit 23 is rotatable relative to the cleaning unit 22.

The developer supply cartridge 9 (9*a*-9*d*) is mounted above the developing unit 23 (developer accommodating portion 16) in the main assembly 100*a* of the apparatus in the state that process cartridge 7 (7*a*-7*d*) is mounted to the main assembly 100*a* of the apparatus. The developer accommodating portion 16 is provided in an upper portion with a developer receiving opening 16*a* for receiving the developer from the supply cartridge 9. Above the receiving opening 16*a*, there is provided a receiving-side shutter 65 for opening and closing the receiving opening 16*a*. The shutter 65 opens and closes the receiving opening 16*a* by rotation. Thus, the shutter 65 is movable between a developer-reception-permitting position for opening the receiving opening 16*a* for receiving the developer and a developer-reception-preventing position for closing the receiving opening 16*a*. An upper portion of the shutter 65 is provided with a sealing member 67, made of urethane foam, felt or the like, for connecting the process cartridge 7 and the developer supply cartridge 9 with each other. The receiving opening 16*a* functions to receive the developer into the developer accommodating portion 16 from the supply cartridge 9. The process cartridge 7 is dismountably mounted to the mounting portion 100*b*, and the supply cartridge 9 is dismountably mounted to the mounting portion 100*c* thereabove. The process cartridge 7 and the supply cartridge 9 are detachably mountable relative to the main assembly 100*a* of the apparatus independently from each other.

The sealing member 67 functions to prevent leakage of the developer through the connecting portion between the supply cartridge 9 and the process cartridge 7 when the developer is supplied from the supply cartridge 9 into the process cartridge 7. The sealing member 67 is provided to assure the prevention of the developer leakage, and is not inevitable.

[Structure of Developer Supply Cartridge]

Referring to FIGS. 2 and a, the structure of the developer supply cartridge 9 will be described.

The supply cartridge 9 comprises a supplying-side developer accommodating portion 33 for accommodating the developer. In the state that process cartridge 7 and the supply cartridge 9 are mounted to or set in the main assembly 100*a* of the apparatus, the lower portion of the developer accommodating portion 33 is provided with a developer supply opening 34 which may be aligned with the receiving opening 16*a*. Through the receiving opening 16*a* and the receiving opening 16*a*, the developer it supplied from the inside of the developer accommodating portion 33 into the process cartridge 7. More particularly, the developer is supplied into the receiving-side developer accommodating portion 16 from the process cartridge 7. Above the supply opening 34, there is provided a screw 38 for feeding the developer. The screw 38 is rotated by receiving the training force from the main assembly 100*a*. By doing so, the developer is fed to the supply opening 34. Then, the developer is fed to the receiving opening 16*a* from the supply opening 34.

The developer accommodating portion 33 it is provided therein with a developer feeding members 36 (36*a*, 36*b*) for feeding the developer to the screw 38. The shaft portion 36*a* it supplied with a rotational driving force by which the developer fed sheet 36*b* coupled with the shaft portion 36*a* is rotated. In this manner, the fed sheet 36*b* feeds the developer to the screw 38.

At the lower portion of the supply opening 34, there is provided a supplying-side shutter 35 for opening and closing the opening 34. The opening 34 is opened and closed by rotation of the shutter 35. In other words, the shutter 35 is capable of take a developer-supply-permitting position where the shutter 35 opens the supply opening 34 for supplying the developer into the process cartridge 7 through the receiving opening from the developer accommodating portion 33. In addition, the shutter 35 can take a developer-supply-preventing position where it closes the supply opening 34. The lower surface of the developer accommodating portion 33 is provided with a first engageable member 31*b* extending downward. The first engageable member 31*b* is disposed at a trailing side of the supplying-side communication opening (T container communication opening) 44*a* as seen in an entering direction in which the developer supply cartridge 9 enters into the main assembly 100*a* of the apparatus. At the leading side, a second engageable member 31*a* is provided similarly. Thus, at the upstream side of the supply opening 34, the first engageable member 31*b* is provided, and at the downstream side thereof, the second engageable member 31*a* is provided, with respect to the entering direction in which the supply cartridge 9 enters the main assembly 100*a* of the apparatus.

[Shutter Mechanism of Developer Supply Cartridge]

Referring to FIG. 6 to FIG. 8, FIGS. 17, 23 and 26, the structure of a shutter mechanism of the supply cartridge 9 according to this embodiment of the present invention will be described.

Figure 6:
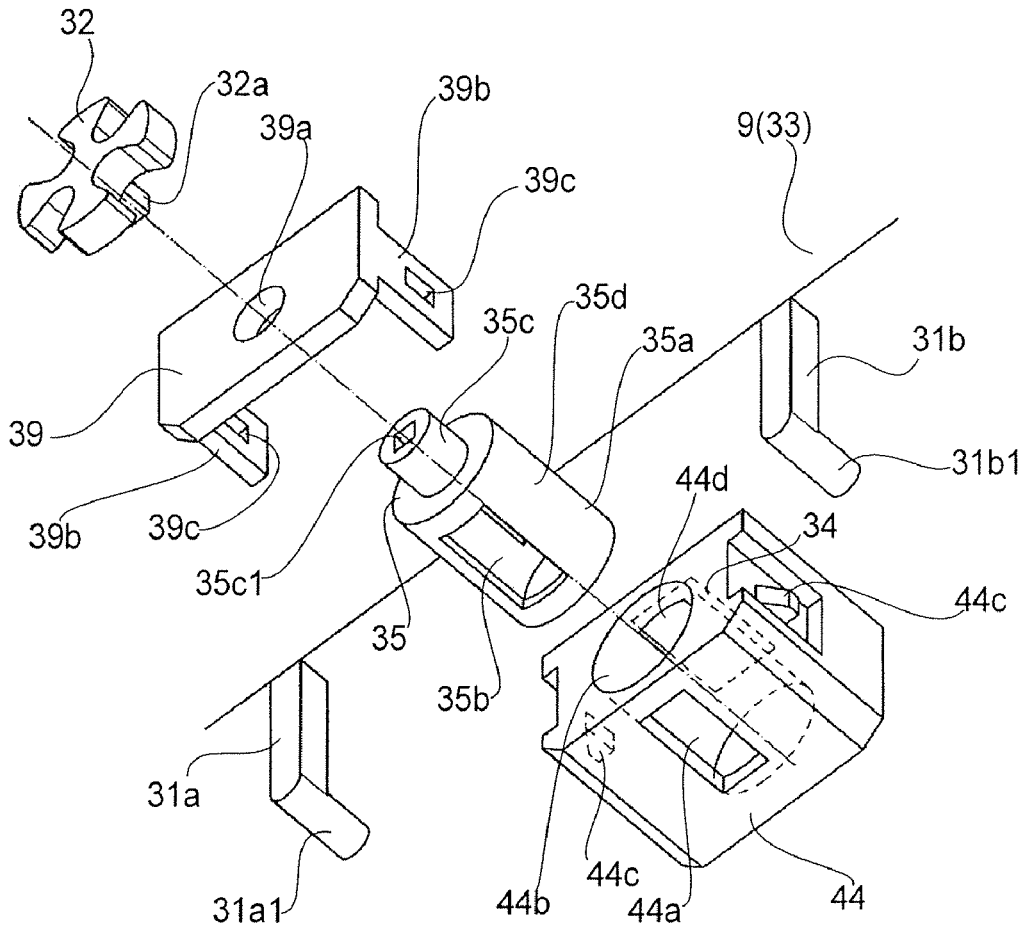
FIG. 6 is an exploded perspective view of a shutter of a developer supply cartridge and the elements therearound.
Figure 7:
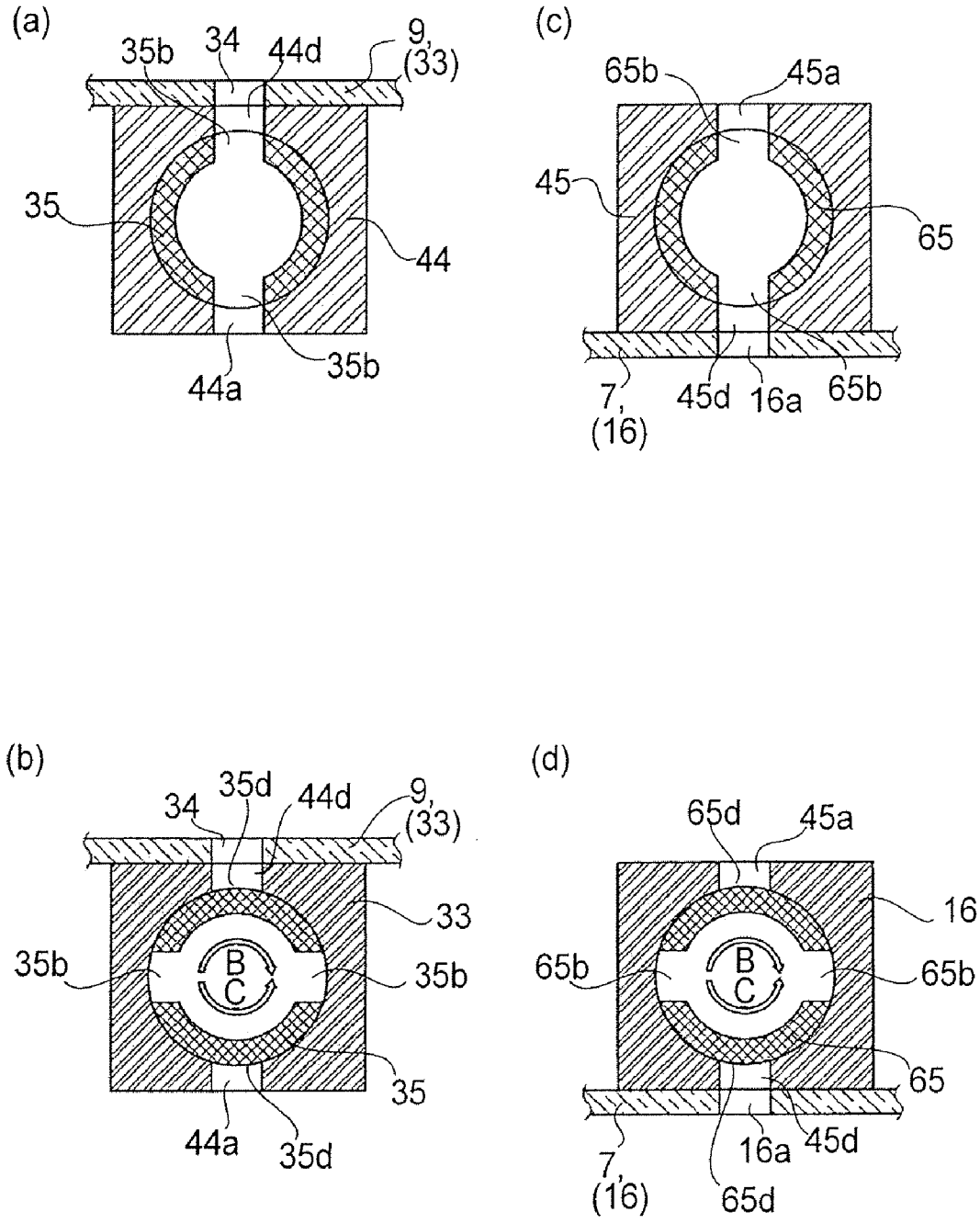
FIGS. 7(*a*)-7(*d*) are sectional views of a supplying-side shutter wherein FIG. 7(*a*) illustrates a state that supply opening is open, FIG. 7(*b*) illustrates a state that supply opening is closed by a supplying-side shutter, FIG. 7(*c*) illustrates a state that receiving opening is opened by a receiving-side shutter, FIG. 7(*d*) illustrates a state that receiving opening is closed by the receiving-side shutter.
Figure 8:
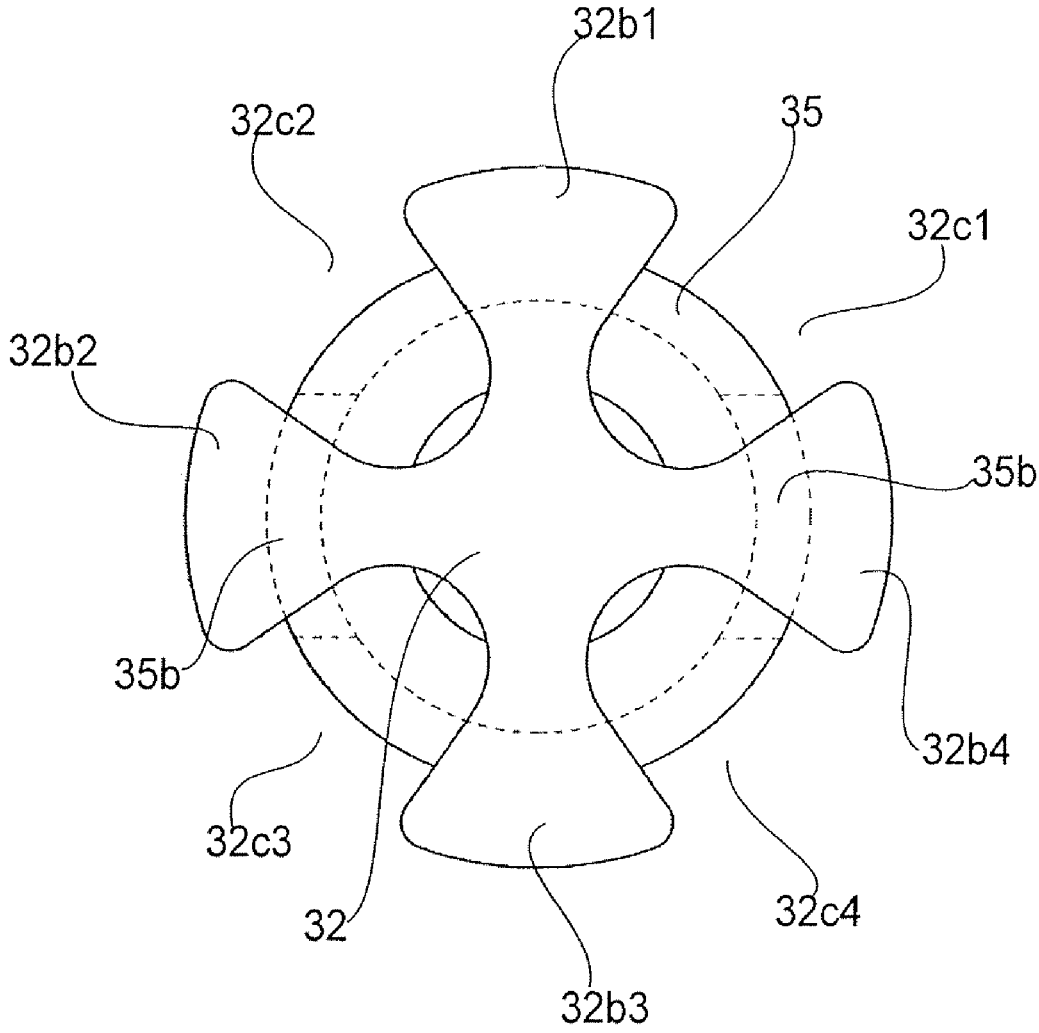
FIG. 8 is a front view of a supplying-side movable member and a supplying-side shutter, illustrating connection therebetween.
Figure 17:
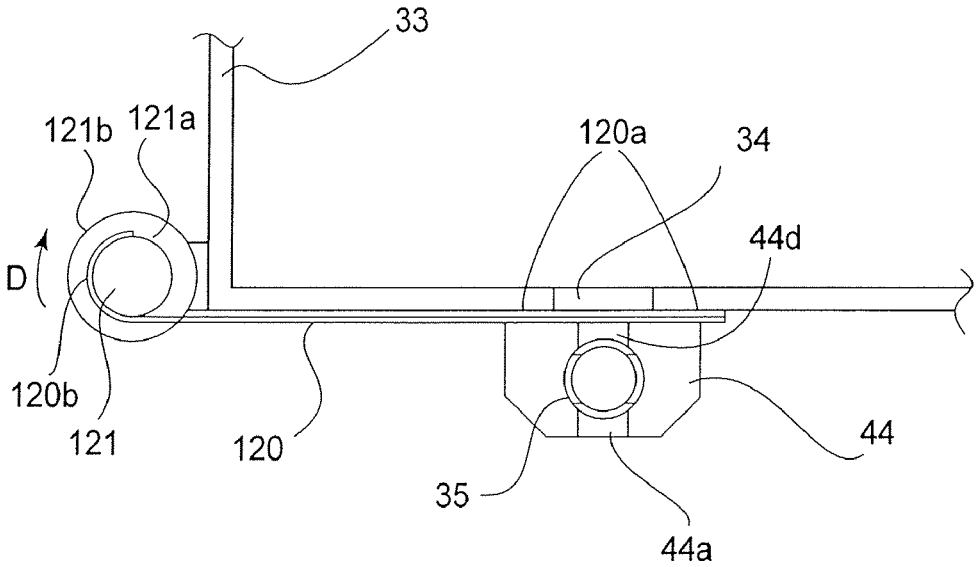
FIG. 17 is a front view of a toner seal winding-up portion of a developer supply cartridge according to the first embodiment of the present invention.
Figure 23:
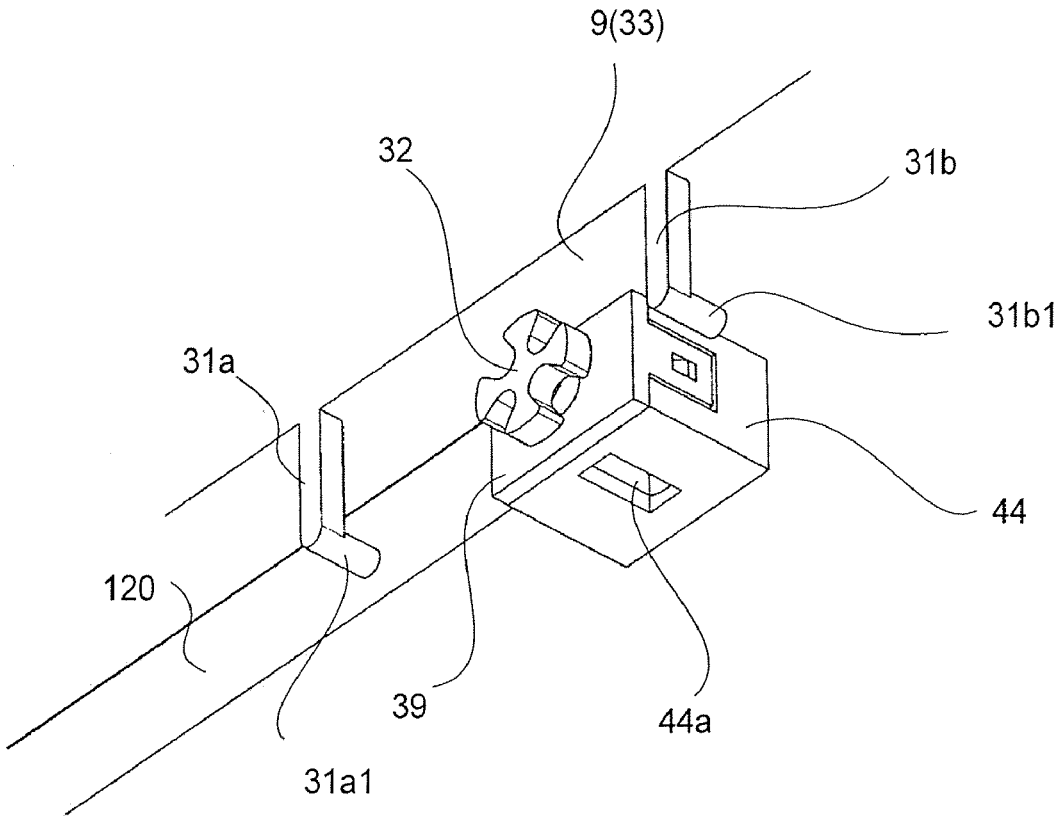
FIG. 23 is a perspective view of a shutter of the developer supply cartridge and the elements therearound, according to the first embodiment of the present invention.
Figure 26:
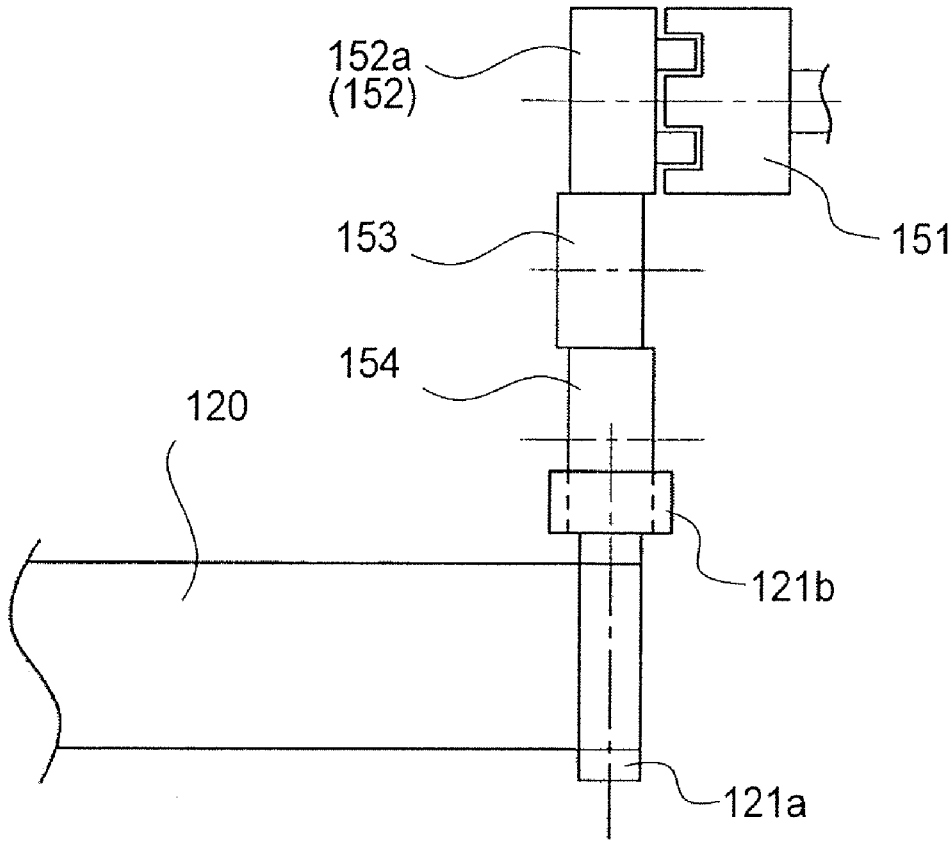
FIG. 26 illustrates operations of the toner seal winding-up portion of the developer supply cartridge according to the first embodiment of the present invention.

FIG. 6 is an exploded perspective view of the shutter 35 (supplying-side shutter portion) (rotatable member) of the supply cartridge 9. FIG. 7 illustrates the supplying-side shutter 35 opening the supply opening 34(*a*), and the supplying-side shutter 35 closing the supply opening 34(*b*). FIG. 7 also illustrates the receiving-side shutter 65 opening the receiving opening 16*a* (c), and the receiving-side shutter 65 closing the receiving opening 16*a* (d). FIG. 8 is a front view of the supplying-side movable member (supplying-side movable portion) 32 and the shutter 35 which are coupled with each other. FIG. 26 illustrates a drive structure for the winding-up portion for winding up a toner seal of the supply cartridge 9. FIG. 17 is a front view of the winding-up portion. FIG. 23 is a perspective view of a shutter 35 and the parts in the neighborhood of the shutter 35.

A lower surface 9*e* of the developer accommodating portion 33 is provided with a T housing 44 fixed thereto. The T housing 44 is provided at an upper part with a T housing opening 44*d* and is provided at a lower part with a T container communication opening 44*a*. The developer in the developer accommodating portion 33 is supplied into the process cartridge 7 (developer accommodating portion 16) through the opening 44*d* and the communication opening 44*a*. Between the opening 44*d* and the communication opening 44*a*, there is provided a supplying-side shutter inserting portion 44*b*. The inserting portion 44*b* functions to rotatably support the cylindrical portion 35*a* of the shutter 35.

Here, the lower surface means the surface or side facing downward when the supply cartridge 9 is mounted to the main assembly 100*a* of the apparatus.

The shutter 35 is provided with a connecting portion 35*c* projecting from a lateral edge of the cylindrical portion 35*a* (base portion) outwardly in the axial direction of the cylindrical portion. The shutter 35 is provided with communication openings 35*b* through the periphery of the cylindrical portion 35*a* at the diametrically opposing positions, respectively. More particularly, the communication openings 35*b* are disposed opposed to the opening 34 and to the communication opening 44*a* with respect to a direction crossing with the axial direction. The cylindrical portion 35*a* is fitted into the shutter inserting portion 44*b* such that outer surface of the cylindrical portion 35*a* is contacted to the inner surface of the shutter inserting portion 44*b*. By doing so, the shutter 35 is rotatable relative to the developer accommodating portion 33.

At the open side of the shutter inserting portion 44*b*, there is provided a cap 39 for the inserting portion of the supplying-side shutter. The cap 39 is provided with arm portions 39*b* at the opposite end portions, respectively. Each of the arm portion 39*b* has a hole portion 39*c* which is engaged with a retaining portion 44*c* in the form of a claw provided on the T housing 44. By doing so, the cap 39 is fixed on the T housing 44. And, the shutter 35 is prevented from disengaging from the T housing 44.

The cap 39 has an opening 39*a* formed therein. Through the opening 39*a*, a connecting portion 35*c* of the shutter 35 is penetrated.

To the free end of the connecting portion 35*c* projected from the cap 39, a supplying-side movable member (supplying-side movable portion) 32 functioning to interrelatedly move the shutter 35 is fixed. The movable member 32 has an end projection 32*a* which is inserted into an end recess 35*c*1 formed in a free end surface of the shutter 35. The projection 32*a* is press-fitted into the recess 35*c*1. By doing so, the movable member 32 is fixed on the shutter 35. The movable member 32 is integrally rotatable with the shutter 35. In other word, the shutter 35 rotates in interrelation with rotation of the movable member 32.

The movable member 32 includes projections 32 (32*b*1, 32*b*2, 32*b*3, 32*b*4) and recesses 32*c* (32*c*1, 32*c*2, 32*c*3, 32*c*4) which are arranged alternately (FIG. 8).

The description will be made as to an assembling method and an operation of the shutter (supplying-side shutter portion) and the elements therearound.

First, the shutter 35 is inserted into the shutter inserting portion 44*b* of the T housing 44. The opening of the shutter inserting portion 44*b* is capped by the cap 39. Then, the hole portion 39*c* is engaged with the retaining portion 44*c* of the T housing 44. By doing so, the cap 39 is fixed to the T housing 44. Thereafter, the end projection 32*a* of the movable member 32 is press-fitted into the end recess 35*c*1 of the supplying-side shutter 35. Then, the T housing 44 is mounted on the developer accommodating portion 33 by screws (unshown) or the like.

FIG. 7, (*a*) is a sectional view of the shutter and the elements therearound in the state that developer supply cartridge 9 and the process cartridge 7 are mounted to or set in the image forming apparatus 100.

As shown in FIG. 7, (*a*), when the process cartridge 7 and the developer supply cartridge 9 are mounted, the supply opening 34, the opening 44*d* and the communication opening 44*a* are opposed to the supplying-side shutter communication port 35*b*. Therefore, the developer supply from the supply cartridge 9 into the process cartridge 7 is enabled. In this state, the screw 38 (FIG. 2) provided above the opening 34 and the opening 44*d* is rotated. By this, the developer is fed to the opening 34. Then, the developer is let fall from the supply opening 34 to the receiving opening 16*a*.

Thus, in the state shown in FIG. 7, (*a*), the shutter 35 is in the developer-supply-permitting position for opening the opening 34.

FIG. 7, (*b*) is a sectional view of the shutter and the elements therearound in the state that one of the developer supply cartridge 9 and the process cartridge 7 is taken out of the main assembly of the image forming apparatus 100*a*.

In the state shown in FIG. 7, (*b*), the shutter 35 is in the developer-supply-preventing position for closing the opening 34.

In this state, a portion of the cylindrical portion 35*a* of the shutter 35 other than the opening 35*d* (portion other than the communication opening 35*b*) is opposed to the supply opening 34, the opening 44*d* and the communication opening 44*a*.

When the supply cartridge 9 or the process cartridge 7 is removed from the main assembly 100*a* of the apparatus, the supplying-side movable member 32 receives a force from the receiving-side movable member (receiving-side movable portion) 62 of the process cartridge 7, which will be described hereinafter, to move, more particularly, to rotate in this embodiment. The shutter 35 rotates by 90° from the position permitting the developer supply (FIG. 7, (*a*)) to a position preventing the developer supply in either one of the directions indicated by arrows B and C (FIG. 7, (*b*)). By this, the opening 44*d* or the communication opening 44*a* of the supply cartridge 9 becomes not opposed to the communication opening 35*b*. By doing so, the opening 44*d* is closed so that supply of the developer into the process cartridge 7 is stopped.

In other words, the opening and closing operations of the shutter of the supply cartridge 9 are carried out by rotating the shutter 35 by 90°.

Between the developer accommodating portion 33 and the T housing 44, there is provided a T toner seal 120 (FIG. 17). One longitudinal end 120*a* of the toner seal 120 is fixed to the supply opening 34 to seal the supply opening 34. The other end 120*b* of the T toner seal 120 is fixed to a circular column portion 120*a* of a winding-up shaft 121. The winding-up shaft 121 is provided with a driving force receiving portion 120*b* which is rotatable integrally with the circular column portion 121*a*.

The driving force receiving portion 120*b* comprises a T driving force receiving coupling 152 for receiving a driving force from a main assembly coupling 151 provided in the main assembly 100*a* of the apparatus, when the supply cartridge 9 is mounted to the main assembly 100*a* of the apparatus. It receives the driving force from a gear portion 152*a* of the coupling 152 through a gear train including idler gears 153, 154 FIG. 26.

Here, in the case that supply cartridge 9 is a fresh one (not used), the supply opening 34 may be sealed by the toner seal 120. When the supply opening 34 is sealed by the toner seal 120, the winding-up shaft 121 receives a driving force from the main assembly through the driving force receiving portion 120*b* to rotate in the direction of arrow D, in the state that supply cartridge 9 is set in the main assembly 100*a* of the apparatus (FIG. 17).

By doing so, the winding-up shaft 121 winds the toner seal 120 up to open the supply opening 34. In the case that supply cartridge 9 is removed from the main assembly 100*a* of the apparatus after the toner seal 120 is removed, the supply opening 34 is sealed by the shutter 35.

The discrimination whether or not the supply cartridge 9 is a fresh one, is carried out by the main assembly 100*a* of the apparatus recognizing information stored in memory (unshown) provided in the supply cartridge 9.

In this embodiment, the developer supply cartridge 9 is provided with the supplying-side shutter 35. For this reason, it is not always necessary to employ the toner seal, and the developer leakage through the supply opening 34 can still be prevented. However, with the above-described structure having the toner seal, the leakage of the developer can be prevented assuredly during, for example, transportation of the developer supply cartridge.

Figure 27:
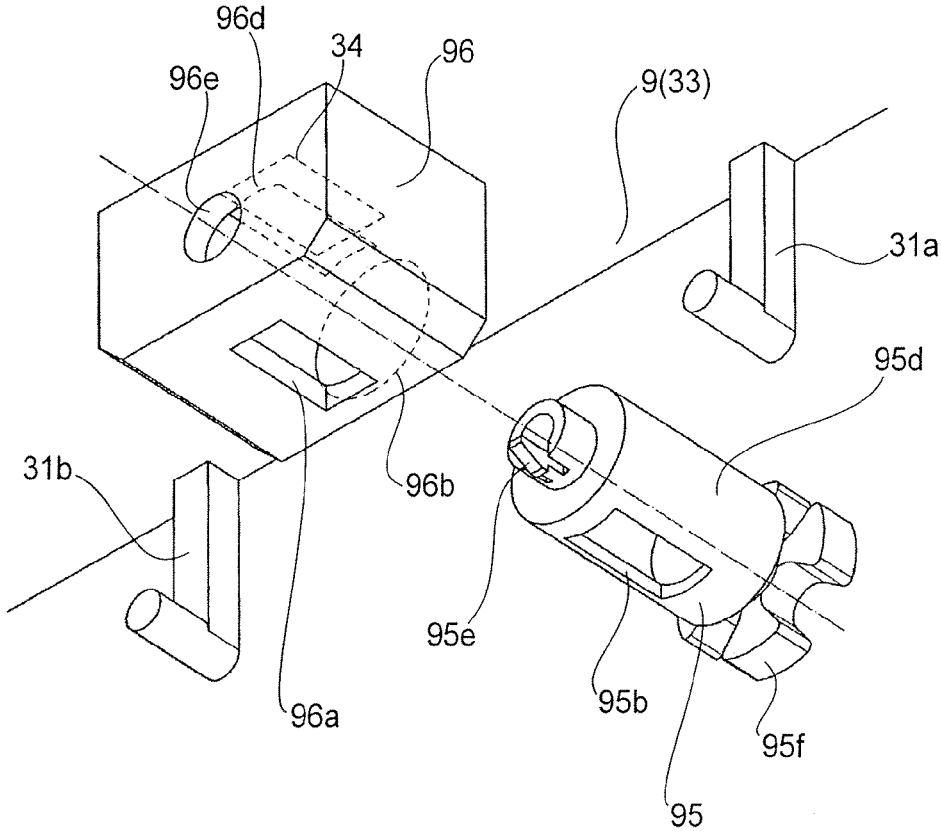
FIG. 27 is an exploded perspective view of a shutter of a developer supply cartridge and the elements therearound.

In this embodiment, the supplying-side shutter 35 and the supplying-side movable member 32 are unintegral or separate members. In an alternative structure, however, the cap 39 is not used, and as shown in FIG. 27, the supplying-side shutter (supplying-side shutter portion) 95 is provided with disengagement prevention portion 95*e* of snap fit type, for example. By doing so, the shutter 95 is engaged with the hole 96*e* of the T housing 96 so that disengagement can be prevented. Therefore, the shutter 95 and the supplying-side movable portion 95*f* may be one integral structure.

The supplying-side shutter 95 of the FIG. 27 example corresponds to the above-described supplying-side shutter 35, and the T housing 96 corresponds to the T housing 44, and in addition, the supplying-side movable portion 95*f* corresponds to the supplying-side movable member 32. The communication opening 95*b* corresponds to the communication opening 35*b*, and non-opening portion 95*d* corresponds to the non-opening portion 35*d*. The T container communication opening 96*a* corresponds to the T container communication opening 44*a*, and the supplying-side shutter inserting portion 96*b* corresponds to the supplying-side shutter inserting portion 44*b*, and in addition, the T housing opening 96*d* corresponds to the T housing opening 44*d*.

The supply cartridge 9 further includes the following structures.

More particularly, it comprises a first engageable member 31*b* fixed at a position upstream of the supply opening 34 (supplying-side movable member 32) with respect to the advancing direction in which the supply cartridge 9 enters the main assembly 100*a* of the apparatus. In the case that supply cartridge 9 enters the main assembly 100*a* of the apparatus, the first engageable member 31*b* moves the regulating member 68 which will be described hereinafter, prior to the shutter 35 opening the supply opening 34. By this, it releases the regulating operation of the regulating member 68. This enables movement of the receiving-side movable member 62. Subsequently, it is brought into engagement with first receiving-side operating portions 62*b*1, 62*b*3 of the movable member 62 to rotate the movable member 62. This moves the receiving-side shutter 65 from the developer-reception-preventing position to the developer-reception-permitting position.

In addition, the developer supply cartridge 9 comprises a second engageable member 31*a* fixed at a position upstream of the supply opening 34 (supplying-side movable member 32) with respect to a dismounting direction in which the developer supply cartridge 9 is removed from the main assembly of the apparatus 100. In the case that supply cartridge 9 is removed from the main assembly of the apparatus 100, the second engageable member 31*a* is brought into contact to the regulating member 68 to move (rotate) the regulating member 68 after the shutter 35 closes the supply opening 34. By this, it releases the regulating operation of the regulating member 68. Thus, it permits the movement of the movable member 62. Subsequently, it engages with a receiving-side operating portion provided at a position different from that of the receiving-side operating portion of the receiving-side movable member 62. By this, the shutter 65 is moved from the developer-reception-permitting position to the developer-reception-preventing position.

In the state that supply cartridge 9 is mounted to the main assembly 100*a* of the apparatus, the supplying-side movable member 32 extends in a direction perpendicular to the bottom side (lower surface) 9*e* of the supply cartridge 9. The movable member 32 is rotatable about a horizontal axis parallel with the lower surface 9*e*.

The supplying-side shutter 35 is in the form of a rotatable cylindrical which is rotatable about a horizontal axis parallel with the lower surface 9*e* of the supply cartridge 9.

The cylindrical opening, extending along the longitudinal direction of the cylindrical shape, of the supplying-side shutter 35 opposes the developer supply opening 34. By doing so, the developer supply opening 34 is opened. The portion of the cylindrical other than the cylindrical opening closes the supply opening 34 by opposing the receiving opening 16*a*.

The supplying-side movable member 32 comprises a supplying-side operating portion in the form of projections (32*b*1, 32*b*2, 32*b*3, 32*b*4) which are engaged with projections 62*b*1, 62*b*3 (first receiving-side operating portion) and bifurcated projections 62*b*2, 62*b*4 (second receiving-side operating portion) to receive rotating forces. By doing so, the supplying-side shutter 35 is rotated.

[Shutter Mechanism of Process Cartridge]

Referring to FIGS. 9, 10, 18, 24 and 25, the shutter mechanism of the process cartridge 7 of this embodiment will be described.

Figure 9:
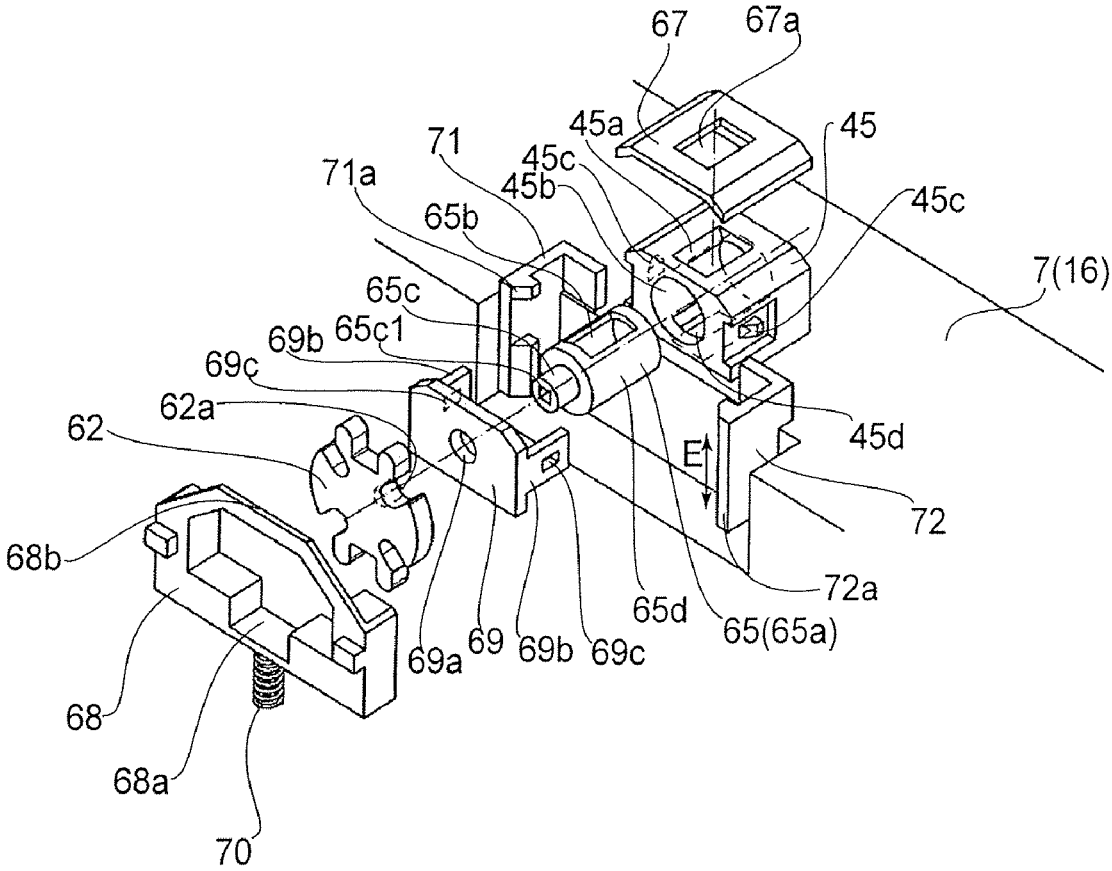
FIG. 9 is an exploded perspective view of a shutter of the process cartridge and the elements therearound.
Figure 10:
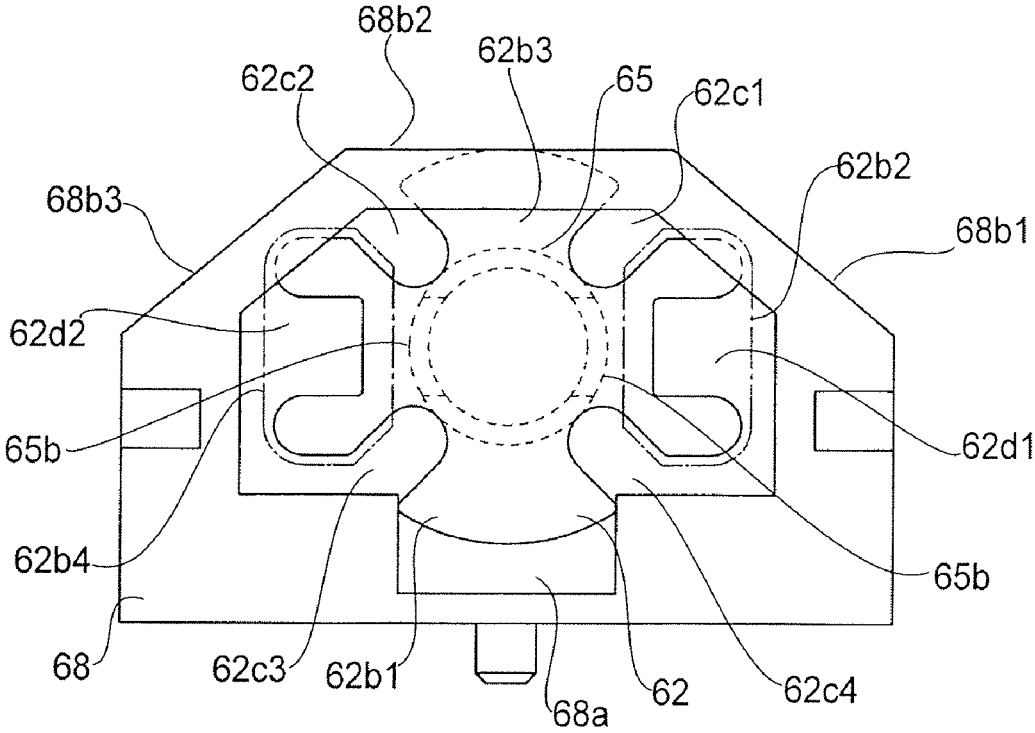
FIG. 10 is a front view of a receiving-side movable member and a receiving-side shutter, illustrating connection therebetween.
Figure 18:
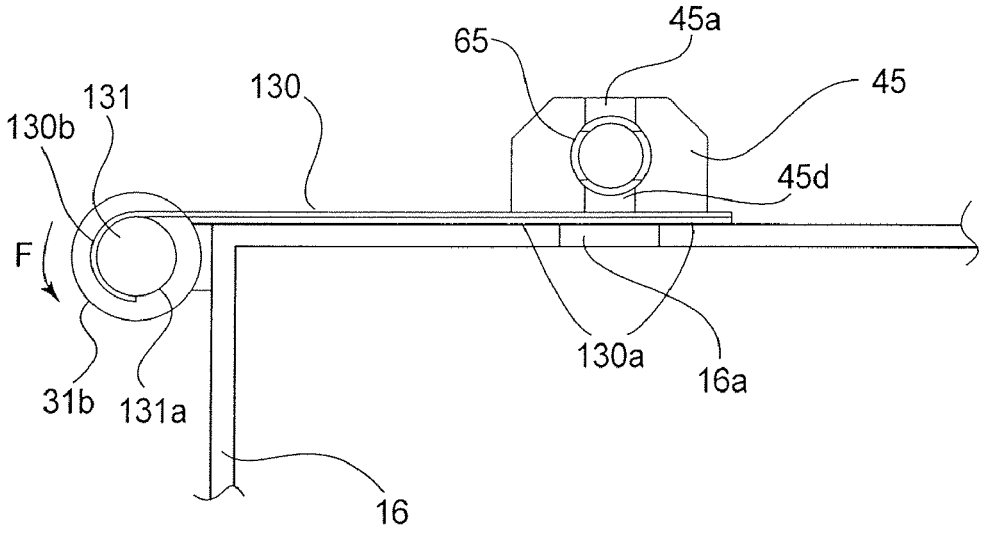
FIG. 18 is a front view of a toner seal winding-up portion of a process cartridge according to the first embodiment of the present invention.
Figure 24:
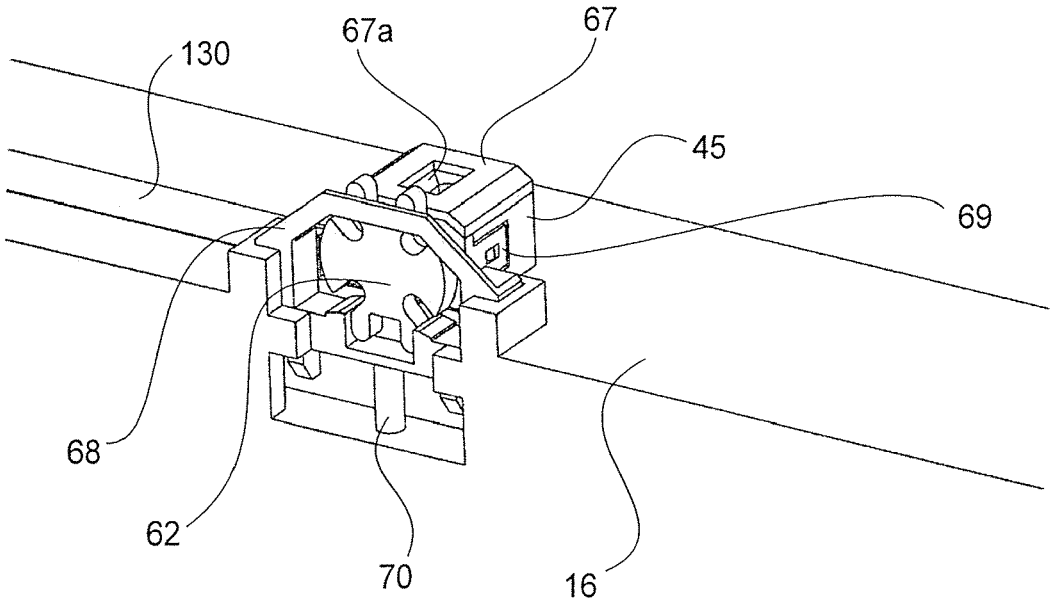
FIG. 24 is a perspective view of a shutter of the process cartridge and the elements therearound, according to the first embodiment of the present invention.
Figure 25:
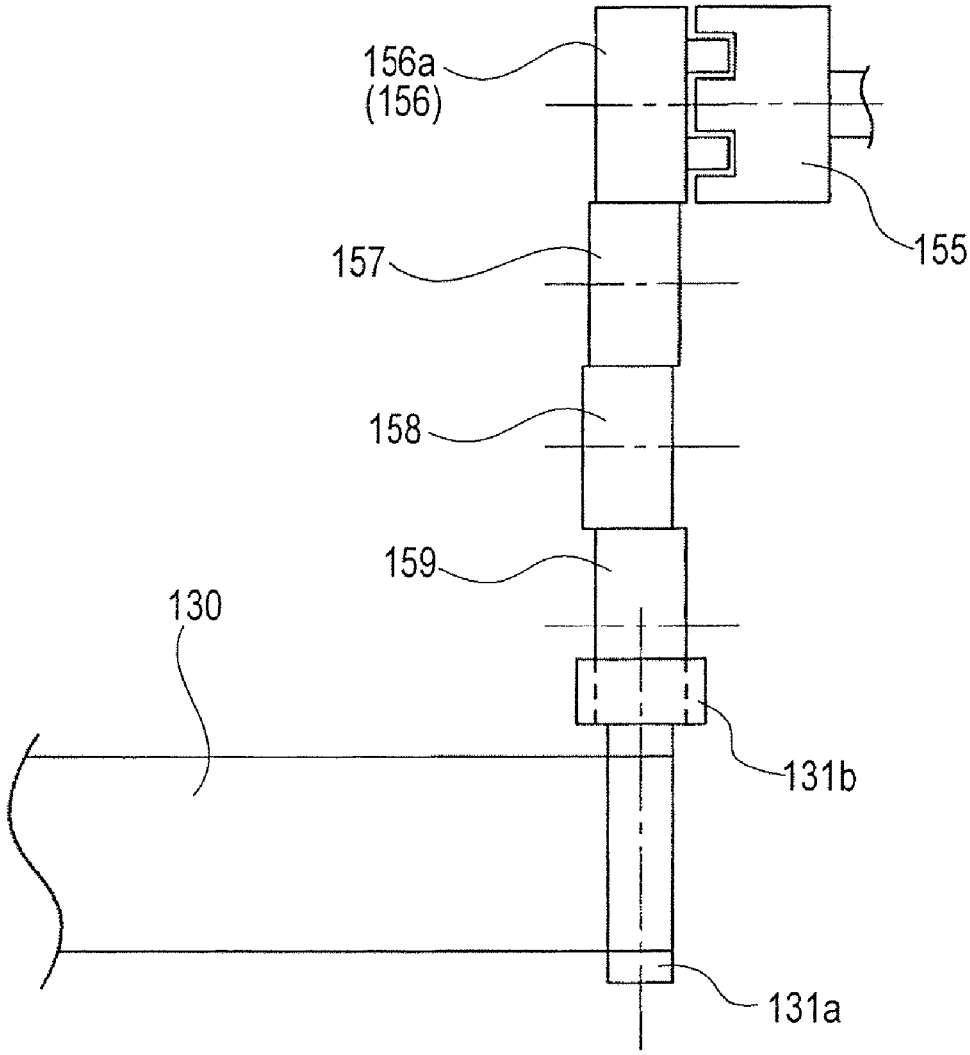
FIG. 25 illustrates operations of toner seal winding-up portion of the process cartridge according to the first embodiment of the present invention.

FIG. 9 is an exploded perspective view of the shutter of the process cartridge 7 and the elements therearound. FIG. 10 is a front view illustrating a state of connection between the receiving-side movable member 62 and the receiving-side shutter 65 (receiving-side shutter portion) (rotatable member). FIG. 18 is a front view of the winding-up portion for winding the toner seal of the process cartridge. FIG. 24 is a perspective view of the shutter of the process cartridge 7 and the elements therearound. FIG. 25 illustrates a driving structure for the winding-up portion.

As shown in FIG. 9, the shutter mechanism of the process cartridge 7 has the structures similar to those of the shutter mechanism of the supply cartridge 9. The developing-device housing 45 corresponds to the T housing 44. The developing-device housing opening 45*d* corresponds to the T housing opening 44*d*. The developing container communication opening 45*a* corresponds to the T container communication opening 44*a*. The development shutter inserting portion 45*b* corresponds to the supplying-side shutter inserting portion 44*b*. The receiving-side shutter 65 corresponds to the supplying-side shutter 35. The cylindrical portion 65*a* corresponds to the cylindrical portion 35*a*; the connecting portion 65*c* corresponds to the connecting portion 35*c*; the communication opening (opening) 65*b* corresponds to the communication opening 35*b*; and non-opening portion 65*d* corresponds to the non-opening portion 35*d*. The cap 69 corresponds to the cap 39; the arm portion 69*b* corresponds to the arm portion 39*b*; the hole portion 69*c* corresponds to the hole portion 39*c*; the opening 69*a* corresponds to the opening 39*a*; and the end recess 65*c*1 corresponds to the end recess 35*c*1. In view of these correspondences, the description of the corresponding portions of the process cartridge will be omitted for simplicity.

The description will be made as to the receiving-side movable member 62.

As shown in FIG. 10, a movable member 62 fixed to a free end of the shutter 65 functions to move the shutter 65. In other word, the shutter 65 is interrelated with the movement (rotation) of the movable member 62. The movable member 62 is provided with projections 62*b* (62*b*1, 62*b*2, 62*b*3, 62*b*4) and recesses 62*c* (62*c*1, 62*c*2, 62*c*3, 62*c*4) to apply a rotating force to the supply cartridge 9 with the mounting and demounting operations of the process cartridge 7 relative to the main assembly 100*a* of the apparatus. The projection 62*b* is arranged along rotational moving direction of the movable member 62. The projection 62*b*2 is provided at the center portion thereof with a recess 62*d*1 so that it constitutes a bifurcated projection. In addition, the projection 62*b*4 is provided at the center portion thereof with a recess 62*d*2 so that it constitutes a bifurcated projection. The projections 62*b*2, 62*b*4 are engageable with the projections 32*b* (32*b*1, 32*b*2, 32*b*3, 32*b*4) of the movable member 32. The projections 62*b*1-62*b*4 constitute a receiving-side operating portion. More particularly, the projections 62*b*1, 62*b*3 constitute a first receiving-side operating portion, and the projections 62*b*2, 62*b*4 constitute a second receiving-side operating portion. The recesses 62*d*1, 62*d*2 are provided to prevent the interference between the projection 32*b* and the projections 62*b*2, 62*b*4. Referring to FIG. 10, the parts of the projection 62*b*2 and 62*b*4 are enclosed by chain lines.

The developer accommodating portion 16 is further provided with a regulating member 68 for regulating rotation of the movable member 62. The regulating member 68 is made slidable in the vertical direction (direction of arrow E) by claw portions 71*a*, 72*a* of the slide rails 71, 72 provided in the developer accommodating portion 16. The regulating member 68 is normally urged in a upward direction by a spring force (elastic force) of a compression spring 70 provided between the developer accommodating portion 16 and the regulating member 68. As shown in FIG. 10, when the regulating member 68 is at the home position (regulation position), the regulation recess 68*a* is sequentially engageable with the projections 62*b* (62*b*1, 62*b*2, 62*b*3, 62*b*4) of the movable member 62. By doing so, the rotation of the movable member 62 is regulated. In other word, by the engagement between the projection 62*b* and the recess 68*a*, the rotation of the movable member 62 is regulated or prevented.

The topmost surface of the housing 45 is provided with a sealing member 67 having an opening 67*a* corresponding to the communication opening 45*a*.

The assembling method and operation of the shutter of the process cartridge 7 and the elements therearound will be described.

First, the shutter 65 is inserted into the shutter inserting portion 45*b* of the housing 45. The opening of the shutter inserting portion 45*b* is capped with the cap 69. Then, the hole portion 69*c* of the cap 69 is engaged with a retaining portion 45*c* of the housing 45. In this manner, the shutter 65 is fixed to the housing 45. Then, the end projection 62*a* of the movable member 62 is press-fitted into the end recess 65*c*1 of the shutter 65. The regulating member 68 is engaged with the claw portions 71*a*, 72*a* of the slide rail 71, 72 on the outside of the developer accommodating portion 16. Thereafter, the spring 70 is mounted between the regulating member 68 and the developer accommodating portion 16. Subsequently, the sealing member 67 is mounted to the communication opening 45*a* side of the housing 45. The developing-device housing 45 is fixed to the developer accommodating portion 16 by screws (unshown) or the like.

The shutter 65 opens and closes similarly to the above-described shutter 35. With each 90° rotation of the receiving-side shutter 65, the process cartridge 7 alternately becomes capable of developer reception from the developer supply cartridge 9 (developer-reception-permitting position, FIG. 7, (*c*)) and becomes incapable of developer reception a (developer-reception-preventing position, 7, (*d*)).

Thus, the receiving opening 16*a* is opened and closed by the rotation of the shutter 65 in interrelation with the 90° rotation of the receiving-side movable member 62.

Between the developer accommodating portion 16 and the developing-device housing 45, there is provided a D toner seal 130 (FIG. 18). One longitudinal end 130*a* of the D toner seal 130 is fixed to the developer accommodating portion 16 and seals the receiving opening 16*a*. The other end of the D toner seal 130 is fixed to the circular column portion 130*a* of the winding-up shaft 131. There is further provided a rotatable driving force receiving portion 131*b* which is rotatable integrally with the circular column portion 131*a*.

As shown in FIG. 25, in the state that process cartridge 7 is mounted in the main assembly 100*a* of the apparatus, the development driving force reception coupling 156 receives the driving force from the main assembly coupling 155, for the developing operation, provided in the main assembly of the apparatus 100. The driving force receiving portion 130*b* receives the driving force through the gear train including idler gears 157, 158, 159 from the gear portion 156*a* of the coupling 156.

In this embodiment, when the process cartridge 7 is a fresh one (unused), the receiving opening 16*a* may be sealed by the above-described toner seal 130. In the case that receiving opening 16*a* is sealed by the toner seal 130, when the process cartridge 7 is set in the main assembly 100*a* of the apparatus, the winding-up shaft 131 receives the driving force from the main assembly through the driving force receiving portion 131*b*.

Whether the process cartridge 7 is a fresh one or not is discriminated by the main assembly 100*a* of the apparatus detecting information stored in memory (un shown) provided in the process cartridge 7.

Then, the winding-up shaft 131 winds the toner seal 130 up to opening the receiving opening 16*a*. When the process cartridge 7 is removed from the main assembly 100*a* of the apparatus, the receiving opening 16*a* is sealed by the shutter 65.

The process cartridge is also provided with the receiving-side shutter 65 similarly to the developer supply cartridge. For this reason, the leakage of the developer from the developer receiving opening 16*a* can be prevented sufficiently even if the toner seal is not employed. However, with the structure employing the above-described toner seal, the possible developer leakage during transportation of the process cartridge can be prevented assuredly.

Figure 28:
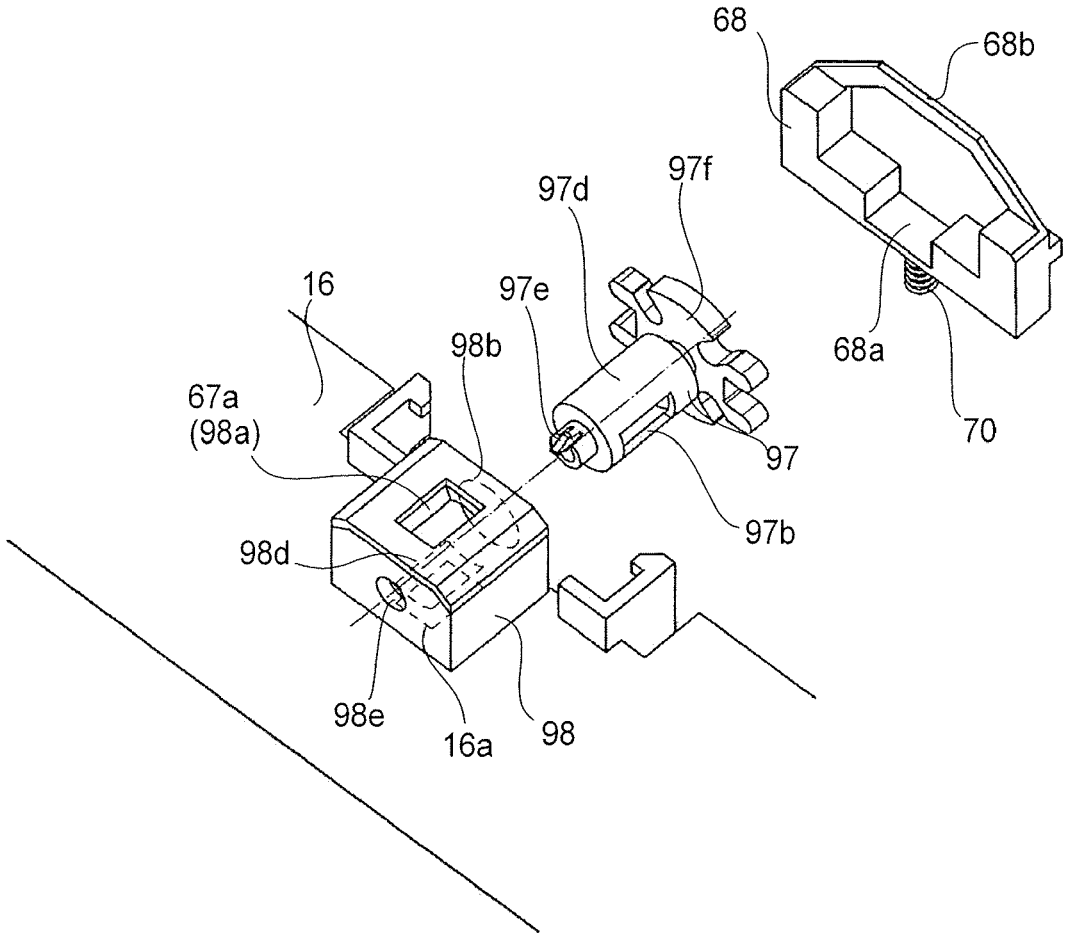
FIG. 28 is an exploded perspective view of a shutter of the process cartridge and the elements therearound.

In this embodiment, the receiving-side shutter 65 and the receiving-side movable member 62 are unintegral or separate members. However, in an alternative structure, as shown in FIG. 28, the cap 69 is not used, but the receiving-side shutter (receiving-side shutter portion) 97 is provided with a disengagement prevention portion 97*e* such as snap fit is provided, and the shutter 97 is engaged with a hole 98*e* of the developing-device housing 98 to prevent the disengagement. By doing so, the shutter 97 and the receiving-side movable portion 97*f* may be made integral.

In FIG. 28, the shutter 97 corresponds to the above-described shutter 65; the movable member 97*f* corresponds to the movable member 62; and the developing-device housing 98 corresponds to the developing-device housing 45. The communication opening 97*b* corresponds to the communication opening 65*b*; and the non-opening portion 97*d* corresponds to the non-opening portion 65*d*. The developing container communication opening 98*a* corresponds to the developing container communication opening 45*a*; the development shutter inserting portion 98*b* corresponds to the development shutter inserting portion 45*b*; and the developing-device housing opening 98*d* corresponds to the developing-device housing opening 45*d*. Therefore, the detailed description of these elements will be omitted for the sake of simplicity.

[Driving Structure for the Shutter Portion]

Figure 11:
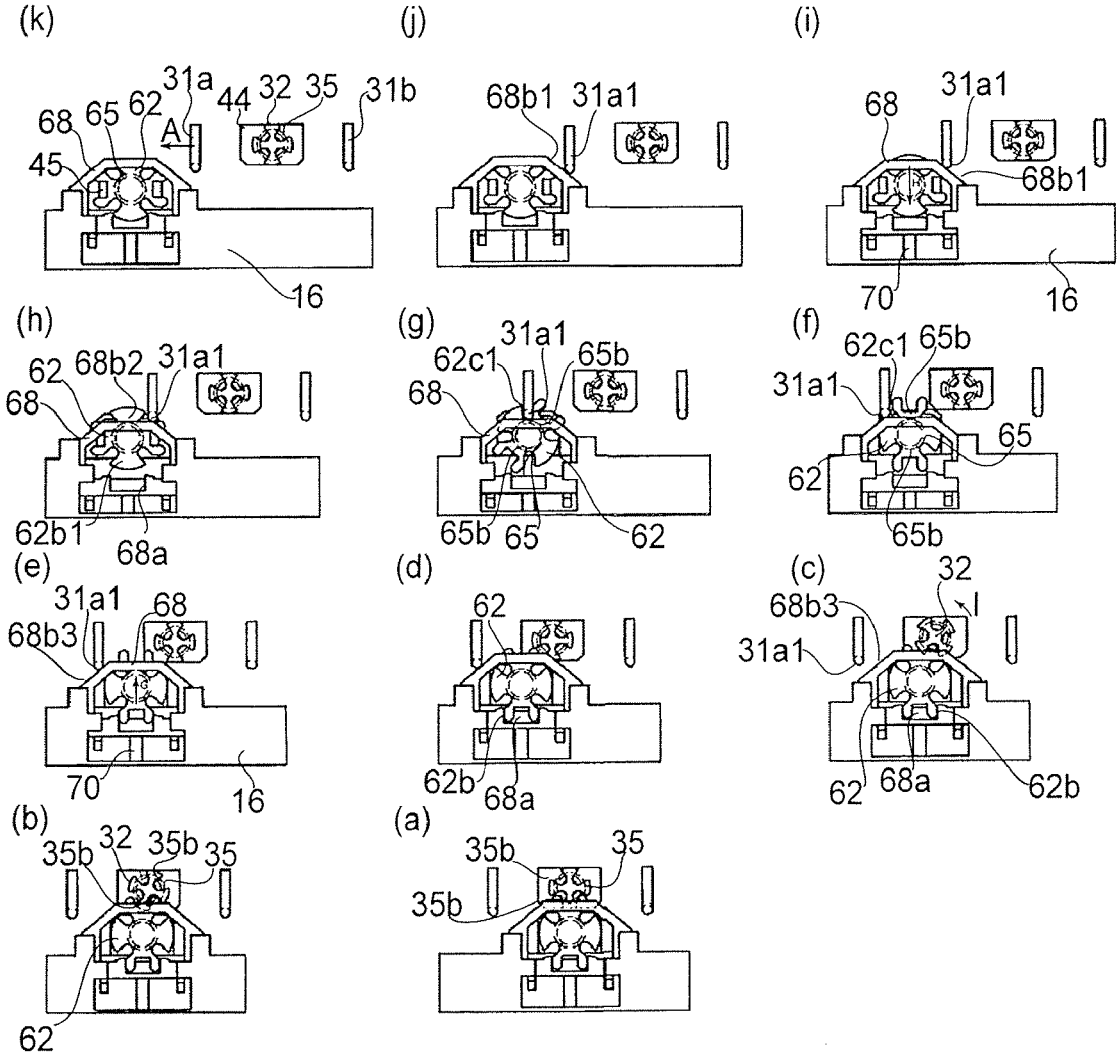
FIGS. 11(*a*)-11(*k*) illustrate operations of the shutter portions when the developer supply cartridge is mounted to the main assembly of the apparatus in the state that process cartridge is set in the main assembly.
Figure 12:
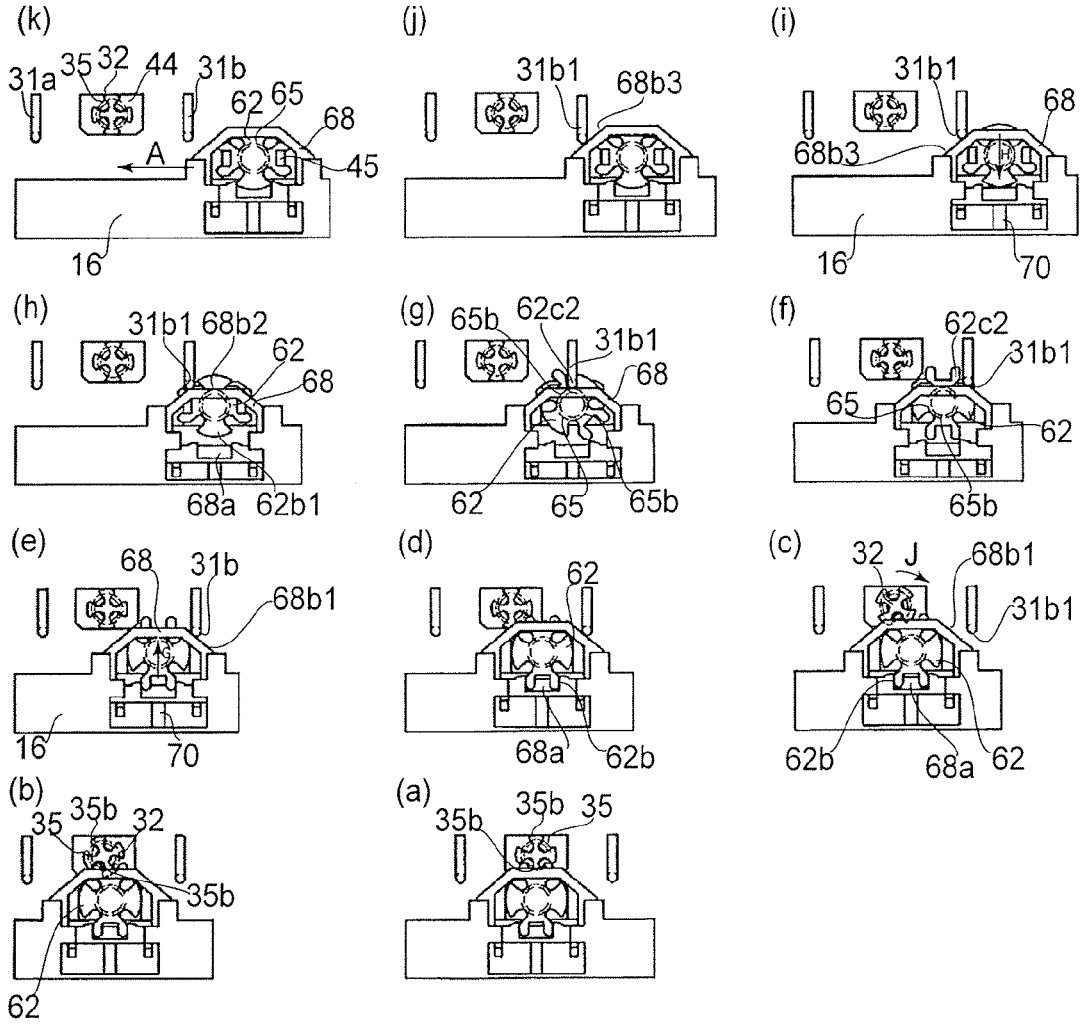
FIGS. 12(*a*)-12(*k*) illustrate operations of a shutter portion when the process cartridge is mounted to the main assembly of the apparatus in the state that developer supply cartridge is set in the main assembly of the apparatus.

Referring to FIGS. 11 and 12, the description will be made as to opening and closing operations of the shutter 35 and the shutter 65 during the mounting and demounting operations of the supply cartridge 9 and the process cartridge 7.

(In the Case that Developer Supply Cartridge is Mounted)

Referring to FIG. 11, the description will be made as to the case that supply cartridge 9 is mounted to the main assembly 100*a* of the apparatus in a state that process cartridge 7 is already set in the main assembly 100*a* of the apparatus. For the simplicity of illustration, the developer accommodating portion 33 and the developer accommodating portion 16 are omitted in FIG. 11. The shutter 44, the communication opening 45*b*, the shutter 65, the communication opening 65*b*, the engaging portion 31*a*1 of the second engageable member 31*a* and the engaging portion 31*b*1 of the first engageable member 31*b*, are indicated by broken lines.

Before the supply cartridge 9 is mounted to the main assembly 100*a* of the apparatus, the opening 44*d* and communication opening 44*a* of the T housing are positioned such that they are not opposed to the communication opening 35*b* of the supplying-side shutter 35 (the state shown in (b) in FIG. 7) (developer-reception-preventing position). Therefore, the supply of the developer into the process cartridge 7 is prevented (closed state).

When the process cartridge 7 is mounted to the main assembly 100*a* of the apparatus in the state that supply cartridge 9 is not mounted to the main assembly 100*a* of the apparatus, the movable member 62 receives no force from anywhere. Therefore, the shutter 65 does not rotate. For this reason, the process cartridge 7 remains in the closed state in which the developer reception is prevented.

The regulation recess 68*a* of the regulating member 68 and the projections 62*b* (62*b*1 or 62*b*3) of the movable member 62 are in engagement with each other. Therefore, the movable member 62 is kept regulated (the rotation (movement) is prevented).

The operator inserts the supply cartridge 9 into the main assembly 100*a* of the apparatus while the portions-to-be-guided 42*a*, 42*b* set on the main assembly rails 101*a*, 101*b* (in the direction indicated by an arrow A in (k) of FIG. 11).

When the supply cartridge 9 is advanced to the position shown in (j) of FIG. 11, the engaging portion 31*a*1 of the second engageable member 31*a* is brought into contact to the inclined surface portion 68*b*1 of the guide surface 68*b* of the regulating member 68.

With further advancement of the supply cartridge 9, as shown in (i) of FIG. 11, the inclined surface portion 68*b*1 is moved by the first engageable member 31*a*1. Therefore, the regulating member 68 having been urged to the upper regulation position by the elastic force of the urging spring 70, is moved downwardly against the elastic force toward the developer accommodating portion 16 in the direction indicated by an arrow H in (i) of FIG. 11 (movement-permitting position (rotation-permitting position)).

When the engaging portion 31*a*1 of the supply cartridge 9 reaches the flat surface portion 68*b*2 of the guide surface 68*b*, the engagement between the regulation recess 68*a* of the regulating member 68 and a projection 62*b* (62*b*1 or 62*b*3 in FIG. 10) is released. By this, the movable member 62 becomes rotatable ((h) of FIG. 11).

Thereafter, the engaging portion 31*a*1 slides on the flat surface portion 68*b*2 of the regulating member 68. And, the engaging portion 31*a*1 is engaged with the projection 62*b* (62*b*1 or 62*b*3) of the movable member 62 to rotate the movable member 62 in the couterclockwise direction ((g) of FIG. 11). With the rotation of the movable member 62, the receiving-side shutter 65 fixed thereto is also rotated in the couterclockwise direction together with the movable member 62. By this, the communication opening 65*b* of the shutter 65 is communicated with the developing-device housing opening 45*d* and the communication opening 45*a*. More particularly, the shutter 65 is now placed in the developer-reception-permitting position ((c) of FIG. 7). The recess 62*c* (62*c*1 or 62*c*3 in FIG. 10) is provided to receive the engaging portion 31*a*1 when the engaging portion 31*a*1 is engaged with the projection 62*b* (62*b*1 or 62*b*3).

When the supply cartridge 9 is advanced to the position where the engagement between the engaging portion 31*a*1 and the movable member 62 is released, the shutter 65 is completely rotated through 90°. Then, the rotation of the shutter 65 stops. At this time, the communication opening 65*b* takes such a position as to oppose to the receiving opening 16*a* ((c) of FIG. 7). Therefore, the opening state is reached in which the developer reception from the supply cartridge 9 is enabled ((f) of FIG. 11).

As shown in (e)-(d) of FIG. 11, when the supply cartridge 9 is further advanced into the main assembly 100*a* of the apparatus, the inclined surface portion 68*b*3 is guided by the engaging portion 31*a*1. Therefore, the regulating member 68 moves upwardly toward the regulation position (in the direction of an arrow G in (e) of FIG. 11) relative to the developer accommodating portion 16 by the elastic force (spring force) of the spring 70.

The engaging portion 31*a*1 of the supply cartridge 9 is disengaged from the inclined surface portion 68*b*3 of the guide surface 68*b*. The projection 62*b* (62*b*2 or 62*b*4 in FIG. 10) is brought into engagement with the regulation recess 68*a* of the regulating member 68. The movable member 62 restores the regulated position where the rotation is prevented ((c) of FIG. 11).

The supply cartridge 9 is further advanced into the main assembly 100*a* of the apparatus. By this, the bifurcated projection 62*b* (62*b*2 or 62*b*4 in FIG. 10) of the movable member 62 is engaged with the projection 32*b* (32*b*1 or 32*b*3 of FIG. 8) and the recess 32*c* (32*c*1 or 32*c*3 of FIG. 8) of the movable member 32. At this time, the rotation of the movable member 62 is regulated or prevented by the regulating member 68. Therefore, the movable member 32 rotates in the couterclockwise (direction of arrow I in (c) of FIG. 11) by the force received from the movable member 62 with the entering movement of the supply cartridge 9. With the rotation of the movable member 32, the shutter 35 fixed thereto also rotates in the couterclockwise. The communication opening 35*b* of the supplying-side shutter 35 is brought into fluid communication (the developer can flow therethrough) with the housing opening 44*d* and the communication opening 44*a* ((c)-(b) of FIG. 11). In other word, the shutter 35 of the supply cartridge 9 is now in the developer-supply-permitting position.

The structure and operation of the process cartridge 7 and supply cartridge 9 are summarized as follows. Also, the positioning structure relative to the main assembly 100*a* will be described.

The process cartridge 7 and the supply cartridge 9 are detachably mountable to the main assembly 100*a* of the apparatus independently from each other.

The process cartridge 7 includes the photosensitive drum 1 and the developing roller 17 for developing the electrostatic latent image formed on the photosensitive drum 1 with the developer. The process cartridge 7 includes the receiving-side shutter 65 movable between the developer-reception-permitting position for opening the developer receiving opening 16*a* for receiving the developer and the developer-reception-preventing position for closing the receiving opening 16*a*. The process cartridge 7 includes the receiving-side movable member 62 which is movable in interrelation with the shutter 65 and which includes receiving-side operating portions 62*b*2 and 62*b*4 which are placed at the operating position when the shutter 65 is at the developer-reception-permitting position. The process cartridge 7 includes the regulating member 68 for regulating the movement of the movable member 62 when the operating portion 62*b*2 or 62*b*4 is at the operating position ((e) of FIG. 11). Here, the operating position is the position where the operating portion 62*b*2 or 62*b*4 is in engagement with the projection 32*b* of the supplying-side movable member 32, and the supplying-side movable member 32 is moved (rotated) by the relative movement between the supplying-side movable member 32 and the receiving-side movable member 62. In this embodiment, the operating portion 62*b*2 or 62*b*4 is at the topmost position in the operating position ((a)-(e)).

The supply cartridge 9 includes the supplying-side developer accommodating portion 33 for accommodating the developer. The supply cartridge 9 includes the T housing opening 44*d* for supplying the developer from the developer accommodating portion 33 into the process cartridge 7 through the receiving opening 16*a*, and the supplying-side shutter 35 is movable between the toner-supply-permitting position where the T housing opening 44*d* and the communication opening 44*a* are in communicating relation with each other and the developer-supply-preventing position for closing the T housing opening 44*d* and the communication opening 44*a*. The developer supply cartridge 9 includes the movable member 32 having the projection 32*b* which is engageable with the operating portion 62*b*2 in the state of being regulated at the operating position. When the supply cartridge 9 advances into the main assembly 100*a* of the apparatus, the movable member 32 moves interrelatedly the shutter 35 from the toner-supply-preventing position to the toner-supply-permitting position by the operating portion 62*b*2 or 62*b*4 engages with the projection 32*b* ((d)-(a) of FIG. 11).

Figure 13:
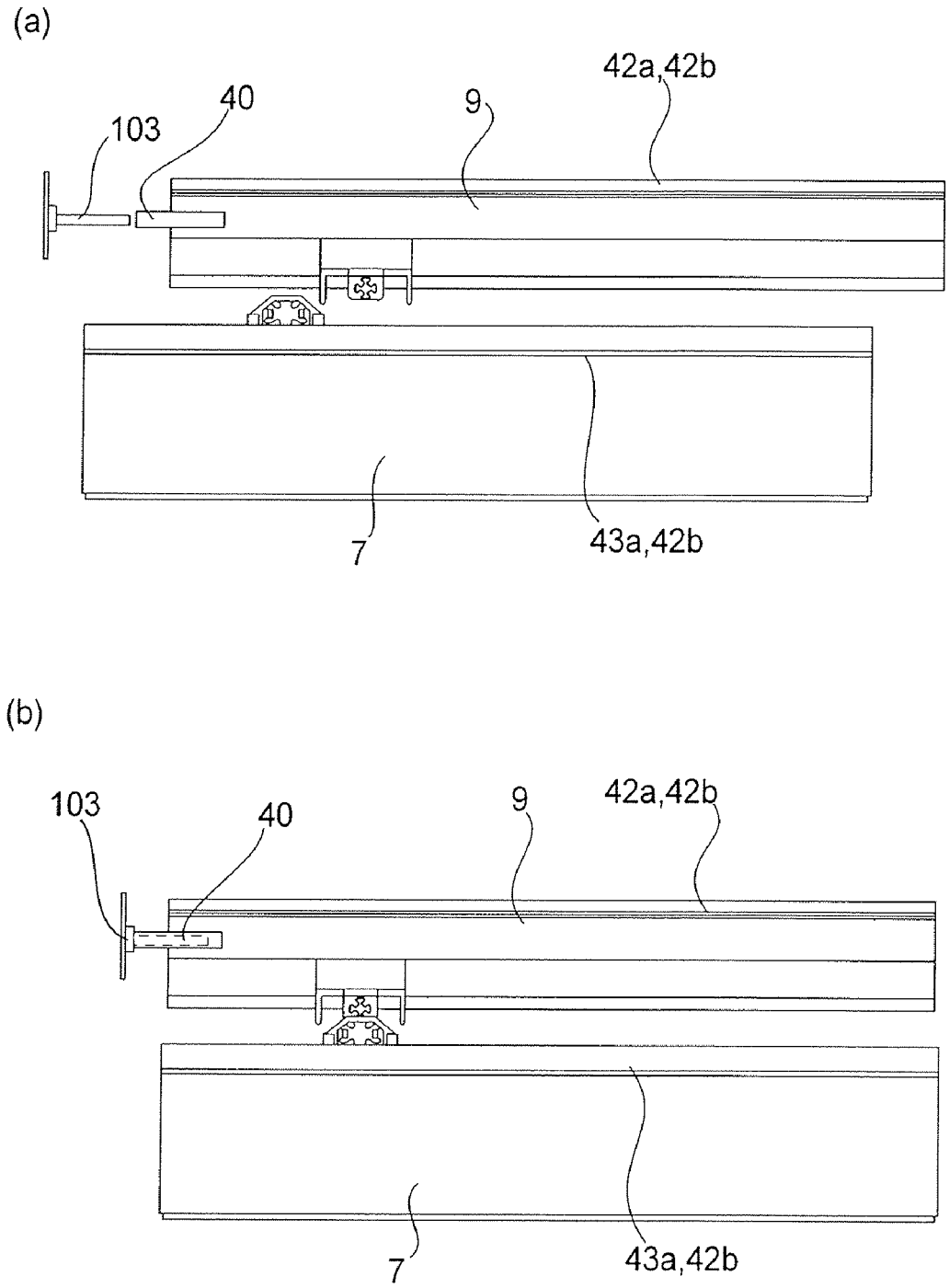
FIG. 13*a* illustrates a positioning operation for the developer supply cartridge relative to the main assembly of the apparatus with respect to the longitudinal direction.
FIG. 13*b* illustrates a positioning operation for the developer supply cartridge relative to the main assembly of the apparatus with respect to the longitudinal direction.

When the supply cartridge 9 further advances into the main assembly 100*a* of the apparatus, the portion-to-be-positioned 40 of the supply cartridge 9 abuts the main assembly supporting shaft 103 provided in the main assembly 100*a* of the apparatus ((b) of FIG. 13). The portion-to-be-positioned 40 is provided on the leading side end surface of the supply cartridge 9 with respect to the entering direction of the supply cartridge 9 into the main assembly 100*a* of the apparatus. At this position, the 90° rotating operation of the shutter 35 is completed, so that mounting of the supply cartridge 9 to the main assembly 100*a* of the apparatus is completed. At this time, the rotation of the supplying-side shutter 65 stops. And, the communication opening 65*b* is at such a position that it opposes the T housing opening 45*d* and the communication opening 45*a* ((c) of FIG. 7) (developer-supply-permitting position). In the developer supply opening 34 is now in the opening state, and the developer can be supplied into the process cartridge 7 ((a) of FIG. 11).

When the cartridge 9 enters the main assembly 100*a* of the apparatus in a state that process cartridge 7 is set in the main assembly 100*a* of the apparatus, the operations of the receiving-side movable member 62, the receiving-side shutter 65 and the regulating member 68 are as follows.

The movable member 62 functions to interrelatedly move the shutter 65 between the developer-reception-permitting position and the developer-reception-preventing position. The movable member 62 includes the receiving-side operating portion (second receiving-side operating portion) (bifurcated projections 62*b*2 and 62*b*4) which is at the operating position when the shutter 65 is placed at the developer-reception-permitting position. The regulating member 68 regulates the movement (rotation) of the movable member 62 in the state that said receiving-side operating portion is at the operating position.

As described in the foregoing, the movable member 32 of the cartridge 9 has the following structures. When the cartridge 9 enters the main assembly 100*a* of the apparatus, the movable member 32 is moved (rotated) by engaging with the receiving-side operating portion (projection 62*b*2, 62*b*4) of the movable member 62 regulated or confined by the regulating member 68 placed at the operating position. The movable member 32 interrelatedly moves the shutter 35 from the developer-supply-preventing position to the developer-supply-permitting position. By doing so, the shutter 35 opens the supply opening 34.

Here, in this embodiment, the receiving-side operating portion which is placed at operating position when the shutter 65 is placed at the developer-reception-permitting position. The movable member 32 is moved by the engagement with the receiving-side operating portion (projection 62*b*2, 62*b*4) to move the shutter 35 from the developer-supply-preventing position to the developer-supply-permitting position. Therefore, when the supply cartridge 9 enters the main assembly 100*a* of the apparatus, the supply opening 34 opens only when the shutter 65 is placed at the developer-reception-permitting position, that is, only when the receiving opening 16*a* is open. For this reason, it can be avoided that supply opening 34 opens despite the receiving opening 16*a* is closed. Thus, the leakage of the developer from the supply opening 34 can be prevented.

According to this embodiment, when the supply cartridge 9 enters the main assembly 100*a* of the apparatus, the supply opening 34 never opens unless the process cartridge 7 is mounted to the main assembly 100*a* of the apparatus.

As described in the foregoing, the supply cartridge 9 is advanced into the main assembly 100*a* of the apparatus while being carried on the main assembly rails (main assembly side guide) 101*a*, 101*b* at the portions-to-be-guided 42*a*, 42*b*. It is desirable that force required for the insertion is small while the positioning of the supply cartridge 9 is assured. From this standpoint, there is provided a clearance which is large at the clearance between the main assembly supporting shaft 103 and the portion-to-be-positioned 40.

The portion-to-be-guided 42*b* which is closer to the movable member 32 as seen in the cross-sectional direction (left side with respect to the direction in which the view of FIG. 2 is seen) is guided. In order to accomplish this, the main assembly rail 101*b* functions to regulate a vertical deviation and a leftward deviation of the supply cartridge 9. The main assembly rail 101*a* regulates downward and rightward deviations of the developer supply cartridge 9.

The supply cartridge 9 and the main assembly rail 101 will be described in detail. As shown in (b) of FIG. 2, the portion-to-be-guided 42*b* includes a side portion-to-be-regulated 42*b*3, an upper side portion-to-be-regulated 42*b*1 and a lower portion-to-be-regulated 42*b*2. When the developer supply cartridge 9 advances into the main assembly 100*a* of the apparatus, the portion-to-be-regulated 42*b*3, the portion-to-be-regulated 42*b*1 and the portion-to-be-regulated 42*b*2 are regulated by the main assembly rail 101*b* provided the main assembly 100*a* of the apparatus. The portion-to-be-regulated 42*b*1 is prevented from upward movement by an upper surface regulating portion 101*b*1 of the main assembly rail 101*b*. The lower portion-to-be-regulated 42*b*2 is regulated in the downward movement by the lower surface regulating portion 101*b*2 of the main assembly rail 101*b*. Similarly, the side portion-to-be-regulated 42*b*3 is regulated in the lateral movement by the side surface regulating portion 101*b*3 of the main assembly rail 101*b*. When the movable member 32 moves while being in engagement with the movable member 62, the portion-to-be-regulated 42*b*1 is prevented from upward movement by the regulating portion 101*b*1. Therefore, the movable member 32 can be moved with assured engagement with the movable member 62. For this reason, the opening and closing operations of the supplying-side shutter 35 and the receiving-side shutter 65 are assured.

Here, the portion-to-be-guided 42*b* is set so as to be guided by the main assembly rail 101*b* at least during the operations of the supplying-side shutter 35, the receiving-side shutter 65 and the regulating member 68, shown in (k)-(a) of FIG. 11.

Therefore, as shown in (k)-(a), during the operations of the shutter members (35, 65) and the regulating member 68, the portion-to-be-guided 42*b* of the developer supply cartridge 9 is guided by the main assembly rail 101*b* with respect to the direction of the view of FIG. 2 (cross-sectional direction). Thus, the relative positional relation between the developer supply cartridge 9 and the process cartridge 7 can be maintained with respect to the cross-sectional direction.

(In the Case that Developer Supply Cartridge is Removed)

When the supply cartridge 9 is dismounted from the main assembly 100*a* of the apparatus in the state that process cartridge 7 and the developer supply cartridge 9 are set in the main assembly 100*a* of the apparatus, the operations are the opposite from those described above. More particularly, the operations are in the order of (a)-(b)-(c)-(d)-(e)-(f)-(g)-(h)-(i)-(j)-(k). Through these steps, the supplying-side movable member 32, the supplying-side shutter 35, the regulating member 68, the receiving-side movable member 62, and the receiving-side shutter 65 operate.

The supply cartridge 9 includes the developer accommodating portion 33 for accommodating the developer. The supply cartridge 9 includes the supplying-side shutter 35 movable between the developer-supply-permitting position for opening the developer supply opening 34 for supplying the developer from the developer accommodating portion 33 into the process cartridge 7 through the developer receiving opening 16*a* and the developer-supply-preventing position for closing the developer supply opening 34. The developer supply cartridge 9 includes the supplying-side movable member 32 (supplying-side movable portion) having the projection 32*b* engageable with the operating portion 62*b*2 or 62*b*4 which is regulated or confined to be at the operating position. The movable member 32 is moved (rotated) by the engagement of the operating portion 62*b*2 with the projection 32*b* with the movement of the supply cartridge 9 to remove from the main assembly 100*a* of the apparatus, to interrelatedly move the supplying-side shutter 35 from the developer-supply-permitting position to the developer-supply-preventing position ((a)-(e) in FIG. 11).

Therefore, after the supply cartridge 9 is removed, the shutter 65 of the process cartridge 7 remaining set in the main assembly 100*a* of the apparatus is interrelatedly closed by the dismounting operation of the supply cartridge 9 from the main assembly 100*a* of the apparatus.

For this reason, even if the process cartridge 7 is removed in the state that supply cartridge 9 is not mounted to the main assembly 100*a* of the apparatus, the shutter 65 of the receiving opening 16*a* of the process cartridge 7 keeps closed. Thus, even if only the supply cartridge 9 is removed from the main assembly 100*a* of the apparatus in the state that both of the process cartridge 7 and the supply cartridge 9 are set in the main assembly 100*a* of the apparatus, the opening 16*a* of the shutter 65 is kept closed assuredly.

When the supply cartridge 9 is removed from the main assembly 100*a* of the apparatus in the state that process cartridge 7 is set in the main assembly 100*a* of the apparatus, the operations of the movable member 62, the shutter 65 and the regulating member 68 will be described.

First, the movable member 62 is movable to interrelatedly move the receiving-side shutter 65 between the developer-reception-permitting position and the developer-reception-preventing position. The movable member 62 includes the receiving-side operating portion (second receiving-side operating portion) (projections 62*b*2 and 62*b*4) which is at the operating position when the shutter 65 is placed at the developer-reception-permitting position. The regulating member 68 regulates the movement of the movable member 62 when the operating portion (projection 62*b*2 or 62*b*4) is at the operating position.

As described hereinbefore, when the supply cartridge 9 is removed from the main assembly 100*a* of the apparatus, the movable member 32 of the supply cartridge 9 is moved by the engagement with the receiving-side operating portion (projection 62*b*2 or 62*b*4) of the movable member 62 which is regulated or confined at the operating position by the regulating member 68. And, the movable member 32 interrelatedly moves the shutter 35 from the developer-supply-permitting position to the developer-supply-preventing position.

In this manner, according to this embodiment of the present invention, when the supply cartridge 9 is removed from the main assembly 100*a* of the apparatus, the movable member 32 is moved (rotated) by the engagement with the receiving-side operating portion (second receiving-side operating portion) (projection 62*b*2 or 62*b*4) of the movable member 62 which is regulated or confined at the operating position by the regulating member 68. Therefore, according to this embodiment, when the supply cartridge 9 is removed from the main assembly 100*a* of the apparatus, the receiving opening 16*a* is closed after the supply opening 34 is closed. Thus, when the supply cartridge 9 is removed from the main assembly 100*a* of the apparatus, it would not happen that supply opening 34 is closed after the receiving opening 16*a* is closed. Therefore, the possible leakage of the developer through the supply opening 34 can be prevented. In the case that supply cartridge 9 is mounted to the main assembly 100*a* of the apparatus or is dismounted from the main assembly 100*a* of the apparatus in the state that process cartridge 7 is set in the main assembly 100*a* of the apparatus, the operations of the movable member 62, the shutter 65 and the regulating member 68 are as follows.

First, the movable member 62 includes the first receiving-side operating portion 62*b*1 or 62*b*3 which is at the operating position when the shutter 65 takes the developer-reception-preventing position, the second receiving-side operating portion 62*b*2 or 62*b*4 which is at the operating position when the receiving-side shutter 65 takes the developer-reception-permitting position.

The regulating member 68 regulates the rotation of the movable member 62 when the first operating portion 62*b*1 or 62*b*3 or second operating portion 62*b*2 or 62*b*4 is placed at the operating position.

In the case that supply cartridge 9 is mounted to the main assembly 100*a* of the apparatus or is dismounted from the main assembly 100*a* of the apparatus in the state that process cartridge 7 is set in the main assembly 100*a* of the apparatus, the operations of the engageable member (second engageable member) 31*a*, the supplying-side movable member 32 and the supplying-side shutter 35 are as follows:

First, when the supply cartridge 9 enters the main assembly 100*a* of the apparatus, the engageable member (second engageable member) 31*a* is brought into contact to the regulating member 68 which regulates the rotation of the movable member 62 by the first operating portion 62*b*1 or 62*b*3 placed at the operating position prior to the supply shutter 35 opening the supply opening 34. The engageable member 31*a* moves the regulating member 68 downwardly against the elastic force of the spring 70. By this, it releases the regulating operation of the regulating member 68. Thus, the engageable member 31*a* permits movement of the movable member 62. Subsequently, the engageable member 32*a* is engaged with the first operating portion 62*b*1 or 62*b*3 to rotate the movable member 62, in interrelation with which the shutter 65 is moved from the developer-reception-preventing position to the developer-reception-permitting position. That is, the receiving opening 16*a* is opened.

In addition, when the supply cartridge 9 is removed from the main assembly 100*a* of the apparatus, the engageable member 31*a* is brought into contact to the regulating member 68 which regulates (prevents) the rotation of the movable member 62 by the second receiving-side operating portion 62*b*2 or 62*b*4 placed at the operating position and moves the regulating member 68 downwardly against the elastic force, after the supplying-side shutter 35 closes the supply opening 34. By this, it releases the regulating operation of the regulating member 68. Thus, the engageable member 31*a* permits movement of the movable member 62.

Then, the engageable member 32*a* rotates the shutter 35 from the developer-reception-permitting position to the developer-reception-preventing position in interrelation with rotation of the movable member 62 caused by engaging with the second operating portion 62*b*2 or 62*b*4. That is, the receiving opening 16*a* disclosed.

Here, the engageable member (second engageable member) 31*a* is disposed fixedly at a position downstream of the supply opening 34 (supplying-side movable member 32) with respect to the direction in which the supply cartridge 9 enters the main assembly 100*a* of the apparatus.

When the supply cartridge 9 enters the main assembly 100*a* of the apparatus, the movable member 32 rotates by engagement with the movable member 62 which is regulated by the regulating member 68 confining the second operating portion 62*b*2 or 62*b*4 at the operating position, after the receiving-side shutter 65 opens the receiving opening 16*a*. The supplying-side movable member 32 moves the supplying-side shutter 35 from the developer-supply-preventing position to the developer-supply-permitting position in interrelation with the rotation thereof. That is, the supply opening 34 is opened.

When the supply cartridge 9 is removed from the main assembly 100*a* of the apparatus, and movable member 32 rotates by the engagement with the movable member 62 which is regulated by the regulating member 68 confining the second receiving-side operating portion 62*b*2 or 62*b*4 at the operating position, prior to the receiving-side shutter 65 closing the receiving opening 16*a*. The movable member 32 moves the supplying-side shutter 35 from the developer-supply-permitting position to the developer-supply-preventing position in interrelation with the rotation thereof. That is, the supply opening 34 is closed.

According to this embodiment, when the supply cartridge 9 is mounted to or dismounted from the main assembly 100*a* of the apparatus in the state that process cartridge 7 its set in the main assembly 100*a* of the apparatus, the leakage of the developer through the supply opening 34 is prevented. The advantageous effects of the foregoing embodiments can be provided.

(In the Case that Process Cartridge is Mounted to Main Assembly of the Apparatus)

The description will be made as to the case that process cartridge 7 is mounted to the main assembly 100*a* of the apparatus in the state that supply cartridge 9 is set in the main assembly 100*a* of the apparatus.

Before the process cartridge 7 is mounted to the main assembly 100*a* of the apparatus, the housing opening 45*d* of the process cartridge 7 and the communication opening 45*a* are not opposed to the communication opening 65*b* ((d) of FIG. 7). That is, the shutter 35 takes the developer-supply-preventing position. Therefore, the receiving opening 16*a* is closed by the shutter 35, in which state the developer cannot be received from the supply cartridge 9. The regulation recess 68*a* of the regulating member 68 is in engagement with the projection 62*b* (62*b*1 or 62*b*3) of the movable member 62. Therefore, the rotation (movement) of the movable member 62 is regulated or prevented.

Even when the supply cartridge 9 is mounted to the main assembly 100*a* of the apparatus in the state that process cartridge 7 is out of the main assembly 100*a* of the apparatus, the movable member 32 does not receive any force. Therefore, the shutter 65 does not rotate. The supply opening 34 is closed, and in the state, the developer supply to the process cartridge 7 is not possible. That is, the shutter 35 is kept at the developer-supply-preventing position.

First, as described hereinbefore, the portions-to-be-guided 43*a* 43*b* are placed on the main assembly rails 102*a*, 102*b*, and the process cartridge 7 is advanced into the main assembly 100 *a* of the apparatus in the direction indicated by an arrow A in (k) of FIG. 12).

When the process cartridge 7 is advanced to the position shown by (j) in FIG. 12, the engaging portion 31*b*1 of the first engageable member 31*b* of the supply cartridge 9 is contacted to the inclined surface portion 68*b*3 of the guide surface 68*b* of the regulating member 68.

With further advancement of the process cartridge 7, the inclined surface portion 68*b*3 is guided by the engaging portion 31*b*1 as shown in (i) of FIG. 12. Therefore, the regulating member 68 having been urged to the upper regulation position by the elastic force of the spring 70 is moved downwardly against the elastic force (spring force) toward the permitting position provided at a lower part where the developer accommodating portion 16 is provided (in the direction indicated by an arrow H in (i) of FIG. 12).

When the engaging portion 31*b*1 of the supply cartridge 9 reaches the flat surface portion 68*b*2 of the guide surface 68*b*, the engagement between the regulation recess 68*a* of the regulating member 68 and the projection 62*b* (62*b*1 or 62*b*3 in FIG. 10) is released. By this, the movable member 62 becomes rotatable ((h) of FIG. 12).

Thereafter, the engaging portion 31*b*1 slides on the flat surface portion 68*b*2 of the regulating member 68 to engage with the projection 62*b* (62*b*1 or 62*b*3) of the movable member 62, by which the movable member 62 is rotated in the clockwise direction ((g) of FIG. 12). With the rotation of the movable member 62, the shutter 65 fixed thereto also rotates in the clockwise direction. And, the communication opening 65*b* of the shutter 65 is opposed to and communicated with the housing opening 45*d* and the communication opening 45*a*. The recess 62*c* (62*c*1 or 62*c*3 in FIG. 10) is provided to receive the engaging portion 31*a*1 when the engaging portion 31*a*1 is engaged with the projection 62*b* (62*b*1 or 62*b*3).

When the process cartridge 7 is advanced to such a position that engagement between the engaging portion 31*b*1 and the movable member 62 is released, the shutter 65 has been rotated by 90°. Then, the rotation of the shutter 65 stops. At this time, the communication opening 65*b* is opposed to the housing opening 45*d* and the communication opening 45*a* (developer-supply-permitting position). Here, the shutter 65 of the process cartridge 7 opens so that process cartridge 7 is capable of receiving the developer from the supply cartridge 9 ((f) of FIG. 12).

As shown in (e)-(d) of FIG. 12, when the process cartridge 7 is further advanced into the main assembly 100*a* of the apparatus, the inclined surface portion 68*b*1 is guided by the engaging portion 31*b*1. Therefore, the regulating member 68 is moved to the upper regulation position (in the direction indicated by an arrow in (e) of FIG. 12) by the elastic force (spring force) of the spring 70.

When the engaging portion 31*b*1 of the supply cartridge 9 departs from the inclined surface portion 68*b*1 of the guide surface 68*b*, the projection 62*b* (62*b*2 or 62*b*4) in FIG. 10 is engaged with the regulation recess 68*a* of the regulating member 68. The movable member 62 restores the regulated position where the rotation is prevented ((d) of FIG. 12).

The process cartridge 7 is further advanced into the main assembly 100*a* of the apparatus. Then, the projection 62*b* (62*b*2 or 62*b*4 FIG. 10 in) of the movable member 62 is engaged with the projection 32*b* (32*b*1 or 32*b*3 in FIG. 8) and the recess 32*c* (32*c*2 or 32*c*4 in FIG. 8) of the movable member 32. At this time, the rotation of the movable member 62 is regulated or prevented by the regulating member 68. Therefore, the movable member 32 receives the force from the movable member 62 to rotate in the clockwise direction (arrow J in (c) of FIG. 12). With the rotation of the movable member 32, the shutter 35 fixed thereto also rotates in the clockwise direction. Then, the communication opening 35*b* of the shutter 35 is opposed to the T housing opening 44*d* and the communication opening 44*a* ((c)-(b)).

And, the portion-to-be-positioned of the process cartridge 7 is abutted to the main assembly supporting shaft (unshown) provided in the main assembly 100*a* of the apparatus. By doing so, the 90° rotation the shutter 35 is completed. Thus, the mounting operation of the process cartridge 7 to the main assembly 100*a* of the apparatus is completed. At this time, the rotation of the shutter 35 stops. The communication opening 35*b* is now positioned to oppose the housing T opening 44*d* and the communication opening 44*a* ((a) of FIG. 7). The supply opening 34 is also opened, and therefore, the developer supply to the process cartridge 7 is permitted ((a) of FIG. 12).

Here, the process cartridge 7 includes the receiving-side movable member 62 which will be described below.

The movable member 62 includes the first receiving-side operating portion (projection) 62*b*3, 62*b*1 which are placed at the operating position when the receiving-side shutter 65 is placed at the developer-supply-preventing position, and the second receiving-side operating portion (projection) 62*b*2, 62*b*4 which are placed at the operating position when the receiving-side shutter 65 is placed at the developer-supply-permitting position The movable member 62 moves the shutter 65 interrelatedly. The movement of the movable member 62 is regulated by the regulating member 68 with the first operating portion 62*b*3, 62*b*1 placed at the first operating position. The movable member 62 moves downwardly by the regulating member 68 contacting the first engageable member 31*b*, when the process cartridge 7 enters the main assembly 100*a* of the apparatus. By doing so, the movable member 62 is released from the regulating member 68 to become movable (rotatable). Then, movable member 62 moves interrelatedly the receiving-side shutter 65 to the developer-supply-permitting position by the movement thereof caused by the first operating portion 62*b*3, 62*b*1 contacting the first engageable member 31*b*. The movement of the movable member 62 is regulated or confined by the regulating member 68 with the second operating portion 62*b*2, 62*b*4 placed at the operating position. The movable member 62 moves the receiving-side shutter 65 to the developer-supply-permitting position in interrelation with the movement (rotation) of the supplying-side movable member 32 caused by engagement of the second operating portion 62*b*2 62*b*4 with the supplying-side movable member 32.

In the case that process cartridge 7 is mounted to the main assembly 100*a* of the apparatus in the state that supply cartridge 9 is set in the main assembly 100*a* of the apparatus, the operations of the first engageable member 31*b* and the movable member 32 of the supply cartridge 9 all as follows.

First, when the process cartridge 7 enters the main assembly 100*a* of the apparatus, the first engageable member 31*b* is brought into contact to the regulating member 68 which regulates or confines the movement of the movable member 62 in the state that shutter 65 is at the developer-supply-preventing position. And, the regulating member 68 is moved downwardly. By doing so, the movable member 62 releases the regulating action of the regulating member 68. By this, the movable member 62 becomes movable (rotatable). Subsequently, the first engageable member 31*b* moves the receiving-side shutter 65 to the permitting position in interrelation with the movement (rotation) of the movable member 62 caused by contacting to the first engageable member 31*b*.

The movable member 32 is engaged with the operating portion 62*b*2, 62*b*4 of the movable member 62 regulated or confined at the operating position. When the process cartridge 7 advances into the main assembly 100*a* of the apparatus, the movable member 32 moves the shutter 35 from the developer-supply-preventing position to the developer-supply-permitting position.

In the case that process cartridge 7 enters the main assembly 100*a* of the apparatus in the state that supply cartridge 9 is set in the main assembly 100*a* of the apparatus, the operations of the receiving-side movable member 62 and the regulating member 68 are as follows.

First, the movable member 62 includes the first receiving-side operating portion 62*b*1 or 62*b*3 placed at the operating position with the shutter 65 placed at the developer-reception-preventing position, and the second receiving-side operating portion 62*b*2 or 62*b*4 placed at the operating position with the shutter 65 placed at the developer-reception-permitting position.

The regulating member 68 regulates or prevents the movement the rotation) of the movable member 62 when the first receiving-side operating portion 62*b*1 or 62*b*3 is placed at the operating position, or when the second receiving-side operating portion 62*b*2 or 62*b*4 is placed at the operating position.

When the process cartridge 7 enters the main assembly 100*a* of the apparatus, the regulating member 68 is contacted to the engageable member (first engageable member) 31*b* to release the movable member 62 from the regulating member 68, so that movable member 62 becomes movable (rotatable). The shutter 65 is moved to the developer-reception-permitting position in interrelation with the movement (rotation) of the first operating portion 62*b*1 or 62*b*3 caused by the contact by the engageable member 31*b*. Subsequently, the movement of the movable member 62 is again regulated by the regulating member 68 when the second operating portion 62*b*2 or 62*b*4 is placed at the operating position. And, the second operating portion 62*b*2 or 62*b*4 is engaged with the movable member 32 to move (rotate) it, and the supplying-side shutter 35 is moved to the developer-supply-permitting position in interrelation with the movement (rotation) of the movable member 32. That is, the supply opening 34 is opened.

In the case that process cartridge 7 enters the main assembly 100*a* of the apparatus in the state that supply cartridge 9 is set in the main assembly 100*a* of the apparatus, the operations of the engageable member (first engageable member) 31*b*, the supplying-side movable member 32 and the supplying-side shutter 35 are as follows.

When the process cartridge 7 enters the main assembly 100*a* of the apparatus, the engageable member (first engageable member) 31*b* is contacted to the regulating member 68 which regulates the movement of the movable member 62 with the first operating portion 62*b*1 or 62*b*3 placed at the operating position. Thus, the movable member 62 is released from the regulating member 68. Thus, it permits the movement of the movable member 62. The engageable member 31*b* is contacted to the first operating portion 62*b*1 or 62*b*3 to move the movable member 32, in interrelation with which the shutter 65 is moved to the developer-reception-permitting position. In this manner, the receiving opening 16*a* is opened.

When the process cartridge 7 enters the main assembly 100*a* of the apparatus, the supplying-side movable member 32 is moved (rotated) by engagement with the second receiving-side operating portion 62*b*2 or 62*b*4 of the movable member 62 which is regulated or confined by the regulating member 68 placed at the operating position, after the engageable member 31*b* moves the shutter 65 to the developer-reception-permitting position. The movable member 32 moves (rotates) interrelatedly the shutter 35 from the developer-supply-preventing position to the developer-supply-permitting position. By doing so, the supply opening 34 is opened.

In this manner, in this embodiment of the present invention, when the process cartridge 7 enters the main assembly 100*a* of the apparatus, the first operating portion 62*b*1 62*b*3 is contacted to the engageable member 31*b* to move (rotate), in interrelation with which the shutter 65 is moved to the developer-reception-permitting position.

Subsequently, the second operating portion 62*b*2 or 62*b*4 is brought into engagement with the movable member 32. In accordance with the advancement of the process cartridge 7, the movable member 32 moves (rotates), in interrelation with which the shutter 35 is moved to the developer-supply-permitting position. That is, the supply opening 34 is opened.

Therefore, according to this embodiment, when the process cartridge 7 enters the main assembly 100*a* of the apparatus, the supply opening 34 is opened only after the receiving opening 16*a* is opened. Therefore, the supply opening 34 never opens in the state that receiving opening 16*a* is closed. Thus, according to this embodiment, when the process cartridge 7 enters the main assembly 100*a* of the apparatus, the leakage of the developer through the supply opening 34 can be avoided.

In addition, according to this embodiment, when the process cartridge 7 enters the main assembly 100*a* of the apparatus, the receiving opening 16*a* is not opened unless the supply cartridge 9 is mounted to the main assembly 100*a* of the apparatus. In this manner, the receiving opening 16*a* will never be opened in the state that supply cartridge 9 is not mounted to the main assembly 100*a* of the apparatus.

(In the Case that Process Cartridge is Removed from Main Assembly of Apparatus)

When the process cartridge 7 is removed from the main assembly 100*a* of the apparatus in the state that process cartridge 7 and the developer supply cartridge 9 are set in the main assembly 100*a* of the apparatus, the operations are opposite. That is, referring to FIG. 12, the order of operations is (a)-(b)-(c)-(d)-(e)-(f)-(g)-(h)-(i)-(j)-(k). The movable member 32, the supplying-side shutter 35, the regulating member 68, the movable member 62 and the receiving-side shutter 65 are operated in this order.

As described in the foregoing, the process cartridge 7 detachably mountable to the main assembly 100*a* of the apparatus includes the receiving-side shutter 65. The shutter 65 is movable between the developer-reception-permitting position for opening the receiving opening 16*a* for receiving the developer to be used by the developing roller 17 for development and the developer-reception-preventing position for closing the developer receiving opening 16*a*.

Furthermore, the shutter 65 is provided with the receiving-side movable member 62 which is rotatable in interrelation with the shutter 65 so that shutter 65 is movable between the developer-reception-permitting position and the developer-reception-preventing position. The movable member 62 includes the receiving-side operating portion 62*b*2 or 62*b*4 which is placed at the operating position when the shutter 65 is placed at the developer-reception-permitting position. The movable member 62 further includes the regulating member 68 for regulating the movement of the movable member 62 when it is placed at the operating position.

The developer supply cartridge 9 which is detachably mountable to the main assembly of the apparatus to supply the developer to the process cartridge 7 includes the developer accommodating portion 16 for accommodating the developer. The developer supply cartridge 9 further includes the supplying-side shutter 35. The shutter 35 is movable between the developer-supply-permitting position for opening the supply opening 34 for supplying the developer into the process cartridge through the receiving opening 16*a* from the developer accommodating portion 16 and the developer-supply-preventing position for closing the supply opening 34. Furthermore, it includes the engageable member (first engageable member) 31*b*. The first engageable member 31*b* is contacted to the regulating member 68 which regulates or confines the movement (rotation) of the movable member 62 with the shutter 65 placed at the developer-reception-preventing position, when the process cartridge 7 enters the main assembly of the apparatus 100. By releasing the movable member 62 from the regulating member 68, the movement of the movable member 62 is enabled. Subsequently, the first engageable member 31*b* is contacted to the movable member 62 to move the movable member 62, in interrelation with which the shutter 65 is moved to the description developer-reception-permitting position. Furthermore, the developer supply cartridge includes the supplying-side movable member 32. When the process cartridge 7 enters the main assembly of the apparatus 100, the movable member 32 is moved (rotated) by engagement with the operating portion 62*b*2 or 62*b*4 of the movable member 62 which is regulated or confined by the regulating member 68 having the operating portion 62*b*4 or 62*b*2 placed at the operating position. The movable member 32 moves interrelatedly the supplying-side shutter 35 from the developer-supply-preventing position to the developer-supply-permitting position.

The receiving-side movable member 62 is constructed as follows.

The movable member 62 includes the operating portion (projection) 62*b*2, 62*b*4 which is placed at the operating position when the shutter 65 is placed at the developer-reception-permitting position. The movable member 62 moves the shutter 65 interrelatedly. The movable member 62 is regulated or prevented from movement by the regulating member 68 placed at the operating position, where the operating portion 62*b*2 is engaged with the projection 32*b*. By this, when the process cartridge 7 is removed from the main assembly 100*a* of the apparatus, the movable member 62 is moved to move the shutter 35 to the developer-supply-preventing position. Subsequently, the movable member 62 becomes movable (rotatable) by the regulating member 68 contacting to the first engageable member 31*b*. The movable member 62 is moved by the operating portion (projection) 62*b*2, 62*b*4 contacting to the first engageable member 31*b* and is moved thereby, in interrelation with which the shutter 65 is moved to the developer-reception-preventing position.

Therefore, after the process cartridge 7 is removed from the main assembly 100*a* of the apparatus, the supplying-side shutter 35 of the supply cartridge 9 which remains in the main assembly 100*a* of the apparatus is closed automatically by the dismounting operation of the process cartridge 7 from the main assembly 100*a* of the apparatus.

In the case that process cartridge 7 is removed from the main assembly 100*a* of the apparatus in the state that supply cartridge 9 is set in the main assembly 100*a* of the apparatus, the operations of the receiving-side movable member 62, the receiving-side shutter 65 and the regulating member 68 are as follows.

First, the receiving-side movable member 62 includes the receiving-side operating portion 62*b*2, 62*b*4 which is placed at the operating position with the shutter 65 placed at the developer-reception-permitting position. The movable member 62 functions to interrelatedly move the shutter 65 between the developer-reception-permitting position and the developer-reception-preventing position. When the process cartridge 7 is removed from the main assembly 100*a* of the apparatus, the receiving-side operating portion 62*b*2, 62*b*4 of the movable member 62 which is regulated or confined by the regulating member 68 placed at the operating position, is engaged with the supplying-side movable member 32 thereby to move (rotate) the movable member 32. The movable member 32 moves interrelatedly the supplying-side shutter 35 to the developer-supply-preventing position. That is, the supply opening 34 is closed. Subsequently, the movable member 62 is released from the regulating member 68 by the regulating member 68 contacting to the engageable member (first engageable member) 35*b*. The movable member 62 becomes movable thereby. Then, movable member 62 is moved by the contact of the receiving-side operating portion 62*b*2, 62*b*4 to the engageable member (first engageable member) 35*b*, in the relation with which the shutter 65 is moved to the developer-reception-preventing position. That is, the receiving opening 16*a* is closed. In the case that process cartridge 7 is removed from the main assembly 100*a* of the apparatus in the state that supply cartridge 9 is set in the main assembly 100*a* of the apparatus, the operations of the supplying-side movable member 32 and the supplying-side shutter 35 are as follows.

First, when the process cartridge 7 is removed from the main assembly 100*a* of the apparatus, the movable member 32 is moved (rotated) by the engagement with the operating portion 62*b*2, 62*b*4 of the movable member 62 which is regulated or confined by the regulating member 68 with the shutter 65 placed at the developer-reception-permitting position. The movable member 32 moves (rotates) interrelatedly the shutter 35 from the developer-supply-permitting position to the developer-supply-preventing position. That is, the supply opening 34 is closed.

Here, according to this embodiment of the present invention, when the process cartridge 7 is removed from the main assembly 100*a* of the apparatus, the receiving-side operating portion 62*b*2, 62*b*4 is engaged with the movable member 32 thereby to move (rotate) the movable member 32. The movable member 32 moves interrelatedly the shutter 35 to the developer-supply-preventing position. Subsequently, the movable member 62 is moved by the operating portion 62*b*2, 62*b*4 contact to the engageable member (first engageable member) 31*b*, in interrelation with which the shutter 65 is moved to the developer-reception-preventing position. That is, the receiving opening 16*a* is closed.

Therefore, according to this embodiment, when process cartridge 7 is removed from the main assembly 100*a* of the apparatus, the receiving opening 16*a* is closed only after the supply opening 34 is closed. Accordingly, with this embodiment of the present invention, the receiving opening 16*a* is never closed in the state that supply opening 34 is open.

Thus, according to this embodiment, the leakage of the developer can be prevented, when the process cartridge 7 is removed from the main assembly 100*a* of the apparatus.

The description will be made as to the case that supply cartridge 9 is mounted to or dismounted from the main assembly 100*a* of the apparatus in the state that process cartridge 7 in set in the main assembly of the apparatus and as to the case that process cartridge 7 is mounted to or dismounted from the main assembly 100*a* of the apparatus in the state that supply cartridge 9 is set in the main assembly of the apparatus.

The operations of the receiving-side movable member 62, the receiving-side shutter 65 and the regulating member 68 of the process cartridge 7 are the same as with the case in that supply cartridge 9 is mounted to or dismounted from the main assembly 100*a* of the apparatus in the state that process cartridge 7 is set in the main assembly 100*a* of the apparatus.

First, the first engageable member (engageable member) 31*b*, the second engageable member (engageable member) 32*b* and the supplying-side movable member 32 are as follows.

First, the first engageable member (engageable member) 31*b* will be described.

When the process cartridge enters the main assembly of the apparatus, the first engageable member 31*b* is contacted to the regulating member 68 which regulates or confines the rotation of the movable member 62 with the first receiving-side operating portion 62*b*1 or 62*b*3 placed at the operating position, prior to the shutter 35 opening the supply opening 34. The first engageable member 31*b* moves the regulating member 68 downwardly against the elastic force of the spring 70. By doing so, the movable member 62 is released from the regulating member 68. By this, the movable member 62 becomes movable. Subsequently, the first engageable member 31*b* is engaged with the first operating portion 62*b*1 or 62*b*3 thereby to rotate the movable member 62, in interrelation with which the shutter 65 is moved from the developer-reception-preventing position to the developer-reception-permitting position. That is, the receiving opening 16*a* is opened.

When the process cartridge 7 is removed from the main assembly 100*a* of the apparatus, the first engageable member 31*b* is brought into contact to the regulating member 68 which regulates or confines the rotation of the movable member 62 with the second receiving-side operating portion 62*b*2 or 62*b*4 placed at the operating position. The first engageable member 31*b* moves the regulating member 68 downwardly against the elastic force of the spring 70 to release the movable member 62 from the regulating member 68. Thus, it permits the movement of the movable member 62. The first engageable member 31*b* is engaged with the second receiving-side operating portion 62*b*2 or 62*b*4 thereby to rotate the movable member 62, in interrelation with which the shutter 65 is rotated from the developer-reception-permitting position to the developer-reception-preventing position. That is, the receiving opening 16*a* is closed.

Here, the first engageable member 31*b* is fixed at a position upstream of the supply opening 16*a* (supplying-side movable member 32) the entering direction in which the supply cartridge 9 enters the main assembly 100*a* of the apparatus.

The description will be made as to the second engageable member 31*a*.

When the supply cartridge 9 enters the main assembly 100*a* of the apparatus, the second engageable member 31*a* is brought into contact to the regulating member 68 which regulates or confines the rotation of the movable member 62 with the first receiving-side operating portion 62*b*1 or 62*b*3 placed at the operating position, prior to the shutter 35 opening the supply opening 34. The second engageable member 31*a* moves the regulating member 68 downwardly against the elastic force to release the movable member 62 from the regulating member 68. By doing so the second engageable member 31*b* makes the receiving-side movable member 62 movable. Then, the second engageable member 31*b* is engaged with the first operating portion 62*b*1 or 62*b*3 to rotate the movable member 62, in interrelation with which the shutter 65 is moved from the developer-reception-preventing position to the developer-reception-permitting position, namely, the receiving opening 16*a* is opened.

When the supply cartridge 9 is removed from the main assembly 100*a* of the apparatus, the second engageable member 31*a* is brought into contact to the regulating member 68 which regulates or confines the rotation of the movable member 62 with the second operating portion 62*b*2 or 62*b*4 placed at the operating position, after the shutter 35 closes the supply opening 34. The second engageable member 31*a* moves the movable member 62 downwardly against the elastic force of the spring 70. By this, it releases the regulating operation of the regulating member 68. Thus, it permits the movement of the movable member 62. Subsequently, the second engageable member 31*a* is engaged with the second operating portion 62*b*2 or 62*b*4 to rotate the movable member 62, in interrelation with which the shutter 65 is rotated from the developer-reception-permitting position to the developer-reception-preventing position. That is, the receiving opening 16*a* is closed.

Here, the second engageable member 31*a* is fixed at the position downstream of the supply opening 34 (supplying-side movable member 32) with respect to the entering direction in which the supply cartridge enters the main assembly of the apparatus.

The description will be made as to the supplying-side movable member 32.

First, when the process cartridge 7 enters the main assembly 100*a* of the apparatus, the movable member 32 is rotated by engagement with the movable member 62 which is regulated by the regulating member 68, more particularly which is prevented from rotating by the second operating portion 62*b*2 or 62*b*4 confined at the operating position, after the first engageable member 31*b* causes the shutter 65 to open the receiving opening 16*a*. The movable member 32 moves interrelatedly the shutter 35 from the developer-supply-preventing position to the developer-supply-permitting position. That is, the supply opening 34 is opened.

In addition, the movable member 32 is rotated by engagement with the movable member 62 which is regulated by the regulating member 68, more particularly, which is prevented from rotating by the second operating portion 62*b*2 or 62*b*4 confined at the operating position, prior to the first engageable member 31*b* causes the shutter 65 to close the receiving opening 16*a*, when the process cartridge 7 is removed from the main assembly 100*a* of the apparatus. The movable member 32 moves interrelatedly the shutter 35 from the developer-supply-permitting position to the developer-supply-preventing position. That is, the supply opening 34 is closed.

In addition, when the supply cartridge 9 enters the main assembly 100*a* of the apparatus, the movable member 32 is rotated by engagement with the movable member 62 which is regulated by the regulating member 68, more particularly, which is prevented from rotating by the second operating portion 62*b*2 or 62*b*4 confined at the operating position, after the second engageable member 31*a* causes the shutter 65 to open the receiving opening 16*a* The movable member 32 moves interrelatedly the shutter 35 from the developer-supply-preventing position to the developer-supply-permitting position. That is, the supply opening 34 is opened.

In addition, when the supply cartridge 9 is removed from the main assembly 100*a* of the apparatus, the movable member 32 is rotated by engagement with the movable member 62 which is regulated the regulating member 68, more particularly, which is prevented from rotating by the second operating portion 62*b*2 or 62*b*4 confined at the operating position. The movable member 32 moves interrelatedly the shutter 35 from the developer-supply-permitting position to the developer-supply-preventing position. That is, the supply opening 34 is closed.

The description will be made as to the case that supply cartridge 9 enters the main assembly 100*a* of the apparatus in the state that process cartridge 7 is set in the main assembly of the apparatus and as to the case that process cartridge 7 enters the main assembly 100*a* of the apparatus in the state that supply cartridge 9 is set in the main assembly of the apparatus.

The description will be made as to the structures and operations of the receiving-side movable member 62 and the regulating member 68 of the process cartridge 7.

The movable member 62 is rotated in interrelation with the shutter 65 such that shutter 65 is movable between the developer-reception-permitting position and the developer-reception-preventing position. The movable member 62 includes the first receiving-side operating portion 62*b*1 or 62*b*3 which is placed at the operating position when the shutter 65 takes the developer-reception-preventing position, and the second receiving-side operating portion 62*b*2 or 62*b*4 which is placed at the operating position when the shutter 65 takes the developer-reception-permitting position.

The regulating member 68 regulates the rotation of the movable member 62 when the first operating portion 62*b*1 or 62*b*3 or second operating portion 62*b*2 or 62*b*4 is placed at the operating position.

The description will be made as to the structures and operations of the first engageable member 31*b*, the second engageable member 31*a* and the supplying-side movable member 32 of the supply cartridge 9.

When the process cartridge 7 enters the main assembly 100*a* of the apparatus, the first engageable member 31*b* is brought into contact to the regulating member 68 which regulates the movable member 32, more particularly, which prevents the movable member 32 from rotating by the first operating portion 62*b*1 or 62*b*3 confined at the operating position, prior to the shutter 35 opening the supply opening 34. The first engageable member 31*b* moves the regulating member 68 downwardly against the elastic force of the spring 70. By this, it releases the regulating operation of the regulating member 68. Thus, it permits the movement of the movable member 62. Subsequently, the first engageable member 31*b* is engaged with the first operating portion 62*b*1 or 62*b*3 to rotate the movable member 32, in interrelation with which the shutter 65 is rotated from the developer-reception-preventing position to the developer-reception-permitting position. That is, the receiving opening 16*a* is opened.

When the supply cartridge 9 enters the main assembly 100*a* of the apparatus, the second engageable member 31*a* is brought into contact to the regulating member 68 which regulates the movable member 62, more particularly, which prevents the movable member 62 from rotating by the first operating portion 62*b*1 or 62*b*3 confined at the operating position, prior to the shutter 35 opening the supply opening 34. The second engageable member 31*a* moves the regulating member 68 downwardly against the elastic force. By this, it releases the regulating operation of the regulating member 68. Thus, it permits the movement of the movable member 62. The second engageable member 31*a* is engaged with the first operating portion 62*b*1 or 62*b*3 to rotate the movable member 62, in interrelation with which the shutter 65 is rotated from the developer-reception-preventing position to the developer-reception-permitting position. That is, the receiving opening 16*a* is opened.

When the process cartridge 7 enters the main assembly 100*a* of the apparatus, the supplying-side movable portion 32 is rotated by engagement with the movable member 62 which is confined by the regulating member 68, more particularly, which is prevented from rotating by the second operating portion 62*b*2 or 62*b*4 confined at the operating position, after the first engageable member 31*b* causes the shutter 65 to open the receiving opening 16*a*. The supplying-side movable portion 32 rotates interrelatedly the shutter 35 from the developer-supply-preventing position to the developer-supply-permitting position. That is, the supply opening 34 is opened.

Therefore, according to this embodiment of the present invention, the same advantageous effects as with the foregoing embodiments are provided.

The description will be made as to the structures and operations in the case that supply cartridge 9 is removed from the main assembly 100*a* of the apparatus, or the process cartridge 7 is removed therefrom in a state that process cartridge 7 and the supply cartridge 9 are set in the main assembly 100*a* of the apparatus.

The structures of the receiving-side movable member 62 and the regulating member 68 of the process cartridge 7 are the same as those of the foregoing embodiments.

The description will be made as to the structures and operations of the first engageable member 31*b*, the second engageable member 31*a* and the supplying-side movable member 32 of the supply cartridge 9.

When the process cartridge 7 is removed from the main assembly 100*a* of the apparatus, the first engageable member 31*b* is brought into contact to the regulating member 68 which regulates the movable member 62, more particularly, which is prevented from rotating by the second operating portion 62*b*2 or 62*b*4 confined at the operating position, after the shutter 35 closes the supply opening 34. The first engageable member 31*b* moves the regulating member 68 downwardly against the elastic force. By doing so, the first engageable member 31*b* releases the movable member 62 from the regulating member 68. Thus, it permits the movement of the movable member 62. Subsequently, the first engageable member 31*b* is engaged with the second operating portion 62*b*2 or 62*b*4 to rotate the movable member 62, in interrelation with which the shutter 65 is rotated from the developer-reception-permitting position to the developer-reception-preventing position. That is, the receiving opening 16*a* is closed.

When the supply cartridge 9 is removed from the main assembly 100*a* of the apparatus, the second engageable member 31*a* is brought into contact to the regulating member 68 which regulates the movable member 62, more particularly, which prevents the movable member 62 from rotating by the second operating portion 62*b*2 or 62*b*4 confined at the operating position, after the shutter 35 closes the supply opening 34. The second engageable member 31*a* moves the regulating member 68 downwardly against the elastic force. By this, it releases the regulating operation of the regulating member 68. Thus, it permits the movement of the movable member 62. Subsequently, the second engageable member 31*a* is engaged with the second operating portion 62*b*2 or 62*b*4 to rotate the movable member 62, in interrelation with which the shutter 65 is rotated from the developer-reception-permitting position to the developer-reception-preventing position. That is, the receiving opening 16*a* is closed.

According to this embodiment, the same advantageous effects as with the foregoing embodiments are provided.

Here, the receiving-side movable member 62 is disposed on the upper surface of the process cartridge when the process cartridge 7 is mounted to the main assembly 100*a* of the apparatus. The movable member 62 is rotatable such that peripheral moving direction thereof is along the mounting and dismounting direction relative to the main assembly 100*a* of the apparatus of the process cartridge 7 and along the length of the process cartridge 7. That is, the movable member 62 is rotatable about a horizontal axis extending in a direction crossing with a longitudinal direction of the process cartridge 7.

The shutter 65 is disposed on the upper surface of the process cartridge 7 when the process cartridge 7 is mounted to the main assembly 100*a* of the apparatus. The rotatable shutter 65 is cylindrical in shape. The shutter 65 is rotatable such that peripheral moving direction thereof is along the mounting and dismounting direction relative to the main assembly 100*a* of the apparatus of the process cartridge 7 and along the length of the process cartridge 7. In other words, the shutter 65 is in the form of a cylinder rotatable about a horizontal axis extending in a direction crossing with the longitudinal direction of the process cartridge 7. The shutter 65 is provided with an opening (communication opening 65*b*) in the peripheral surface thereof to permit flow of the developer in the radial direction of the cylindrical shape. When the opening is opposed or aligned with the receiving opening 16*a*, it opens the receiving opening 16*a*. The shutter 65 closes the receiving opening 16*a* by a portion thereof other than the opening is opposed to the developer receiving opening.

Here, the upper surface is a surface facing upward when the process cartridge 7 is mounted to the main assembly 100*a* of the apparatus. It does not necessarily mean a topmost service of the cartridge.

In this embodiment, the receiving-side shutter 65 is cylindrical, but this is not limiting. For example, the shutter 65 may be any rotatable member, more particularly, it may be in the form of a circular column, for example. However, the cylindrical shape is preferable from the standpoint of easiness a manufacturing. The shutter is not limited to the rotatable structure, but may be of a slidable structure, which will be described hereinafter.

The first receiving-side operating portion 62*b*1 or 62*b*3 is provided with a projection provided on the peripheral surface of the receiving-side movable member 62. The projection is engaged with the engageable member (first engageable member 31*b*, second engageable member 31*a*) to receive the rotating force. By doing so, the receiving-side shutter 65 is rotated. The second receiving-side operating portion 62*b*2 or 62*b*4 is provided with a projection provided on the peripheral surface of the movable member 62. The projection is engaged with the projection of the supplying-side operating portion 32*b*1, 32*b*2, 32*b*3, 32*b*4*d* of the movable member 32. By doing so, the supplying-side shutter 35 is rotated.

According to this embodiment of the present invention, the transmission of the force is assured because it is accomplished by abutment between the projections.

The movable member 32 is disposed on the lower surface of the supply cartridge 9 when the supply cartridge 9 is mounted to the main assembly 100*a* of the apparatus. The movable member 32 is rotatable such that peripheral moving direction thereof is along the mounting and dismounting direction relative to the main assembly 100*a* of the apparatus of the supply cartridge 9 and along the length of the supply cartridge 9. That is, the movable member 32 is rotatable about a horizontal axis extending in a direction crossing with a longitudinal direction of the supply cartridge 9.

The shutter 35 is disposed on the lower surface of the supply cartridge 9 when the supply cartridge 9 is mounted to the main assembly 100*a* of the apparatus. The rotatable shutter 65 is cylindrical in shape. The shutter 35 is rotatable such that peripheral moving direction thereof is along the mounting and dismounting direction relative to the main assembly 100*a* of the apparatus of the supply cartridge 9 and along the length of the supply cartridge 9. In other words, the shutter 35 is in the form of a cylinder rotatable about a horizontal axis extending in a direction crossing with the longitudinal direction of the supply cartridge 9. The shutter 35 is provided with an opening (communication opening 35*b*) in the peripheral surface thereof to permit flow of the developer in the radial direction of the cylindrical shape, the opening being opposed or aligned with the receiving opening 16*a* to open the receiving opening 16*a*. When the opening (communication opening 35*b*) is opposed to the supply opening 34, the supply opening 34 is opened, and when a portion other than the opening (communication opening 35*b*) is opposed to the supply opening 34, the supply opening 34 is closed.

Here, the lower surface means the surface or side facing downward when the supply cartridge 9 is mounted to the main assembly 100*a* of the apparatus. It does not necessarily mean the bottommost surface.

In this embodiment, the shutter 35 is cylindrical in shape, but this is not limiting to the present invention. It may be any rotatable member, a rotatable circular column, for example. However, the cylindrical shape is preferable from the standpoint of easiness a manufacturing. The shutter 35 is not limited to a rotatable one, but may be a slidable shutter, which will be described hereinafter.

Furthermore, the movable member 32 is provided with the supplying-side operating portions 32*b*1, 32*b*2, 32*b*3 and 32*b*4. The projection of the supplying-side operating portion 32*b*1, 32*b*2, 32*b*3, 32*b*4 is engaged with the projection of the receiving-side operating portion 62*b*2, 62*b*4 to receive a rotating force. By doing so, the shutter 35 is rotated.

According to this embodiment of the present invention, the transmission of the force is assured because it is accomplished by abutment between the projections.

As described hereinbefore, in this embodiment, the shutters 35 and 65 are rotatable cylindrical members (rotatable member). This is advantageous over a translational movement shutter in that area to which the developer is deposited is small.

The above-described operating position will be described in detail.

The operating position is the position at which the receiving-side operating portion (second receiving-side operating portion) 62*b*2, 62*b*4 of the receiving-side movable member 62, when the process cartridge 7 is mounted to the main assembly 100*a* of the apparatus, is opposed to or engaged with the supplying-side movable member 32 of the supply cartridge 9 mounted to the main assembly 100*a* of the apparatus. In this embodiment, the operating position is at the topmost position of the track of the rotation of the receiving-side movable member 62. At this operating position, the receiving-side operating portion 62*b*2, 62*b*4 receives the force from the engageable member 31*a* or 31*b* to rotate the receiving-side movable member 62. Or, at this operating position, the receiving-side operating portion 62*b*2, 62*b*4 applies the force to the supplying-side movable member 32 to rotate the supplying-side movable member 32.

In this manner, even if the developer supply cartridge 9 is mounted to the main assembly 100*a* of the apparatus in the state that process cartridge 7 is not mounted to the main assembly 100*a* of the apparatus, the closed state of the developer supply opening 34 is maintained. In addition, even when the process cartridge 7 is removed from the main assembly 100*a* of the apparatus in the state that both of the process cartridge 7 and the developer supply cartridge 9 are mounted to the main assembly 100*a* of the apparatus.

In the foregoing examples, the cartridges are properly operated irrespective of the order of mounting the supply cartridge 9 and the process cartridge 7 or the order of dismounting the supply cartridge 9 and the process cartridge 7. The supplying-side movable member 32 and the receiving-side movable member 62 are rotatable such that peripheral moving direction is along the mounting direction. In other words, movable member 62 is rotatable about a horizontal axis extending in a direction crossing with the longitudinal direction of the process cartridge 7 in the state that process cartridge 7 is mounted to the main assembly 100*a* of the apparatus. Similarly, movable member 32 is rotatable about a horizontal axis extending in a direction crossing with the longitudinal direction of the supply cartridge 9 in the state that supply cartridge 9 is mounted to the main assembly 100*a* of the apparatus.

Here, "horizontal" does not necessarily mean "perpendicular to the vertical direction (the direction of gravity)". More particularly, in this example, the "horizontal" covers the inclination from the right horizontal direction within the range of ±15°. The range is satisfactory as long as the movable member 32 and the movable member 62 are engaged with each other such that force can be transmitted. In other words, the range is satisfactory if the shutters 35 and 65 can be rotated.

By this, as compared with the conventional structure in which the supply opening and the sealing portion are mounted to a flat member rotatable about a vertical axis, the area of the developer supply opening and the area of the shutter are smaller with respect to the cross-sectional direction. For this reason, the process cartridge 7 and the developer supply cartridge 9 can be downsized, and the foot print of the image forming apparatus 100 can be reduced in the case that four process cartridges 7 and four developer supply cartridges 9 are arranged.

In addition, the supply opening 34 of the supply cartridge 9 is opened, only after the receiving opening 16*a* of the process cartridge 7 is opened, irrespective of the order of mounting operations of the process cartridge 7 and the supply cartridge 9 into the main assembly 100*a* of the apparatus. Therefore, the top level of the developer accommodated in the process cartridge 7 (developer accommodating portion 16) can be raised to the neighborhood of the receiving opening. This enables downsizing of the process cartridge 7 with respect to the direction of height. Even when the process cartridge 7 is mounted to the main assembly 100*a* of the apparatus in the state that supply cartridge 9 is not set in the main assembly 100*a* of the apparatus, the receiving opening 16*a* is never be opened. Therefore, the developer is prevented from blowing out through the opening 16*a* even upon the impact when the process cartridge 7 is mounted to the main assembly 100*a* of the apparatus. For this reason, the developer can be accommodated up to the neighborhood of the top level 7*e*.

In addition, the supply opening 34 is opened only after the receiving opening 16*a* is opened irrespective of the order of mounting of the process cartridge 7 and supply cartridge 9 into the main assembly 100*a* of the apparatus. Therefore, the developer is prevented from scattering when the process cartridge 7 or the developer supply cartridge 9 is mounted to the main assembly 100*a* of the apparatus.

The developer receiving opening 16*a* is closed only after the supply opening 34 is closed, irrespective of the order of dismounting operations of the process cartridge 7 and the supply cartridge 9 from the main assembly 100*a* of the apparatus. Therefore, the developer is prevented from scattering when the process cartridge 7 and/or the supply cartridge 9 is removed from the main assembly 100*a* of the apparatus.

As described hereinbefore, the receiving opening 16*a* of the process cartridge 7 is not opened when the supply cartridge 9 is not set in the main assembly 100*a* of the apparatus. Therefore, even when the process cartridge 7 is left in the main assembly 100*a* of the apparatus in the state that supply cartridge 9 is not set in the main assembly 100*a* of the apparatus, it is unlikely that foreign matter enters the process cartridge 7.

The supplying-side shutter 35 and the receiving-side shutter 65 can be opened in response to the mounting operation of the process cartridge 7 or the supply cartridge 9 irrespective of the order of mounting operations of the process cartridge 7 and the supply cartridge 9 into the main assembly 100*a* of the apparatus.

Furthermore, the supplying-side shutter 35 and receiving-side shutter 65 receiving-side shutter 65 can be closed in response to the dismounting operation of the process cartridge 7 and the supply cartridge 9, irrespective of the order of removing operations of the process cartridge 7 and the supply cartridge 9 into the main assembly 100*a* of the apparatus.

Accordingly, the opening and closing states of the supplying-side shutter 35 and the receiving-side shutter 65 can be switched therebetween in response to the mounting operations of the process cartridge 7 and the supply cartridge 9, irrespective of the order of mounting operations of the process cartridge 7 and the supply cartridge 9 into the main assembly 100*a* of the apparatus.

Thus, the operator can properly mount or dismount the process cartridge 7 and the supply cartridge 9 relative to the main assembly 100*a* of the apparatus irrespective of the order of the mounting and demounting operations of them. Thus, the mounting and demounting operativity is improved.

In addition, only when the receiving-side shutter 65 opens the receiving opening 16*a*, the projection 62*b* of the cartridge side movable member 62 and the projection 32*b* and recess 32*c* of the supplying-side movable member 32 are engageable with each other.

For this reason, the movable members 32 and 62 function as detection portions for detecting the opening state of the shutter of the process cartridge 7. This eliminates the necessity of provision of detecting mechanisms for this purpose. Furthermore, even if the operator erroneously mounts process cartridge 7 process cartridge 7 into the main assembly of the apparatus 100 in the state that shutter 65 of the process cartridge 7 is open, and then the operator mounts the supply cartridge 9 into the main assembly of the apparatus 100, the movable members 32 and 62 are not engaged with each other.

In that occasion, the mounting of the supply cartridge 9 results in incomplete mounting. The incompleteness can notify the operator of the erroneous mounting of the process cartridge 7.

Second Embodiment

Figure 14:
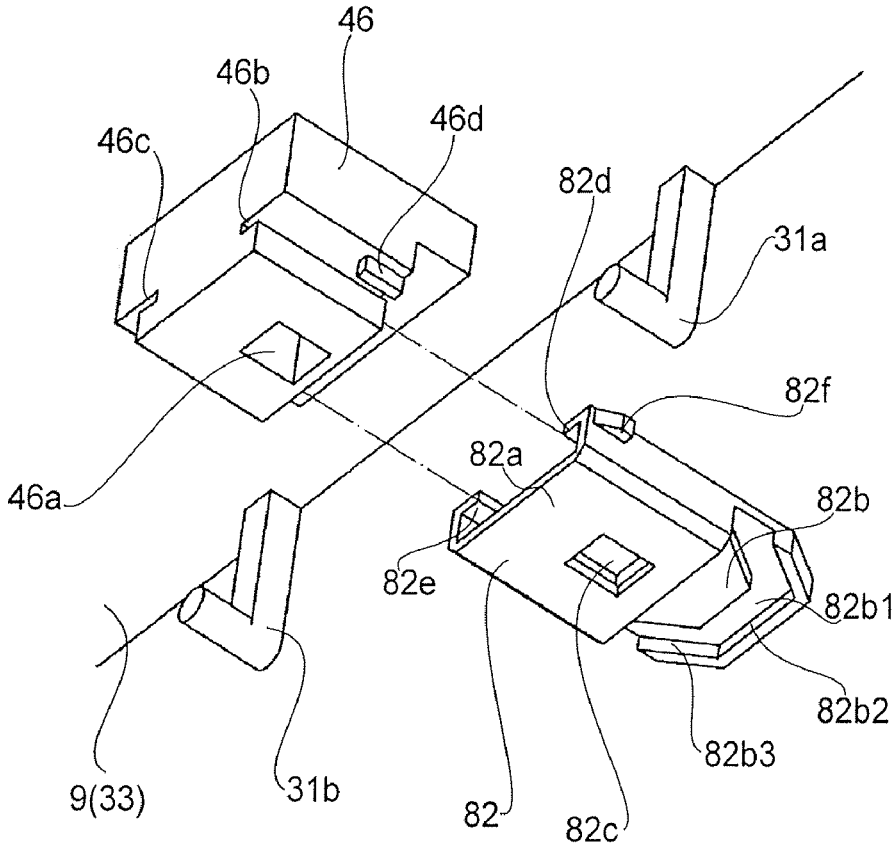
FIG. 14 is an exploded perspective view of a shutter of the developer supply cartridge and the elements therearound according to a second embodiment of the present invention.
Figure 15:
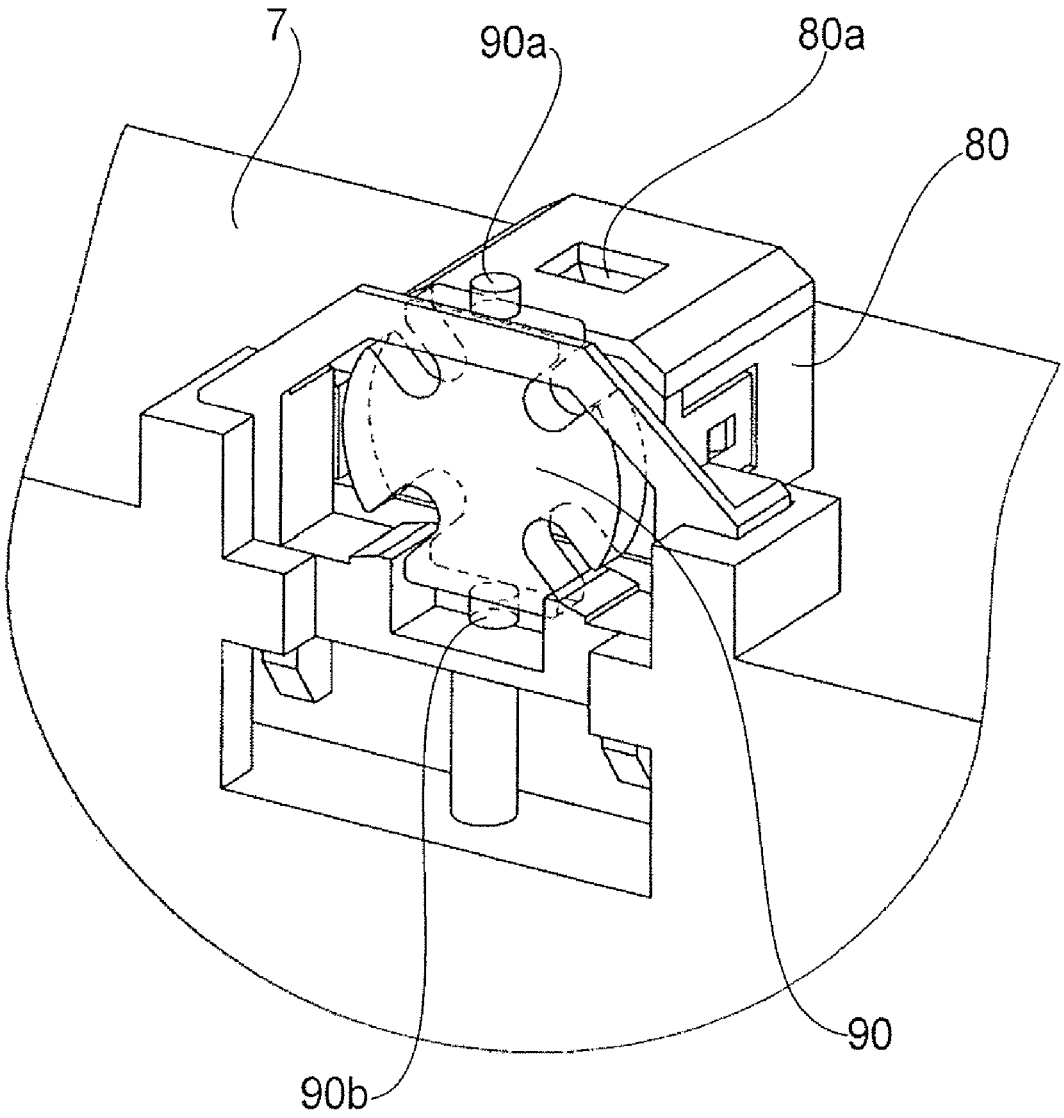
FIG. 15 is an exploded perspective view of a shutter of a process cartridge and the elements therearound, according to the second embodiment of the present invention.
Figure 16:
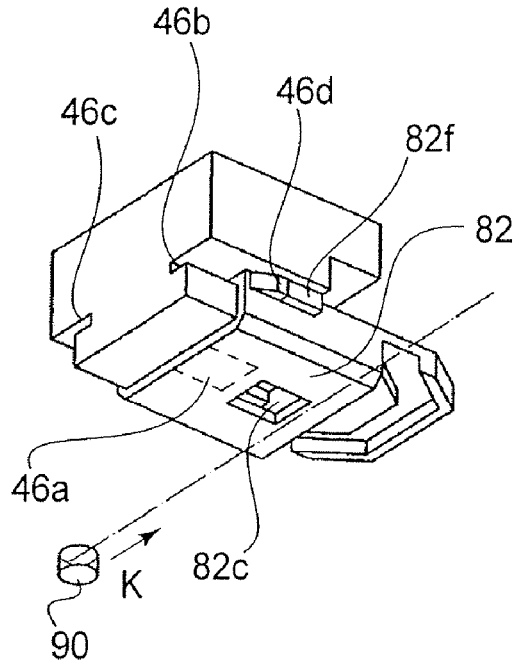
FIGS. 16(*a*) and 16(*b*) illustrate operations the shutter portions when the process cartridge is mounted to the main assembly of the apparatus in the state that developer supply cartridge is set in the main assembly of the apparatus, according to the second embodiment of the present invention.
Figure 16:
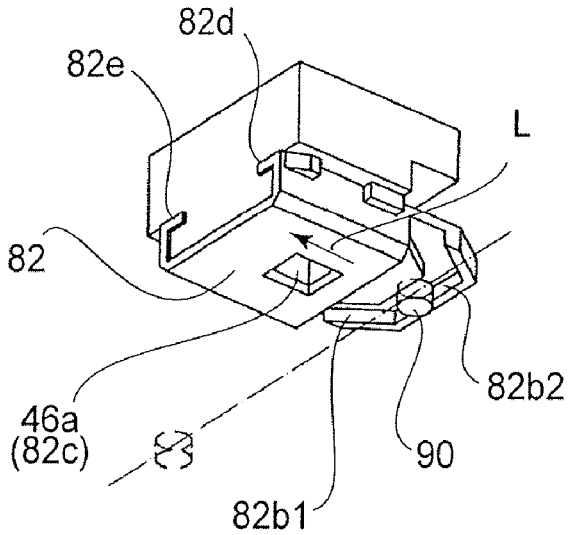

Referring to FIG. 14-FIG. 16, the shutter mechanism according to a second embodiment of the present invention will be described. In the second embodiment, the shutter portion is slidable in horizontal directions rather than rotatable. The basic structures of the developer supply cartridge and the process cartridge and the like are the same as those of the first embodiments, and therefore, the detailed description thereof is omitted for simplicity. The shutter mechanism of the developer supply cartridge and process cartridge process cartridge will be described. The same reference numerals as in Embodiment 1 are assigned to the elements having the corresponding functions in this embodiment, and the detailed description thereof is omitted for simplicity.

FIG. 14 is an exploded perspective view of a shutter of a supply cartridge 9 and the elements therearound. FIG. 15 is a perspective view of the shutter of the process cartridge 7 and the elements therearound. FIG. 16 illustrates operations of the shutter of the supply cartridge 9 and shows the elements therearound.

The shutter of the supply cartridge 9 in this embodiment will be described.

As shown in FIG. 14, on the lower surface, when the process cartridge 7 and the supply cartridge 9 are is set in the main assembly 100*a* of the apparatus, of the developer accommodating portion 33 of the supply cartridge 9, the T housing 46 is fixed. The T housing 46 is provided with a T housing opening 46*a* corresponding to the receiving opening 16*a* of the process cartridge 7. At the opposite ends of the T housing opening 46*a*, there are provided groove portions 46*b* 46*c* and stopper portions 46*d*. Below the T housing opening 46*a*, a supplying-side shutter 82 is provided.

The supplying-side shutter 82 comprises a shutter portion (supplying-side shutter portion) 82*a* for opening and closing the T housing opening 46*a* and a supplying-side movable portion 82*b* for providing the opening and closing force by engagement with the process cartridge 7. The shutter portion 82*a* is provided with a supplying-side shutter communication port 82*c*, a portion-to-be-engaged 82*d*, 82*e* and a claw portion 82*f*. On the other hand, the supplying-side movable portion 82*b* is provided with a guide groove 82*b*1 including inclined surfaces and a flat surface portion.

The assembling method of the shutter of the supply cartridge 9 will be described.

First, portions-to-be-engaged 82*d*, 82*e* of the supplying-side shutter 82 are engaged with groove portions 46*b*, 46*c* of the T housing 46. They are engaged such that claw portion 82*f* of the supplying-side shutter 82 rides over the stopper portion 46*d*. By this, the shutter 82 is held slidably in horizontal directions by the portions-to-be-engaged 82*d* portion-to-be-engaged 82*d*, 82*e* and the groove portions 46*b*, 46*c*. The claw portion 82*f* and the stopper portion 46*d* engaged with each other functions to prevent the shutter 82 from disengaging from the supply cartridge 9. With the sliding movement of the shutter 82, the supplying-side shutter communication port 85 and the T housing opening 46*a* become opposed to or aligned with each other where the developer can be supplied from the supply cartridge 9.

The structures of the shutter of the process cartridge 7 in this embodiment will be described.

As shown in FIG. 15, the receiving-side movable member (receiving-side movable portion) 90 used in this embodiment is provided with operating portions 90*a* and 90*b* in the form of projections. As shown in FIG. 15, the operating portion 90*a*, 90*b*, when the receiving-side shutter (receiving-side shutter portion) 65 is in the open state for permitting reception of the developer by the developer receiving opening 80*a* of the developing-device housing 80, is placed at the position opposing the supply cartridge 9 (developer-supply-permitting position). The other structures in the neighborhood of the shutter are the same as with the first embodiment, and therefore, the detailed description thereof will be omitted.

Referring to FIG. 16, the description will be made as to the case that process cartridge 7 is mounted to the main assembly 100*a* of the apparatus in the state that supply cartridge 9 is set in the main assembly 100*a* of the apparatus.

During the mounting process of the process cartridge 7, the operations are the same as with the first embodiment up to a certain stage. More particularly, the movable member 90 moves to open the receiving opening 80*a*, and then the movable member 90 is regulated to be prevented from rotation, by the regulating member 68, and up to this stage, the operations are the same as with the first embodiment. Therefore, the description will be omitted. As described above, when the receiving opening 80*a* is in the open state for permitting developer reception, the operating portion 90*a* or 90*b* provided on the movable member 90 is disposed opposed to the supply cartridge 9 (developer-supply-preventing position) (FIG. 16).

In this case, the T housing opening 46*a* of the developer supply cartridge 9 is not disposed opposed to the communication opening 82*c*, that is, it is in the closed state for preventing the supply of developer. The process cartridge 7 is further advanced into the main assembly 100*a* of the apparatus. Then, the operating portion 90*a* or the operating portion 90*b* moves in the direction of an arrow K ((a) of FIG. 16). And, the operating portion 90*a* or operating portion 90*b* is engaged with the guide groove 82*b*1.

When the process cartridge 7 is further advanced into the main assembly 100*a* of the apparatus, the operating portion 90*a* or the operating portion 90*b* is set in the guided by the inclined surface portion 82*b*3 and the flat surface portion 82*b*2 provided in the guide groove 82*b*1. Therefore, the supplying-side shutter 82 held slidably by the groove portion 46*b* and the groove portion 46*c* is moved in the direction of arrow L ((b) of FIG. 16). That is, the shutter 82 moves horizontally.

The process cartridge 7 reaches the position ((b) of FIG. 16) of completed mounting. Then, the operating portion 90*a* or the operating portion 90*b* is held by the flat surface portion 82*b*2 of the guide groove 82*b*1, and the communication opening 82*c* of the supplying-side shutter 82 and the T housing opening 46*a* become opposed to each other.

When the process cartridge 7 is dismounted from the main assembly 100*a* of the apparatus in the state that process cartridge 7 and the supply cartridge 9 are mounted, the supplying-side shutter 82, the regulating member 68, the movable member 90 and the receiving-side shutter 65 are operated in the reverse order.

Therefore, when the process cartridge 7 is set in the main assembly 100*a* of the apparatus, the housing opening 46*a* of the supply cartridge 9 mounted in the main assembly 100*a* of the apparatus and the communication opening 82*c* are not opposed to each other. Therefore, the housing opening 46*a* is closed so that supply of the developer into the process cartridge 7 is not possible.

The operations are the same as those described above when the supply cartridge 9 is mounted to the main assembly 100*a* of the apparatus in the state that process cartridge 7 is set in the main assembly 100*a* of the apparatus and when the supply cartridge 9 is dismounted from the main assembly of the apparatus 100 in the state that supply cartridge 9 and the process cartridge 7 are set in the main assembly of the apparatus 100.

According to this embodiment, similarly to the first embodiment, the space saving, the suppression of toner scattering or the like is accomplished.

In this embodiment, the supplying-side shutter 82 is such that shutter portion 82*a* and the movable portion 82*b* are integral with each other. However, in this embodiment, the supplying-side shutter 82 may be constituted by a supplying-side shutter for opening and closing the housing opening and a supplying-side movable member for receiving a force from the operating portion of the process cartridge.

In this embodiment, the shutter 82 slides in the horizontal direction. By doing so, the supply opening 34 can be opened and closed.

Third Embodiment

Referring to FIG. 19-FIG. 22, the description will be made as to a shutter mechanism usable with the supply cartridge 9 and the process cartridge 7 which the present invention is applicable to, according to third embodiment of the present invention. In the third embodiment, an outer cover is employed.

Figure 19:
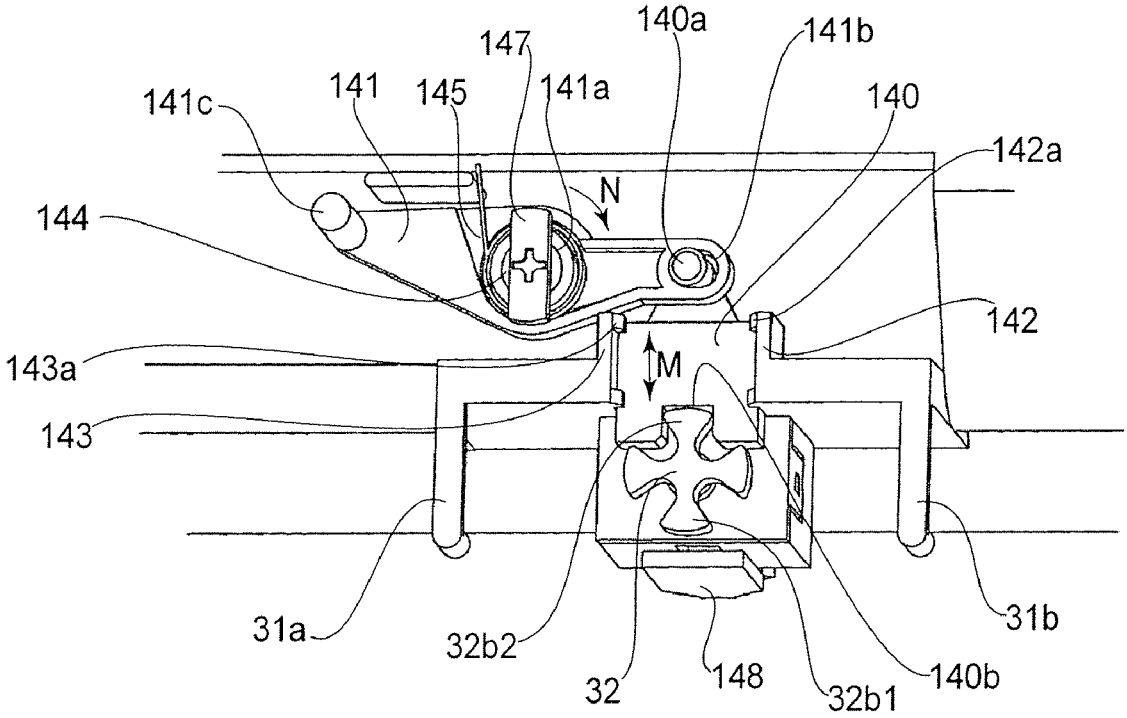
FIG. 19 is a perspective view of a stopper actable on a supplying-side movable member of a developer supply cartridge according to a third embodiment of the present invention.
Figure 20A:
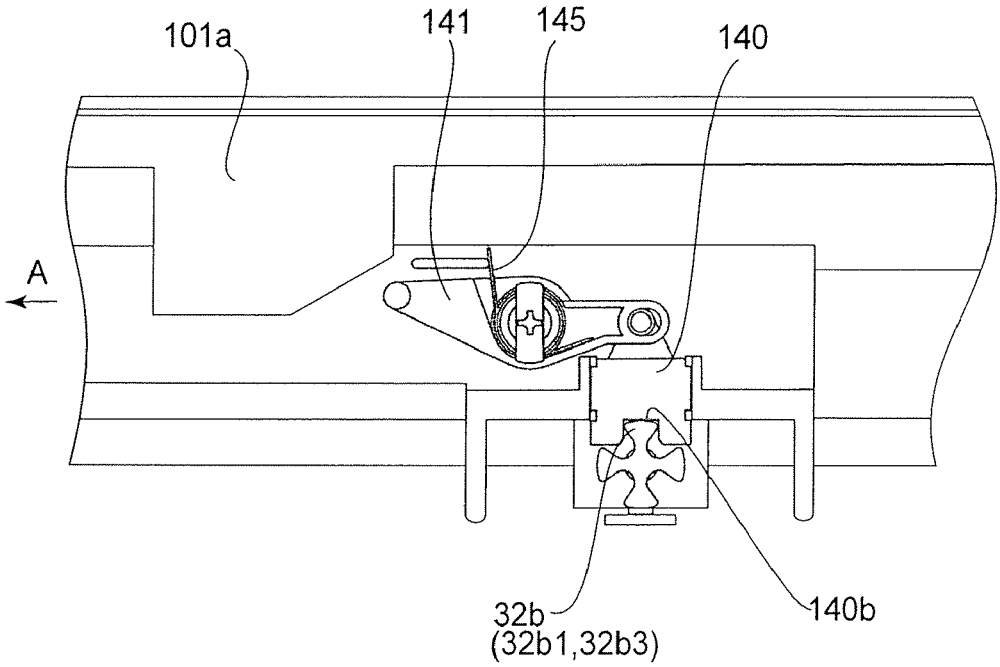
FIG. 20*a* illustrates operations of the stopper of the developer supply cartridge and the elements therearound, according to the third embodiment over the present invention.
Figure 20B:
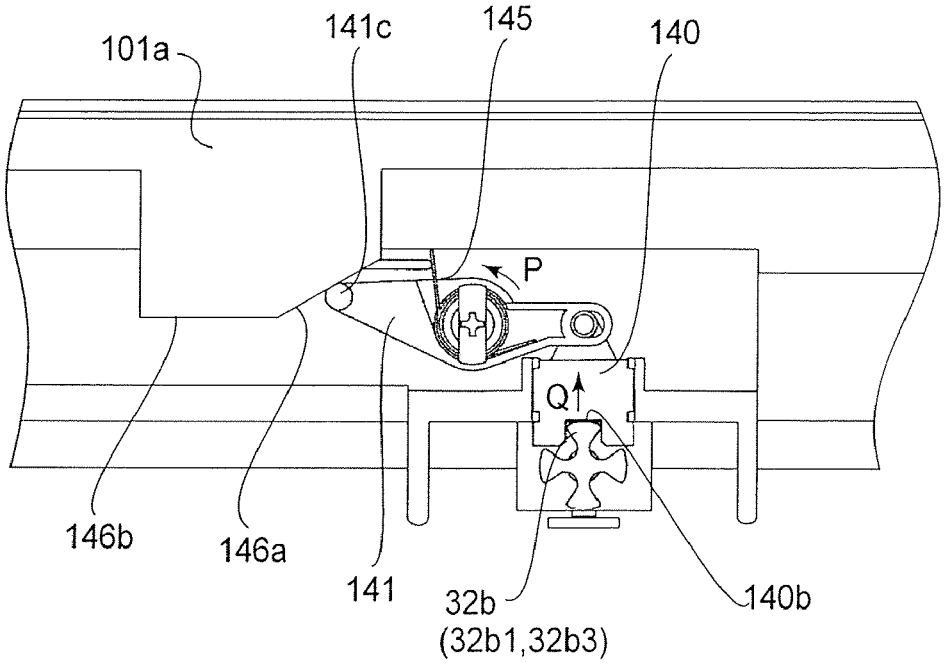
FIG. 20*b* illustrates operations of the stopper of the developer supply cartridge and the elements therearound, according to the third embodiment over the present invention.
Figure 20C:
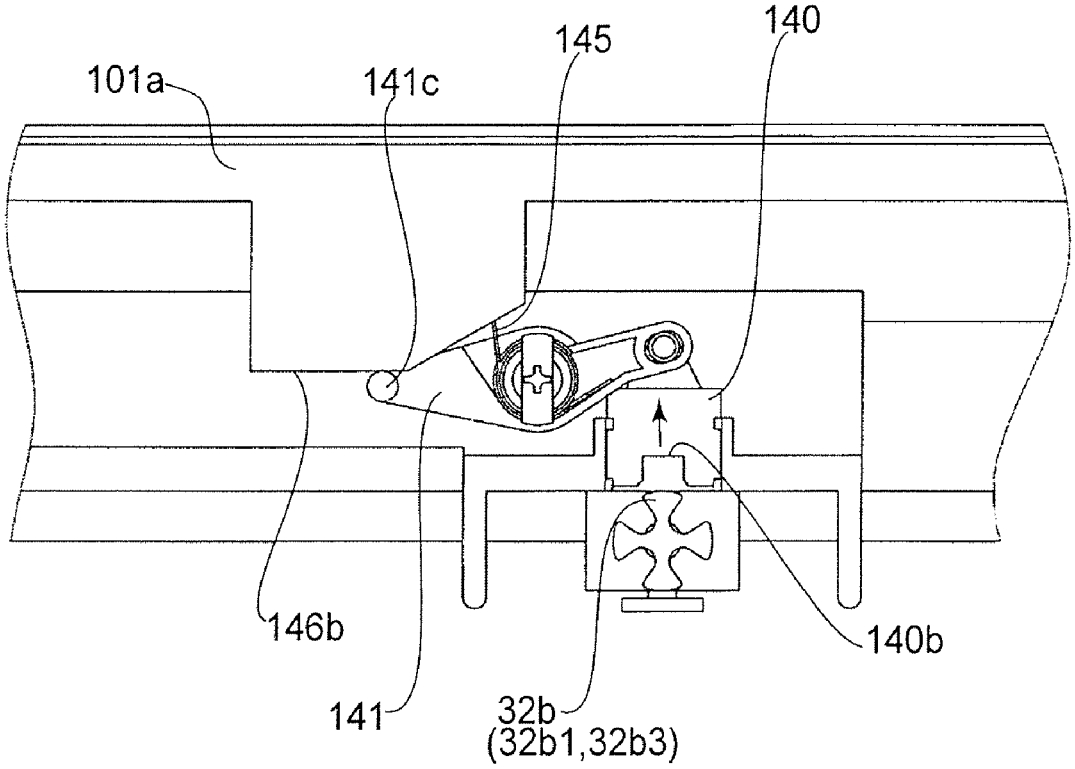
FIG. 20*c* illustrates operations of the stopper of the developer supply cartridge and the elements therearound, according to the third embodiment over the present invention.
Figure 21:
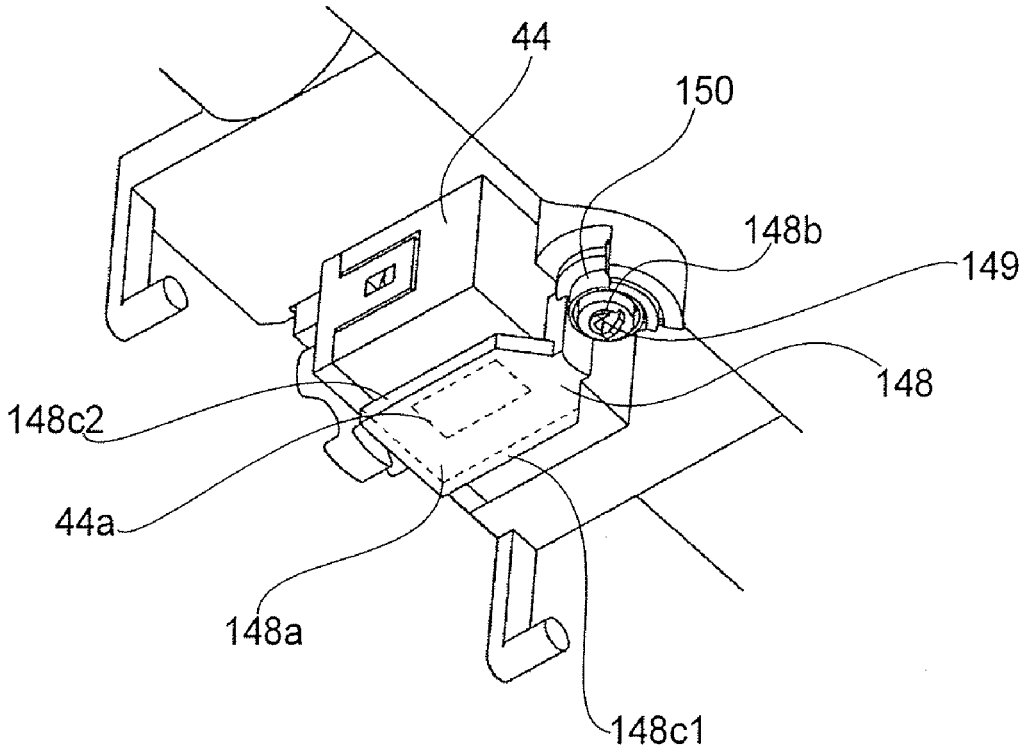
FIG. 21 is a perspective view of an outer cover of the developer supply cartridge according to the third embodiment of the present invention.

FIG. 19 is a perspective view of a stopper actable on the supplying-side movable member of the supply cartridge 9. FIG. 20 illustrates operations of the stopper of the supply cartridge 9 and the elements therearound. FIG. 21 is a perspective view of the outer cover of the supply cartridge 9. FIG. 22 illustrates operations of the outer cover of the developer supply cartridge 9 and the elements therearound.

The structures of the shutter and the structures of the shutter of the supply cartridge 9 are the same as those of the process cartridge 7, and therefore, the description thereof is omitted.

[Structures of Stopper of Supplying-side Movable Member of Supply Cartridge]

Referring to FIG. 19, movement regulating (stopper) of the movable member 32 of the supply cartridge 9 will be described.

The developer accommodating portion 33 is provided with a T regulation releasing member 141 and T regulating member 140 for regulating the movement of the movable member 32.

The regulating member 140 is held for sliding movement in the vertical direction (direction of arrow M) by claw portions 142*a*, 143*a* and slide rails 142, 143 provided on the developer accommodating portion 33.

The releasing member 141 is supported rotatably by the hole portion 140*a* of the releasing member 141 being engaged the shaft portion 144 and the disengagement preventing member 147 provided on the developer accommodating portion 33. The releasing member 141 is provided with an engaging hole 141*b* engaged with the engagement shaft 140*a* of the regulating member 140. At a position across the hole portion 141*a* (rotational center of the releasing member 141) from the engaging hole 141*b*, there is provided a force receiving shaft portion 141*c* for receiving a driving force from the main assembly of the apparatus 100. By the driving force, the releasing member 141 is rotated.

By the elastic force of a coil spring 145 provided between the developer accommodating portion 33 and the releasing member 141, the releasing member 141 is urged in the clockwise direction (direction of arrow N of FIG. 19). The urging force normally urges the regulating member 140 engaged with the releasing member 141 downwardly.

At the home position state (regulation position), the regulation recess 140*b* provided on the regulating member 140 and the projection 32*b* (32*b*1, 32*b*3) of the movable member 32 are engaged to each other. By this, the movement of the movable member 32 is regulated or is prevented.

[Operations of Stopper of Supplying-side Movable Member]

Referring to FIG. 20, the operation of the regulating member 140 when the supply cartridge 9 enters the main assembly of the apparatus 100 will be described.

As described hereinbefore, when the supply cartridge 9 is not set in the main assembly of the apparatus 100, the recess 140*b* is in engagement with the projection 32*b* (32*b*1, 32*b*3) of the movable member 32. Therefore, the movement of the movable member 32 is regulated or prevented.

Therefore, even if the operator inadvertently touches the movable member 32, or even if vibration is imparted to the supply cartridge 9 during transportation stage thereof, the movable member 32 does not move.

The supply cartridge 9 is carried on main assembly rails 101*a* provided in the main assembly 100*a* of the apparatus and is advanced into the main assembly 100*a* of the apparatus (the supply cartridge 9 moves in the direction of arrow A ((a) of FIG. 20).

When the supply cartridge 9 is inserted to the position shown in (b) of FIG. 20, the force reception shaft portion 141*c* of the releasing member 141 is brought into contact to the inclined surface portion 146*a* of the guide 146 of the main assembly rail 101*a*.

And, with the advancement of the supply cartridge 9, the shaft portion 141*c* is guided by the inclined surface portion 146*a*. By doing so, the releasing member 141 is moved in the couterclockwise direction (in the direction of arrow P in (b) of FIG. 20) against the elastic force (spring force). The releasing member 141 is urged in the clockwise direction by the elastic force of the coil spring 145. By this, the regulating member 140 positioned at the lower regulation position is moved to the upper permitting position (the direction of arrow Q of (b) in FIG. 20) in the developer accommodating portion 33.

When the supply cartridge 9 is further advanced such that shaft portion 141*c* reaches the flat surface portion 146*b* of the guide surface 146, the engagement between the recess 140*b* and the projection 32*b* (32*b*1 or 32*b*3 in FIG. 6) is released. By this, the movable member 32 becomes rotatable ((c) of FIG. 20).

By moving the movable member 32 in this state, the communication opening 44*a* is opened. Thus, the supply of the developer into the process cartridge 7 from the supply cartridge 9 is permitted.

In this manner, the release action for the prevention of movement of movable member 32 by the regulating member 140 is controlled to occur prior to the movement of the movable member 32 opening the communication opening 44*a*, by the proper arrangement of the guide surface 146 (146*a*, 146*b*) of the main assembly rail 101 in the longitudinal direction. Therefore, the regulating member can regulate or prevent movement of the movable member 32, without preventing the opening and closing operation of the shutter portion 82*a* during the operation.

[Structure of T Outer Cover of Supply Cartridge]

As shown in FIG. 21, the lower surface of the housing 44 of the supply cartridge 9 is covered by a T outer cover 148. The cover 148 includes a cover portion 148*a* covering the communication opening 44*a* of the housing 44 and a shaft hole 148*b* engaged by the shaft portion 149 of the developer accommodating portion 33. The cover 148 includes surfaces 148*c*1, 148*c*2 to be urged for retracting the cover 148 from the communication opening 44*a* by being contacted by the sealing member 67 or the developing-device housing 45 of the process cartridge 7. The cover 148 is disposed at a position covering the communication opening 44*a* when it does not receive a force from the coil spring 150 disposed substantially coaxially with the shaft portion 149.

[Driving Structure for T Outer Cover Portion]

Referring to FIG. 22, the description will be made as to the retracting operation of the cover 148 when only one of the supply cartridge 9 and the process cartridge 7 is set in the main assembly 100*a* of the apparatus, and the other cartridge is mounted to the main assembly 100*a* of the apparatus.

First, the case that supply cartridge 9 is mounted to the main assembly 100*a* of the apparatus in the state that process cartridge 7 is set in the main assembly 100*a* of the apparatus will be dealt with.

Figure 22A:
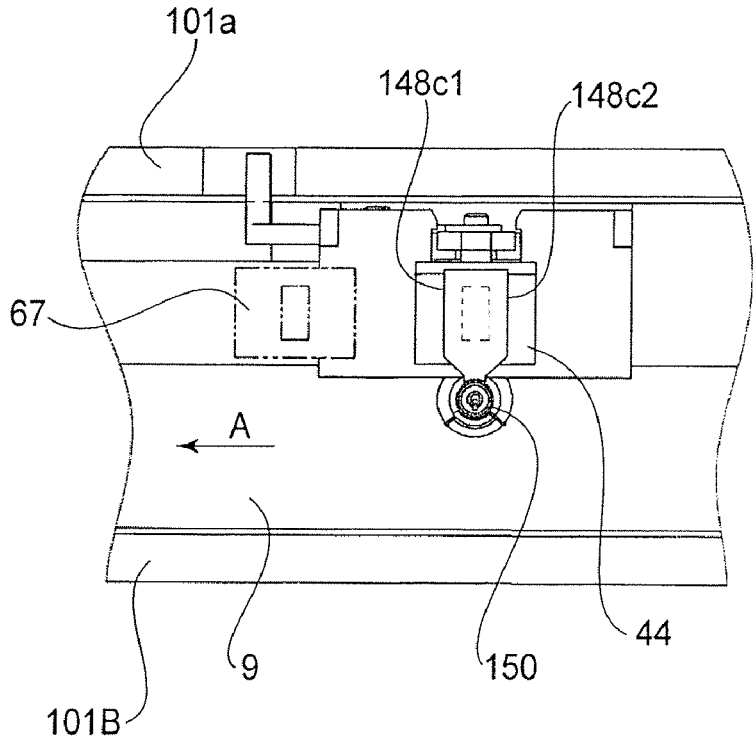
FIG. 22*a* illustrates operation of the outer cover of the developer supply cartridge and the elements therearound, according to the third embodiment of the present invention.

The supply cartridge 9 is carried on the main assembly rails 101*a* and 101*b* provided in the main assembly of the apparatus 100 and is inserted in the direction indicated by an arrow A in FIG. 22*a*.

Figure 22B:
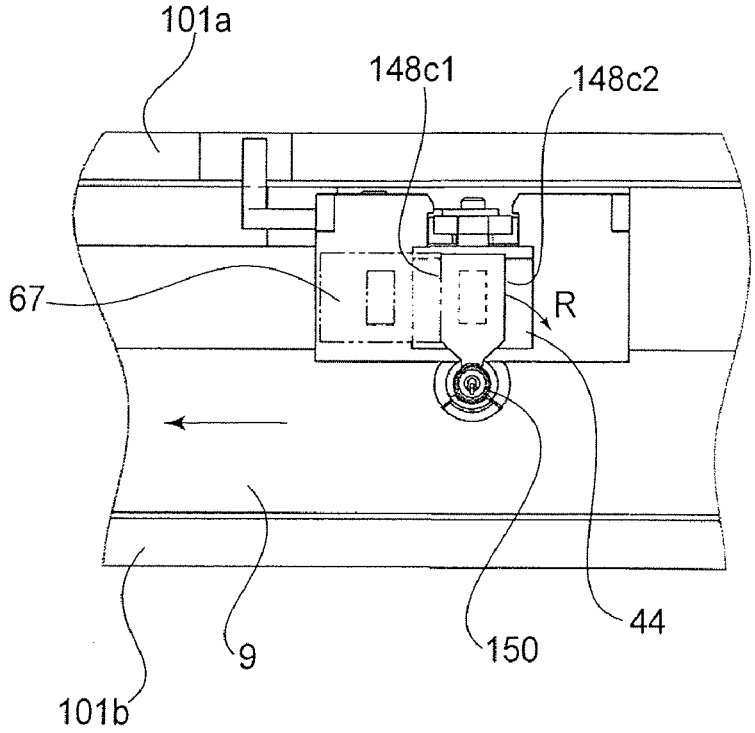
FIG. 22*b* illustrates operation of the outer cover of the developer supply cartridge and the elements therearound, according to the third embodiment of the present invention.

When the supply cartridge 9 is inserted to the position shown in FIG. 22*b*, the surface 148*c*1 to be urged of the cover 148 is brought into contact to the sealing member 67 of the process cartridge 7 as indicated by chain lines in FIG. 22*b*.

With the advancement of the supply cartridge 9, the surface 148*c*1 is urged by the sealing member 67. By doing so, the cover 148 disposed at the position covering the communication opening 44*a* by the coil spring 150 is rotated in the clockwise direction (R direction in the Figure) against the spring force.

Furthermore, before the completion of mounting operation of the supply cartridge 9 to the main assembly of the apparatus 100, the cover 148 becomes retracted from the communication opening 44*a*. Therefore, the supply of the developer from the supply cartridge 9 is permitted (FIG. 22*c*).

Figure 22C:
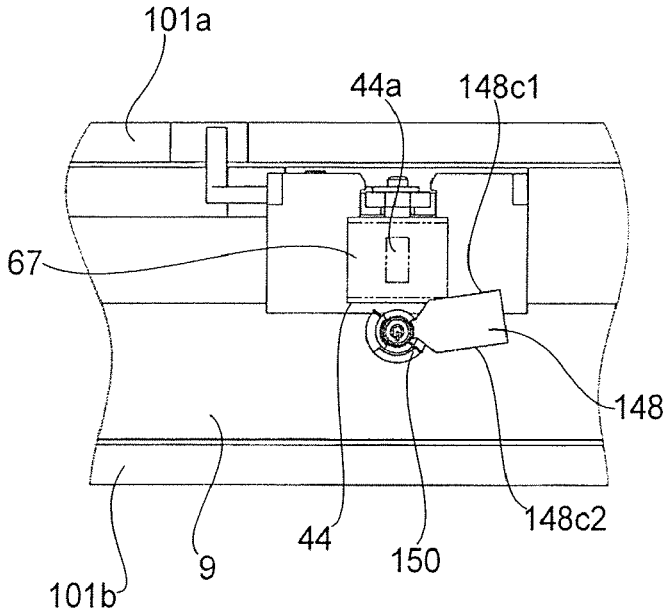
FIG. 22*c* illustrates operation of the outer cover of the developer supply cartridge and the elements therearound, according to the third embodiment of the present invention.

When the supply cartridge 9 is removed from the main assembly 100*a* of the apparatus in the state that process cartridge 7 and the supply cartridge 9 are set in the main assembly 100*a* of the apparatus, the order of the operations of the cover 148 are reverse (FIG. 22*c* to FIG. 22*a*).

When the supply cartridge 9 is removed, the cover 148 restores to the position covering the communication opening 44*a* by the urging force of the coil spring 150.

The description will be made as to the case that process cartridge 7 is removed from the main assembly 100*a* of the apparatus in the state that process cartridge 7 and the supply cartridge 9 are set in the main assembly 100*a* of the apparatus.

Figure 22D:
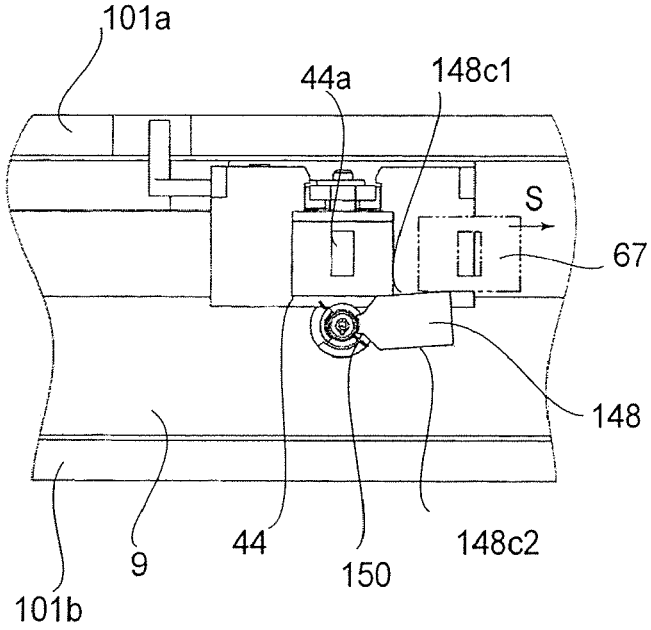
FIG. 22*d* illustrates operation of the outer cover of the developer supply cartridge and the elements therearound, according to the third embodiment of the present invention.

The process cartridge 7 moves in the direction of an arrow S (FIG. 22*d*). During the period in which the surface 148*c*1 to be urged is urged by the sealing member 67 in the process of dismounting the process cartridge 7, the cover 148 is kept retracted from the communication opening 34*a* (FIG. 22*d*).

Thereafter, when the process cartridge 7 is further pulled out to such a position that sealing member 67 becomes out of contact with the surface 148*c*1 to be urged, the cover 148 restores to the position covering the communication opening 34*a* by the urging force of the coil spring 150.

Figure 22E:
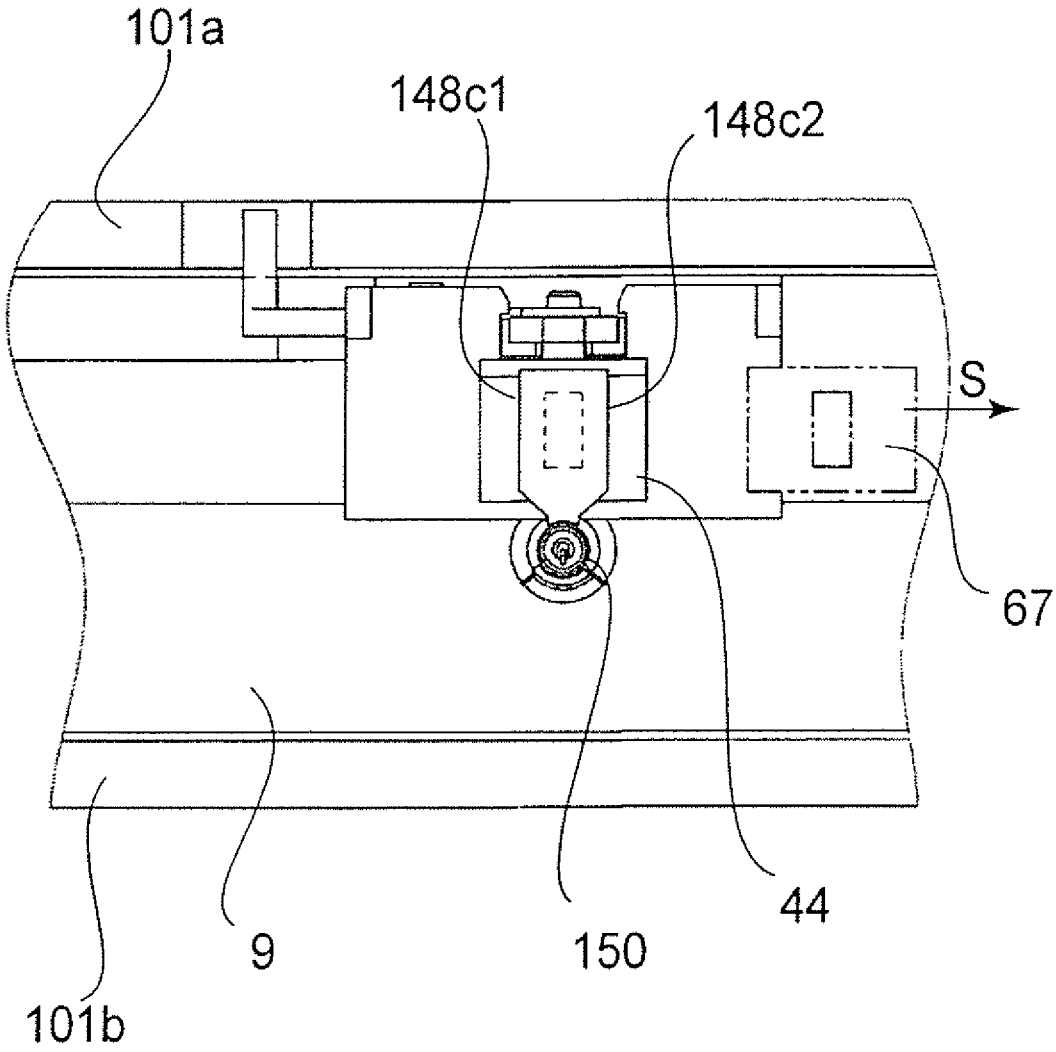
FIG. 22*e* illustrates operation of the outer cover of the developer supply cartridge and the elements therearound, according to the third embodiment of the present invention.

Therefore, when the supply cartridge 9 is completely dismounted, the cover 148 restores the position covering the communication opening 44*a* by the urging force of the coil spring 150 (FIG. 22*e*).

Thus, irrespective of whichever cartridge 7 or 9 is first removed, the T outer cover 148 covers the communication opening 34*a*, 44*a* in the process of the removing operation of the cartridge.

In the case that process cartridge 9 is mounted to the main assembly of the apparatus 100 in the state that supply cartridge 9 is set in the main assembly of the apparatus 100, the sealing member 67 urges the surface 148*c*2 to be urged. By this, similarly to the above-described case, the cover 148 disposed at the position covering the communication opening 44*a* by the coil spring 150 is moved against the elastic force (spring force). And, the cover 148 is retracted from the communication opening 44*a*.

With such a structure, the portion supplying the developer is normally covered by the cover 148 except for the operation state. Therefore, when the supply cartridge 9 is mounted to or dismounted from relative to the main assembly 100*a* of the apparatus, the developer supplying portion disposed on lower surface portion of the supply cartridge 9 which is not easily seen by the operator is prevented from being inadvertently touched by the operator.

The operations when the cartridge 9 is mounted to the main assembly 100*a* of the apparatus in the state that process cartridge 7 is set in the main assembly 100*a* of the apparatus or when the supply cartridge 9 is removed from the main assembly 100*a* of the apparatus in the state that cartridge 9 and the process cartridge 7 are set in the main assembly 100*a* of the apparatus, are the same as those described above, and therefore, the detailed description of such cases are omitted.

In this embodiment, similarly to the first embodiments, the space saving, the suppression of developer scattering or the like can be accomplished.

In the foregoing descriptions, the color electrophotographic image forming apparatus employing four supply cartridges and four process cartridge are used correspondingly has been taken as an example. However, the present invention is not limited to such an example. For example, the present invention is applicable to a developer supply cartridge and a process cartridge used with a monochromatic electrophotographic image forming apparatus. The present invention is also applicable to such an electrophotographic image forming apparatus.

In addition, as described above, in present invention, the receiving-side shutter and the receiving-side movable member may be separate members, and the supplying-side shutter and the supplying-side movable member may be separate members.

In such a case, the assemblying is easy.

On the contrary, in the case of the integral structures, the number of parts can be reduced. One skilled in the art can properly select the structures depending on the cases.

In the foregoing description, the operating portion has a projection. However, the present invention is not limited to such a structure. For example, the operating portion may be provided with a friction member to intentionally enhance the sliding resistance. When the operating portion has the projection, the driving force can be transmitted assuredly.

As described in the foregoing, according to the present invention, when the developer is supplied into the process cartridge from the developer supply cartridge, the leakage of the developer can be effectively prevented.

According to present invention, the receiving-side movable member movable in interrelation with the receiving-side shutter can be used for moving the supplying-side movable member.

According to the embodiment wherein the developer supply cartridge is entered into the main assembly of the apparatus in the state that process cartridge is set in the main assembly of the apparatus, the developer can be supplied through the supply opening only when the receiving opening can receive the developer.

According to the embodiment wherein the developer supply cartridge is removed from the main assembly of the apparatus in the state that process cartridge is set in the main assembly of the apparatus, the receiving opening is prevented from receiving the developer with the supply opening is prevented from supplying the developer.

According to the embodiment wherein the process cartridge is mounted to the main assembly of the apparatus in the state that developer supply cartridge is set in the main assembly of the apparatus, the developer can be supplied through the supply opening only when the receiving opening can receive the developer.

According to the embodiment wherein the process cartridge is removed from the main assembly of the apparatus in the state that developer supply cartridge is set in the main assembly of the apparatus, the receiving opening can prevent reception of the developer with the supply opening is prevented from supplying the developer.

According to the embodiments of the present invention, the supply opening is prevented from opening even if the developer supply cartridge is entered into the main assembly of the apparatus in the state that process cartridge is not set in the main assembly of the apparatus.

According to the embodiments of the present invention, the receiving opening is prevented from opening even if the process cartridge is entered into the main assembly of the apparatus in the state that developer supply cartridge is not set in the main assembly of the apparatus.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 066011/2006 and 295074/2006 filed Mar. 10, 2006 and Oct. 31, 2006, respectively which are hereby incorporated by reference.

What is claimed is:

1. A process cartridge detachably mountable to a main assembly of an electrophotographic image forming apparatus, wherein said process cartridge is capable of receiving a supply of a developer from a developer supply cartridge, wherein the developer supply cartridge includes a supplying-side developer accommodating portion for accommodating the developer, a supplying-side shutter portion movable between a developer-supply-permitting position for opening a developer supply opening for supplying the developer from the supplying-side developer accommodating portion into the process cartridge and a developer-supply-preventing position for closing the developer supply opening, a supplying-side movable portion movable to interrelatedly move the supplying-side shutter portion between the developer-supply-permitting position and the developer-supply-preventing position, and an engageable member, said process cartridge comprising:

an electrophotographic photosensitive drum;

a developing roller that develops an electrostatic latent image formed on said electrophotographic photosensitive drum with the developer;

a receiving-side developer accommodating portion that accommodates the developer;

a developer receiving opening that receives the developer into said receiving-side developer accommodating portion;

a receiving-side shutter portion movable between a developer-reception-permitting position for opening said developer receiving opening and a developer-reception-preventing position for closing said developer receiving opening;

a regulating member; and a receiving-side movable portion movable to interrelatedly move said receiving-side shutter portion between the developer-reception-permitting position and the developer-reception-preventing position, said receiving-side movable portion including a first receiving-side operating portion which takes an operating position when said receiving-side shutter portion is at the developer-reception-preventing position and a second receiving-side operating portion which takes the operating position when said receiving-side shutter portion is at the developer-reception-permitting position, wherein when said process cartridge enters the main assembly of the apparatus with said regulating member regulating movement to place said first receiving-side operating portion at the operating position in a state that the developer supply cartridge is set in the main assembly of the apparatus, said regulating member contacts the engageable member to release said receiving-side movable portion, thus permitting movement of said receiving-side movable portion, then said receiving-side movable portion moves said receiving-side shutter portion to the developer-reception-permitting position in interrelation with said first receiving-side operating portion being moved by contacting the engageable member, and then said receiving-side movable portion moves the supplying-side shutter portion to the developer-supply-permitting position in interrelation with the supplying-side movable portion being moved by engagement of said second receiving-side operating portion with the supplying-side movable portion while being regulated by said regulating member in a state that said second receiving-side operating portion is placed at the operating position, and wherein when said process cartridge is removed from the main assembly of the apparatus in a state that the developer supply cartridge is set in the main assembly of the apparatus, said second receiving side operating portion moves the supplying side movable portion by engagement with the supplying side movable portion which is regulated by said regulating member in a state that said receiving side movable portion is placed at the operating position to interrelatedly move the supplying side shutter portion to the developer supply preventing position, then said regulating member contacts the engageable member to release said receiving side movable portion, thus permitting movement of said receiving side movable portion, and said receiving side movable portion moves said receiving side shutter portion to the developer reception preventing position in interrelation with said first receiving side operating portion being moved by contacting the engageable member.

2. A process cartridge according to claim 1, wherein said receiving-side shutter portion is disposed on an upper surface of said process cartridge in a state that said process cartridge is mounted to the main assembly of the apparatus and includes a rotatable member rotatable about a horizontal axis crossing a longitudinal direction of said process cartridge, said rotatable member being provided with an opening which opens in a radial direction of rotation of said rotatable member, wherein said developer receiving opening is opened by said opening of said rotatable member opposing said developer receiving opening, and said developer receiving opening is closed by a portion of said rotatable member other than said opening opposing to said developer receiving opening.

3. A process cartridge according to claim 1, wherein said receiving-side movable portion is rotatable, wherein said first receiving-side operating portion includes a projection having a portion extending along a rotational movement direction of said receiving-side movable portion, and said projection receives a force by engagement with the engageable member to rotate said receiving-side shutter portion, and wherein said second receiving-side operating portion includes a projection having a portion extending along the rotational moving direction of said receiving-side movable portion, said projection of said second receiving-side operating portion being engageable with a projection of a supplying-side operating portion of the supplying-side movable portion to apply a rotating force, thus rotating the supplying-side shutter portion.

4. A developer supply cartridge for supplying a developer into a process cartridge, said developer supply cartridge being detachably mountable to a main assembly of an electrophotographic image forming apparatus, wherein the process cartridge includes an electrophotographic photosensitive drum, a developing roller that develops an electrostatic latent image formed on the electrophotographic photosensitive drum, a receiving-side shutter portion movable between a developer-reception-permitting position for opening a developer receiving opening for receiving the developer to be used by the developing roller for a developing operation and a developer-reception-preventing position for closing the developer receiving opening, a receiving-side movable portion rotatable to interrelatedly move the receiving-side shutter portion between the developer-reception-permitting position and the developer-reception-preventing position, the receiving-side movable portion including a first receiving-side operating portion which takes an operating position when the receiving-side shutter portion is at the developer-reception-preventing position, and a second receiving-side operating portion which takes the operating position when the receiving-side shutter portion is at the developer-reception-permitting position, and a regulating member that regulates rotation of the receiving-side movable portion when the first or second receiving-side operating portion is at the operating position, said developer supply cartridge comprising:

a supplying-side developer accommodating portion that accommodates the developer;

a developer supply opening that supplies the developer from said supplying-side developer accommodating portion into the process cartridge through the developer receiving opening;

a supplying-side shutter portion movable between a developer-supply-permitting position for opening said developer supply opening and a developer-supply-preventing position for closing said developer supply opening;

a first engageable member fixed at a position upstream of said developer supply opening with respect to an entering direction in which said developer supply cartridge enters the main assembly of the apparatus, wherein when the process cartridge is removed from the main assembly of the apparatus in a state that said developer supply cartridge is set in the main assembly of the apparatus, said first engageable member releases, after said supplying-side shutter portion closes said developer supply opening, the receiving-side movable portion from the regulating member by contacting the regulating member which regulates rotation of the receiving-side movable portion with the second receiving-side operating portion placed at the operating position to move the regulating member downwardly against an elastic force, thus permitting movement of the receiving-side movable portion, then said first engageable member engages with the second receiving-side operating portion to rotate the receiving-side movable portion and to interrelatedly rotate the receiving-side shutter portion from the developer-reception-permitting position to the developer-reception-preventing position, and wherein when the process cartridge enters the main assembly of the apparatus in a state that said developer supply cartridge is set in the main assembly of the apparatus, said first engageable member releases, prior to said supplying side shutter portion opening said developer supply opening, the receiving side movable portion from the regulating member by contacting the regulating member which regulates rotation of the receiving side movable portion with the first receiving side operating portion placed at the operating position to move the regulating member downwardly against an elastic force, thus permitting movement of the receiving side movable portion, then said first engageable member engages the first receiving side operating portion to rotate the receiving side movable portion and to interrelatedly rotate the receiving side shutter portion from the developer reception preventing position to the developer reception permitting position;

a second engageable member fixed at a position downstream of said developer supply opening with respect to the entering direction, wherein when said developer supply cartridge is removed from the main assembly of the apparatus in a state that said process cartridge is set in the main assembly of the apparatus, said second engageable member releases, after said supplying-side shutter portion closes said developer supply opening, the receiving-side movable portion from the regulating member by contacting the regulating member which regulates rotation of the receiving-side movable portion with the second receiving-side operating portion placed at the operating position to move the regulating member downwardly against an elastic force, thus permitting movement of the receiving-side movable portion, then said second engageable member engages with the second receiving-side operating portion to rotate the receiving-side movable portion and to interrelatedly rotate the receiving-side shutter portion from the developer-reception-permitting position to the developer-reception-preventing position, and wherein when said developer supply cartridge enters the main assembly of the apparatus in a state that the process cartridge is set in the main assembly of the apparatus, said second engageable member releases, prior to said supplying side shutter portion opening said developer supply opening, the receiving side movable portion from the regulating member by contacting the regulating member which regulates rotation of the receiving side movable portion with the first receiving side operating portion placed at the operating position to move the regulating member downwardly against an elastic force, thus permitting movement of the receiving side movable portion, then the second engageable member engages the first receiving side operating portion to rotate the receiving side movable portion and to interrelatedly rotate the receiving side shutter portion from the developer reception preventing position to the developer reception permitting position; and a supplying-side movable portion that rotates said supplying-side shutter portion from said developer-supply-permitting position to said developer-supply-preventing position, wherein when the process cartridge is removed from the main assembly of the apparatus in a state that said developer supply cartridge is set in the main assembly of the apparatus, said supplying-side movable portion is rotated, prior to said first engageable member causing the receiving-side shutter portion to close the developer receiving opening, by engagement with the receiving-side movable portion which is regulated by the regulating member with the second receiving-side operating portion placed at the operating position, and in interrelation with rotation of said supplying-side movable portion, said supplying-side shutter portion is moved from the developer-supply-permitting position to the developer-supply-preventing position, and wherein when said developer supply cartridge is removed from the main assembly of the apparatus in a state that the process cartridge is set in the main assembly of the apparatus, said supplying-side movable portion is rotated, prior to said second engageable member causing the receiving-side shutter portion to close the developer receiving opening, by engagement with the receiving-side movable portion which is regulated by the regulating member with the second receiving-side operating portion placed at the operating position, and in interrelation with rotation of said supplying-side movable portion, said supplying-side shutter portion is moved from the developer-supply-permitting position to the developer-supply-preventing position, and wherein when the process cartridge enters the main assembly of the apparatus in a state that said developer supply cartridge is set in the main assembly of the apparatus, said supplying side movable portion is rotated, after said first engageable member causes the receiving side shutter portion to open the developer receiving opening, by engagement with the receiving side movable portion which is regulated by the regulating member with the second receiving side operating portion placed at the operating position, and in interrelation with rotation of said supplying side movable portion, said supplying side shutter portion is rotated from the developer supply preventing position to the developer supply permitting position, and wherein when said developer supply cartridge enters the main assembly of the apparatus in a state that the process cartridge is set in the main assembly of the apparatus, said supplying side movable portion is rotated, after said second engageable member causes the receiving side shutter portion to open the developer receiving opening, by engagement with the receiving side movable portion which is regulated by the regulating member with the second receiving side operating portion placed at the operating position, and in interrelation with rotation of said supplying side movable portion, said supplying side shutter portion is rotated from the developer supply preventing position to the developer supply permitting position.

5. A developer supply cartridge according to claim 4, wherein said supplying-side shutter portion is disposed on a lower surface of said developer supply cartridge in a state that said developer supply cartridge is set in the main assembly of the apparatus and includes a rotatable member rotatable about a horizontal axis crossing a longitudinal direction of said developer supply cartridge, said rotatable member being provided with an opening which opens in a radial direction of rotation of said rotatable member, and wherein the developer supply opening is opened by said opening of said rotatable member opposing to the developer supply opening, and the developer supply opening is closed by a portion of said rotatable member other than said opening opposing to the developer supply opening.

6. A developer supply cartridge according to claim 5, wherein said supplying-side movable portion is rotatable, and a supplying-side operating portion includes a projection having a portion extending along a rotational movement direction of said supplying-side movable portion, and wherein the receiving-side movable portion is rotatable, and one of the first and second receiving-side operating portions includes a projection having a portion extending along the rotational moving direction of the receiving-side movable portion, said projection of said supplying-side movable portion is engageable with a projection of the receiving-side movable portion to receive a rotating force, thus rotating said supplying-side shutter portion.

7. An electrophotographic image forming apparatus to which a process cartridge and a developer supply cartridge for supplying a developer into the process cartridge are detachably mountable, independently from each other, to a main assembly of said apparatus, said apparatus comprising:

(i) said developer supply cartridge detachably mountable to the main assembly of said apparatus, said developer supply cartridge including, a supplying side developer accommodating portion that accommodates the developer, a developer supply opening that supplies the developer from said supplying side developer accommodating portion into said process cartridge, a supplying side shutter portion movable between a developer supply permitting position for opening said developer supply opening and a developer supply preventing position for closing said developer supply opening, a supplying side movable portion movable to interrelatedly move said supplying side shutter portion between said developer supply permitting position and said developer supply preventing position, and an engageable member; and (ii) said process cartridge detachably mountable to the main assembly of said apparatus, said process cartridge including, an electrophotographic photosensitive drum, a developing roller that develops an electrostatic latent image formed on said electrophotographic photosensitive drum, a receiving side developer accommodating portion that accommodates the developer, a developer receiving opening that receives the developer, a receiving side shutter portion movable between a developer reception permitting position for opening said developer receiving opening and a developer reception preventing position for closing said developer receiving opening, a regulating member, and a receiving side movable portion movable to interrelatedly move said receiving side shutter portion between the developer reception permitting position and the developer reception preventing position, said receiving side movable portion including a first receiving side operating portion which takes an operating position when said receiving side shutter portion is at the developer reception preventing position and a second receiving side operating portion which takes the operating position when said receiving side shutter portion is at the developer reception permitting position, wherein when said process cartridge enters the main assembly of said apparatus with said regulating member regulating movement to place said first receiving side operating portion at the operating position in a state that said developer supply cartridge is set in the main assembly of said apparatus, said regulating member contacts said engageable member to release said receiving side movable portion, thus permitting movement of said receiving side movable portion, then said receiving side movable portion moves said receiving side shutter portion to the developer reception permitting position in interrelation with said first receiving side operating portion being moved by contacting the engageable member, and then said receiving side movable portion moves said supplying side shutter portion to the developer supply permitting position in interrelation with said supplying side movable portion being moved by engagement of said second receiving side operating portion with said supplying side movable portion while being regulated by said regulating member in a state that said second receiving side operating portion is placed at the operating position, and wherein when said process cartridge is removed from the main assembly of said apparatus in a state that said developer supply cartridge is set in the main assembly of said apparatus, said second receiving side operating portion moves said supplying side movable portion by engagement, with said supplying side movable portion which is regulated by said regulating member in a state that said receiving side movable portion is placed at the operating position to interrelatedly move said supplying side shutter portion to the developer supply preventing position, then said regulating member contacts said engageable member to release said receiving side movable portion, thus permitting movement of said receiving side movable portion, and said receiving side movable portion moves said receiving side shutter portion to the developer reception preventing position in interrelation with said first receiving side operating portion being moved by contacting said engageable member.

8. An apparatus according to claim 7, wherein said receiving side shutter portion is disposed on an upper surface of said process cartridge in a state that said process cartridge is mounted to the main assembly of said apparatus and includes a rotatable member rotatable about a horizontal axis crossing with a longitudinal direction of said process cartridge, said rotatable member being provided with an opening which opens in a radial direction of rotation of said rotatable member, wherein said developer receiving opening is opened by said opening of said rotatable member opposing said developer receiving opening, and said developer receiving opening is closed by a portion of said rotatable member other than said opening opposing to said developer receiving opening.

9. An apparatus according to claim 8, wherein said receiving side movable portion is rotatable, wherein said first receiving side operating portion includes a projection having a portion extending along a rotational movement direction of said receiving side movable portion, and said projection receives a force by engagement with said engageable member to rotate said receiving side shutter portion, wherein said second receiving side operating portion includes a projection having a portion extending along the rotational moving direction of said receiving side movable portion, said projection of said second receiving side operating portion being engageable with a projection of a supplying side operating portion of said supplying side movable portion to apply a rotating force, thus rotating said supplying side shutter portion.

10. An electrophotographic image forming apparatus to which a process cartridge and a developer supply cartridge for supplying a developer into the process cartridge are detachably mountable, independently from each other, to a main assembly of said apparatus, said apparatus comprising:

(i) said process cartridge detachably mountable to the main assembly of said apparatus, said process cartridge including an electrophotographic photosensitive drum, a developing roller that develops an electrostatic latent image formed on said electrophotographic photosensitive drum, a receiving side developer accommodating portion that accommodates the developer, a developer receiving opening that receives the developer into said receiving side developer accommodating portion, a receiving side shutter portion movable between a developer reception permitting position for opening said developer receiving opening and a developer reception preventing position for closing said developer receiving opening, a receiving side movable portion rotatable to interrelatedly move said receiving side shutter portion between the developer reception permitting position and the developer reception preventing position, said receiving side movable portion including a first receiving side operating portion which takes an operating position when said receiving side shutter portion is at said developer reception preventing position, and a second receiving side operating portion which takes the operating position when said receiving side shutter portion is at said developer reception permitting position, and a regulating member that regulates rotation of said receiving side movable portion when said first or second receiving side operating portion is at the operating position; and (ii) said developer supply cartridge detachably mountable to the main assembly of said apparatus, said developer supply cartridge including, a supplying side developer accommodating portion that accommodates the developer, a developer supply opening that supplies the developer from said supplying side developer accommodating portion into said process cartridge through said developer receiving opening, a supplying side shutter portion movable between a developer supply permitting position for opening said developer supply opening and a developer supply preventing position for closing said developer supply opening, a first engageable member fixed at a position upstream of said developer supply opening with respect to an entering direction in which said developer supply cartridge enters said main assembly of said apparatus, wherein when said process cartridge enters the main assembly of said apparatus in a state that said developer supply cartridge is set in the main assembly of said apparatus, said first engageable member releases, prior to said supplying side shutter portion opening said developer supply opening, said receiving side movable portion from said regulating member by contacting said regulating member which regulates rotation of said receiving side movable portion with said first receiving side operating portion placed at said operating position to move said regulating member downwardly against an elastic force, thus permitting movement of said receiving side movable portion, then said first engageable member engages with said first receiving side operating portion to rotate said receiving side movable portion and to interrelatedly rotate said receiving side shutter portion from said developer reception preventing position to said developer reception permitting position, and wherein when said process cartridge enters the main assembly of said apparatus in a state that said developer supply cartridge is set in the main assembly of said apparatus, said first engageable member releases, prior to said supplying side shutter portion opening said developer supply opening, said receiving side movable portion from said regulating member by contacting said regulating member which regulates rotation of said receiving side movable portion with said first receiving side operating portion placed at said operating position to move said regulating member downwardly against an elastic force, thus permitting movement of said receiving side movable portion, then said first engageable member engages with said first receiving side operating portion to rotate said receiving side movable portion and to interrelatedly rotate said receiving side shutter portion from said developer reception preventing position to said developer reception permitting position, a second engageable member fixed at a position downstream of said developer supply opening with respect to the entering direction, wherein when said developer supply cartridge enters the main assembly of said apparatus in a state that said process cartridge is set in the main assembly of said apparatus, said second engageable member releases, prior to said supplying side shutter portion opening said developer supply opening, said receiving side movable portion from said regulating member by contacting said regulating member which regulates rotation of said receiving side movable portion with said first receiving side operating portion placed at said operating position to move said regulating member downwardly against an elastic force, thus permitting movement of said receiving side movable portion, then said second engageable member engages with said first receiving side operating portion to rotate said receiving side movable portion and to interrelatedly rotate said receiving side shutter portion from said developer reception preventing position to said developer reception permitting position, and wherein when said developer supply cartridge enters the main assembly of said apparatus in a state that said process cartridge is set in the main assembly of said apparatus, said second engageable member releases, prior to said supplying side shutter portion opening said developer supply opening, said receiving side movable portion from said regulating member by contacting said regulating member which regulates rotation of said receiving side movable portion with said first receiving side operating portion placed at said operating position to move said regulating member downwardly against an elastic force, thus permitting movement of said receiving side movable portion, then said second engageable member engages with said first receiving side operating portion to rotate said receiving side movable portion and to interrelatedly rotate said receiving side shutter portion from said developer reception preventing position to said developer reception permitting position, and a supplying side movable portion that rotates said supplying side shutter portion from said developer supply preventing position to said developer supply permitting position, wherein when said process cartridge enters the main assembly of said apparatus in a state that said developer supply cartridge is set in the main assembly of said apparatus, said supplying side movable portion is rotated, after said first engageable member causes said receiving side shutter portion to open said developer receiving opening, by engagement with said receiving side movable portion which is regulated by said regulating member with said second receiving side operating portion placed at said operating position, and in interrelation with rotation of said supplying side movable portion, said supplying side shutter portion is rotated from said developer supply preventing position to said developer supply permitting position, and wherein when said developer supply cartridge enters the main assembly of said apparatus in a state that said process cartridge is set in the main assembly of said apparatus, said supplying side movable portion is rotated, after said second engageable member causes said receiving side shutter portion to open said developer receiving opening, by engagement with said receiving side movable portion which is regulated by said regulating member with said second receiving side operating portion placed at said operating position, and in interrelation with rotation of said supplying side movable portion, said supplying side shutter portion is rotated from said developer supply preventing position to said developer supply permitting position, and wherein when said process cartridge enters the main assembly of said apparatus in a state that said developer supply cartridge is set in the main assembly of said apparatus, said supplying side movable portion is rotated, after said first engageable member causes said receiving side shutter portion to open said developer receiving opening, by engagement with said receiving side movable portion which is regulated by said regulating member with said second receiving side operating portion placed at said operating position, and in interrelation with rotation of said supplying side movable portion, said supplying side shutter portion is rotated from said developer supply preventing position to said developer supply permitting position, and wherein when said developer supply cartridge enters the main assembly of said apparatus in a state that said process cartridge is set in the main assembly of said apparatus, said supplying side movable portion is rotated, after said second engageable member causes said receiving side shutter portion to open said developer receiving opening, by engagement with said receiving side movable portion which is regulated by said regulating member with said second receiving side operating portion placed at said operating position, and in interrelation with rotation of said supplying side movable portion, said supplying side shutter portion is rotated from said developer supply preventing position to said developer supply permitting position.

11. An apparatus according to claim 10, wherein said supplying side shutter portion is disposed on a lower surface of said developer supply cartridge in a state that said developer supply cartridge is set in the main assembly of said apparatus and includes a rotatable member rotatable about a horizontal axis crossing a longitudinal direction of said developer supply cartridge, said rotatable member being provided with an opening which opens in a radial direction of rotation of said rotatable member, and wherein said developer supply opening is opened by said opening of said rotatable member opposing said developer supply opening, and said developer supply opening is closed by a portion of said rotatable member other than said opening opposing to said developer supply opening.

12. A developer supply cartridge according to claim 11, wherein said supplying side movable portion is rotatable, and said supplying side operating portion includes a projection having a portion extending along a rotational movement direction of said supplying side movable portion, and wherein said receiving side movable portion is rotatable, and one of the first and second receiving side operating portions includes a projection having a portion extending along the rotational moving direction of said receiving side movable portion, said projection of said supplying side movable portion being engageable with a projection of a receiving side movable portion to receive a rotating force, thus rotating said supplying side shutter portion.

* * * * *